US007821403B2

(12) United States Patent
Hogan

(10) Patent No.: US 7,821,403 B2
(45) Date of Patent: Oct. 26, 2010

(54) MAGNETICALLY RELEASABLE GROOVED TACK CLUTCH FOR REUSABLE AND NON-REUSABLE APPLICATIONS

(75) Inventor: Dennis L. Hogan, Boca Raton, FL (US); Paul Griffiths, legal representative, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 321 days.

(21) Appl. No.: 11/667,577

(22) PCT Filed: Nov. 16, 2005

(86) PCT No.: PCT/US2005/041813

§ 371 (c)(1),
(2), (4) Date: Feb. 27, 2008

(87) PCT Pub. No.: WO2006/055774

PCT Pub. Date: May 26, 2006

(65) Prior Publication Data

US 2008/0303675 A1 Dec. 11, 2008

Related U.S. Application Data

(60) Provisional application No. 60/628,730, filed on Nov. 17, 2004.

(51) Int. Cl.
*G08B 13/14* (2006.01)

(52) U.S. Cl. ..... 340/572.9; 340/571; 340/572.1; 340/572.7; 340/572.8; 340/568.1; 70/33; 70/34; 70/41; 24/6; 24/326; 24/327; 24/409; 24/704.1

(58) Field of Classification Search ..... 340/572.9, 340/572.1, 572.3, 572.7, 572.8, 568.1, 573.1, 340/500, 540, 825.72; 24/407.1, 326, 327, 24/6, 331, 334, 340, 347, 572, 704.1; 70/34, 70/57.1, 256, 276, 33, 39, 41, 42, 44
See application file for complete search history.

(56) References Cited

U.S. PATENT DOCUMENTS

| | | | | | |
|---|---|---|---|---|---|
| 4,502,717 | A * | 3/1985 | Close | ..... | 70/57.1 |
| 4,603,453 | A * | 8/1986 | Yokoyama | ..... | 70/57.1 |
| 4,987,754 | A * | 1/1991 | Minasy et al. | ..... | 70/57.1 |
| 5,528,914 | A * | 6/1996 | Nguyen et al. | ..... | 70/57.1 |
| 5,535,606 | A * | 7/1996 | Nguyen et al. | ..... | 70/57.1 |
| 6,191,692 | B1 * | 2/2001 | Stoltz et al. | ..... | 340/572.9 |
| 6,255,950 | B1 * | 7/2001 | Nguyen | ..... | 340/572.8 |
| 2006/0097872 | A1 * | 5/2006 | Ho | ..... | 340/572.1 |

* cited by examiner

*Primary Examiner*—Benjamin C Lee
*Assistant Examiner*—Sisay Yacob
(74) *Attorney, Agent, or Firm*—Kacvinsky LLC

(57) ABSTRACT

A system, apparatus (100) and method are described for an electronic article surveillance security tag (102) having a magnetically releasable tack retaining system, and a magnetic detaching device for use with the electronic article surveillance tag. Other embodiments are described and claimed.

34 Claims, 43 Drawing Sheets

PARTIAL CROSS SECTION OF A-A OF FIG. 9F
SHOWING SOME DIMENSIONS

MAGNETICALLY RELEASABLE GROOVED TACK CLUTCH FOR REUSABLE AND NON-REUSABLE APPLICATIONS

RELATED APPLICATIONS

This application claims benefit of earlier filed provisional patent application No. 60/628,730 titled "Magnetically Releasable Grooved Tack Clutch For Reusable And NonReusable Applications" filed on Nov. 17, 2004, the entirety of which is hereby incorporated by reference for all purposes.

BACKGROUND

An Electronic Article Surveillance (EAS) system is designed to prevent unauthorized removal of an item from a controlled area. A typical EAS system may comprise a monitoring system and one or more security tags. The monitoring system may create a surveillance zone at an access point for the controlled area. A security tag may be fastened to the monitored item, such as a garment or article of clothing. If the monitored item enters the surveillance zone, an alarm may be triggered indicating unauthorized removal of the monitored item from the controlled area.

Security tags are typically attached to the article of clothing using a metal tack having a large head. During attachment operations, the tack may be inserted through the clothing fabric and into a tack shank hole in the security tag where the tack shank is securely retained. During detachment operations, the tag may be released from the security tag and the garment at the point of sale.

Security tags may generally comprise one of two types. One type of security tag may be designed for reuse. For example, a security tag may be detached from the monitored item at the point of sale in a manner that does not substantially harm the integrity of the security tag, either externally or internally. Once detached, the reusable tag may be reattached to another item. Another type of security tag may be designed for single use. For example, a security tag may be detached from the monitored item at the point of sale in a manner that typically harms the integrity of the security tag. Once detached, a single-use security tag cannot be reattached again to another item.

Both types of security tags may be unsatisfactory for a number of reasons. For example, conventional reusable security tags may be relatively expensive since they are made to be durable enough to withstand the rigors of continuous attaching and detaching from monitored items. Single-use security tags, however, may not be economical, or secure enough to meet the design constraints for a given security system. Consequently, there may be a need for an improved EAS system to solve these and other problems.

DETAILED DESCRIPTION

Some embodiments may be directed to a security system. The security system may comprise, for example, an EAS system. The EAS system may include a security tag, a detaching device and monitoring system. In general operation, the security tag may include a sensor to emit a detectable signal when it is in the monitored surveillance zone. The security tag may be attached to an item to be monitored, such as a garment or article of clothing. The detaching device may remove the security tag from the item. The monitoring system may monitor a controlled area for the signal to ensure that the monitored item with the security tag is not removed from the controlled area.

Various embodiments may include a system that can address the use of reusable and single-use security tags. A system that may address the use of both types of tags may be desirable for modern hypermarket type retail stores. Inexpensive single use security tags make it economical to tag less expensive items, whereas more expensive items can still be tagged with the more expensive reusable type of security tag. Both types of security tags could be removed from the items with the same detaching device as described herein.

Figure 1A:
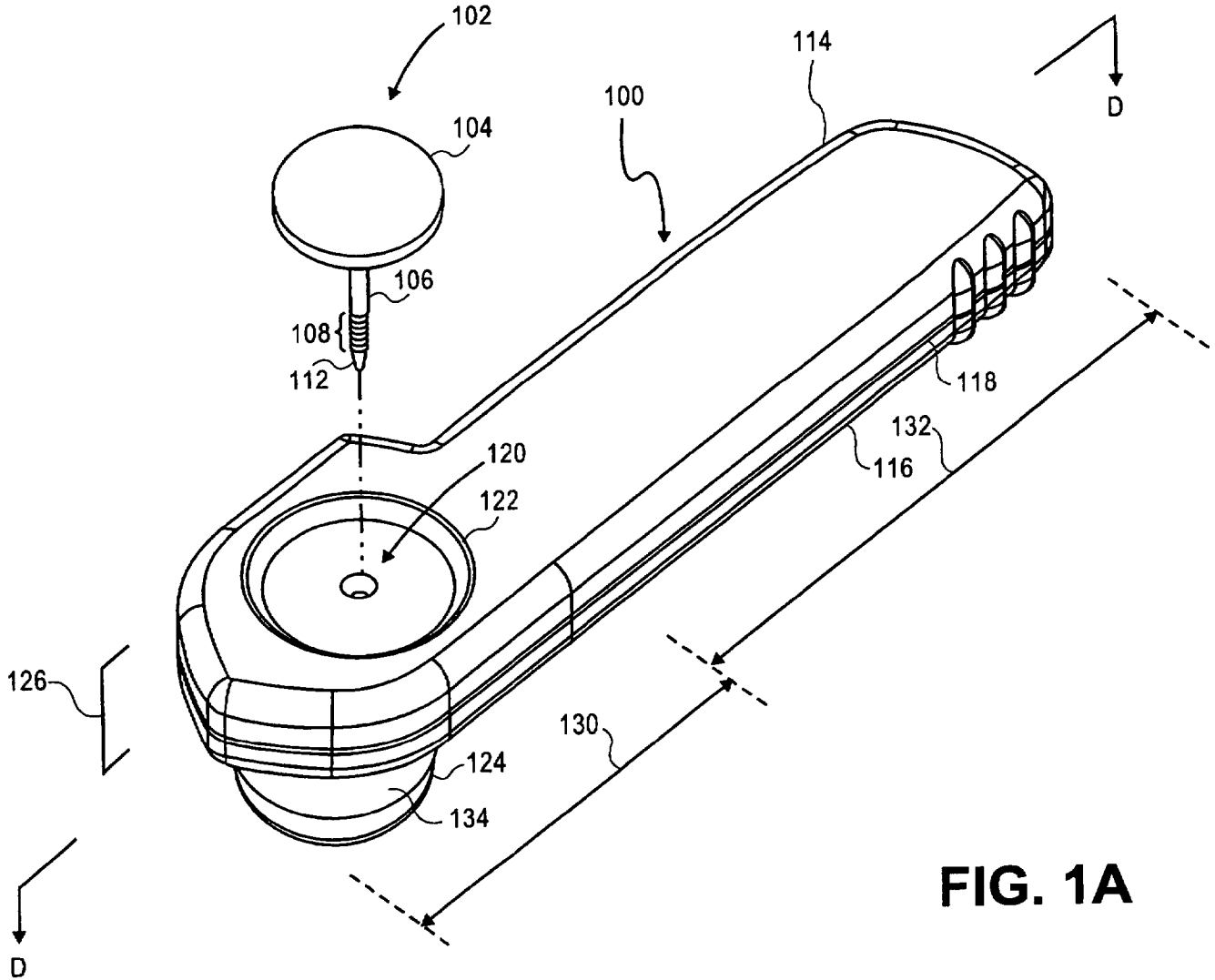
FIG. 1A illustrates a security tag and a tack assembly in accordance with one embodiment.

FIG. 1A illustrates a security tag and a tack assembly in accordance with one embodiment. FIG. 1A may illustrate a security tag 100 and a tack assembly 102. Security tag 100 may be implemented with a tack retaining system. A tack retaining system may refer to one or more elements arranged to retain tack assembly 102 when inserted into security tag 100. Security tag 100 may be implemented as a reusable security tag or a single-use security tag depending on the type of tack retaining system implemented for security tag 100. The embodiments are not limited in this context.

In one embodiment, for example, security tag 100 may be implemented using a reusable tack retaining system. A reusable security tag may be detached from a monitored item in a manner that does not substantially harm the integrity of the security tag, either externally or internally. Once a reusable security tag is detached, it may generally be reattached to another item. Detachment indicates the tag is the unlocked condition.

In one embodiment, for example, security tag 100 may be implemented using a single-use tack retaining system. A single-use security tag may be detached from the monitored item in a manner that typically harms the integrity of the security tag. Once a single-use security tag is detached, it generally cannot be reattached again to another item. Detachment indicates the tag is in the permanently unlocked condition.

In one embodiment, tack assembly 102 may comprise an enlarged tack head 104 and an elongated tack shank 106. Tack shank 106 may have one or more grooves 108 and a pointed end 112. In one embodiment, for example, tack head 104 may have a diameter of approximately 0.5 inches, and a thickness of approximately 0.05 inches. Tack shank 106 may be similar in shape to a small pointed nail. In one embodiment, for example, tack shank 106 may be 0.75 inches long, and 0.046 inches in diameter. The grooves 108 may have a diameter of 0.038 inches. The embodiments are not limited in this context.

Security tag 100 may be implemented using various materials, to include various types of metals and plastics. For example, tack head 104 may be formed using plastic and/or steel. Tack shank 106 is typically formed using steel. A design constraint for security tag 100 may include the amount of magnetic material that is used with security tag 100, since the range of some sensors may be reduced by such magnetism. Consequently, tack assembly 102 may be implemented using a plastic material for tack head 104 to reduce the overall amount of steel in tack assembly 102. Another potential option is to use non-magnetic stainless steel to manufacture tack assembly 102. The embodiments, however, are not limited to a particular material for tack assembly 102, as long as they are designed to operate compatibly with each other.

In one embodiment, tack assembly 102 may be used to attach security tag 100 to an item. The item may comprise any commercial good, such as a garment, article of clothing, packaging material, digital versatile disc (DVD) jewel case, compact disk (CD) jewel case, glasses, boxes, and so forth. When the item is a garment or article of clothing, pointed end 112 may be inserted through the garment and into security tag 100. The attachment operation may be discussed in more detail below.

In one embodiment, tack assembly 102 may also include additional features, such as a lanyard or security strap attached to tack head 104. The lanyard or security strap may allow security tag 100 to be used with items where penetration of the item is not desired or possible. For example, packaged items such as sports equipment, electronics and any other product may be secured with the lanyard through a stable portion of the packaging or product itself. The embodiments are not limited in this context.

In one embodiment, security tag 100 may be smaller in size than some conventional security tags. In one embodiment, for example, security tag 100 may be approximately 2.6 inches long, 0.8 inches wide, and 0.25 inches thick. With tack assembly 102 inserted into security tag 100, the thickness may increase to approximately 0.67 inches. The total weight may be approximately 6 grams. The embodiments, however, are not limited to these particular metrics.

In one embodiment, security tag 100 may comprise an upper housing 114 and a lower housing 116. Upper housing 114 and lower housing 116 may be joined at seam 118 to form the closed security tag 100. In one embodiment, housings 114 and 116 may be made of a semi-hard or rigid material. A usable rigid or semi-hard material may include a hard plastic such as an injection molded Acrylonitrate-Butadiene-Styrene (ABS) plastic, or a plastic such as polycarbonate. If a plastic material is used, the mating of housings 114 and 116 may be accomplished using an ultrasonic weld, snap fitting, or any other suitable joining mechanism desired for a given implementation. The embodiments are not limited in this context.

In one embodiment, security tag 100 may comprise a first end 130 and a second end 132. First end 130 and second end 132 may be partially hollow, with each end having a compartment. First end 130 may have a first compartment to hold a tack retaining system. In one embodiment, for example, the tack retaining system may include a steel wedge shaped member and a rubber bias spring to retain tack shank 106 of tack assembly 102. First end 130 may also be referred to herein as an "attachment end" or "tack retaining system end." Second end 132 may have a second compartment to hold a sensor to emit a signal detectable by the monitoring system. An example of a sensor suitable for use with security tag 100 may include the EAS Ultra-Max® narrow label sensor made by Sensormatic® Electronics Corporation ("UltraMax Sensor"). Second end 132 may also be referred to herein as a "detection end."

In one embodiment, first end 130 may comprise a tag head 126. Tag head 126 may further comprise an upper housing aperture 120 and a concentric rampart 122. First end 130 may be approximately 0.9 inches long and 0.825 inches wide. The shape may be similar to a half circle with a diameter of approximately 0.825 inches. The embodiments are not limited in this context.

In one embodiment, first end 130 may also comprise a detacher interface for use with a detaching device, such as magnetic detaching device 602 as described with reference to FIG. 6. For example, first end 130 may include a protrusion 124 having an outer wall 134. Protrusion 124 may comprise any desired shape, as long as the desired shape appropriately interfaces with the detaching device. In one embodiment, for example, protrusion 124 may have a cylindrical shape, as shown in FIG. 1A. The embodiments are not limited in this context.

In one embodiment, second end 132 may be approximately 1.8 inches long, 0.62 inches wide and 0.22 inches thick. The shape may be similar to a rectangle. The shape and dimensions of second end 132 may allow second end 132 to act as a handle to place the protrusion 124 into the magnetic detaching device described herein.

Figure 1B:
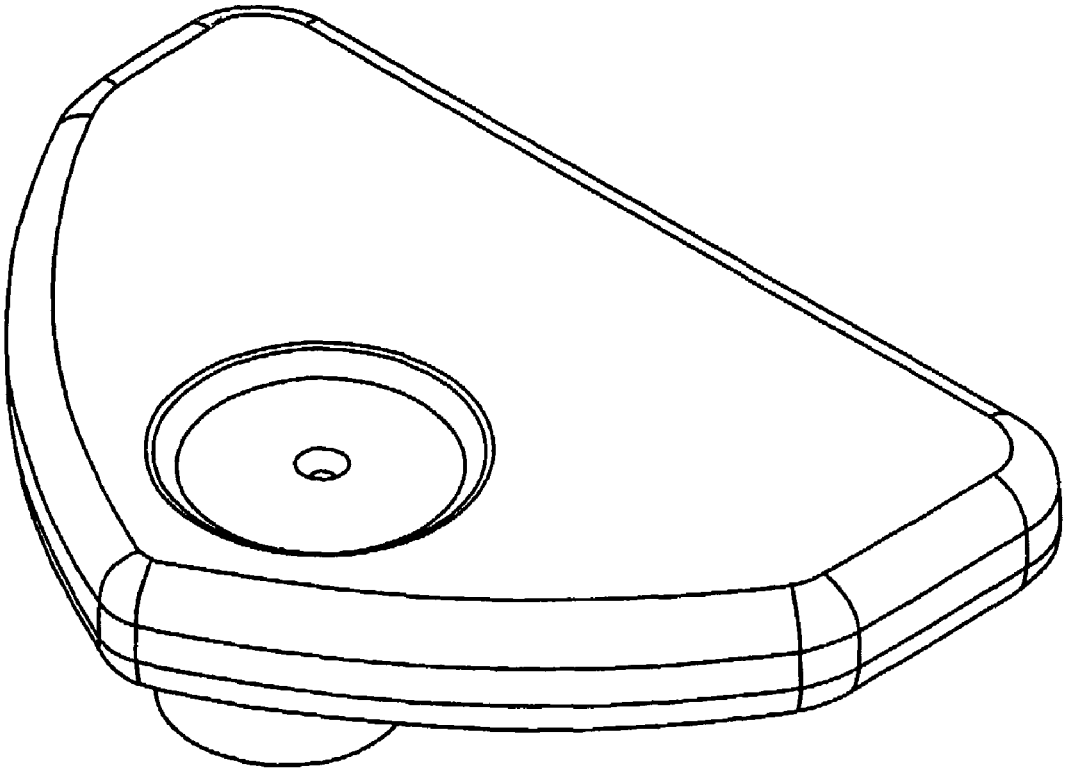
FIG. 1B illustrates a security tag assembly in accordance with one embodiment.

FIG. 1B illustrates a security tag assembly in accordance with one embodiment. FIG. 1B may illustrate another possible embodiment of security tag 100 that is similar to the embodiment described with reference to FIG. 1A. As shown in FIG. 1B, second end 132 may be formed 90° with respect to first end 130. The embodiments are not limited in this context.

As illustrated in FIGS. 1A and 1B, security tag 100 may be implemented using a number of different external shapes or configurations. It may be appreciated, however, that security tag 100 may be implemented using any number of external configurations for a given set of design constraints. The external configuration used for a particular implementation should be made in accordance with the design and configuration of the compatible magnetic detaching device used to detach security tag 100 from a monitored item. In one embodiment, for example, the external configuration shown for security tag 100 in general, and first end 130 in particular, have been designed to interface with the embodiments of a magnetic detaching device 602 as described with reference to FIG. 6. The embodiments are not limited in this context.

In one embodiment, upper housing aperture 120 of first end 130 may be used to receive tack shank 106 during the attachment operation. The diameter of upper housing aperture 120 may be a little larger than the diameter of tack shank 106 to accommodate the insertion of tack shank 106 during the attachment operation.

In one embodiment, concentric rampart 122 may be a rampart defining a space to receive tack head 104. The diameter of concentric rampart 122 may be a little larger than the diameter of tack head 104 to ensure tack head 104 may be properly seated during the attachment operation. In one embodiment, for example, the internal diameter of concentric rampart 122 may be approximately 0.66 inches. One purpose for concentric rampart 122 is to better secure the article between tack head 104 and security tag 100. As a result, this arrangement may better resist unauthorized attempts to pry tack assembly 102 away from security tag 100. The size and configuration of tack head 104, as well as the shape and size of the mating rampart 122 are not limited in this context.

Figure 2:
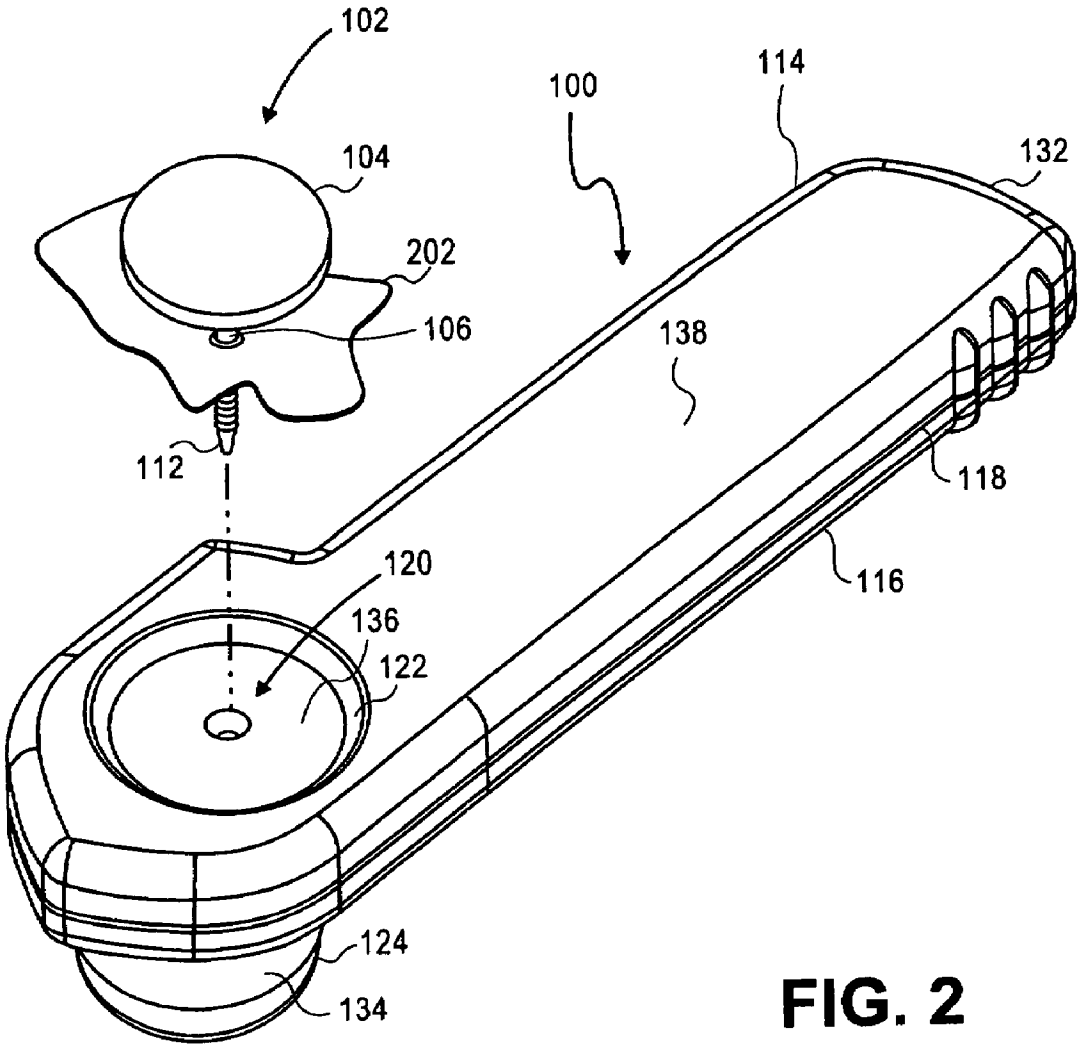
FIG. 2 illustrates a security tag, a tack assembly and an article in an unfastened position in accordance with one embodiment.

FIG. 2 illustrates a security tag, a tack assembly and an article in an unfastened position in accordance with one embodiment. FIG. 2 may illustrate the beginning of the attachment operations to fasten security tag 100 to an item, such as an article of clothing. During the attachment operation, pointed end 112 of tack body 106 may be inserted through an article 202. The size of tack head 104 helps to ensure that article 202 may not be removed from tack assembly 102 without damaging article 202.

Figure 3:
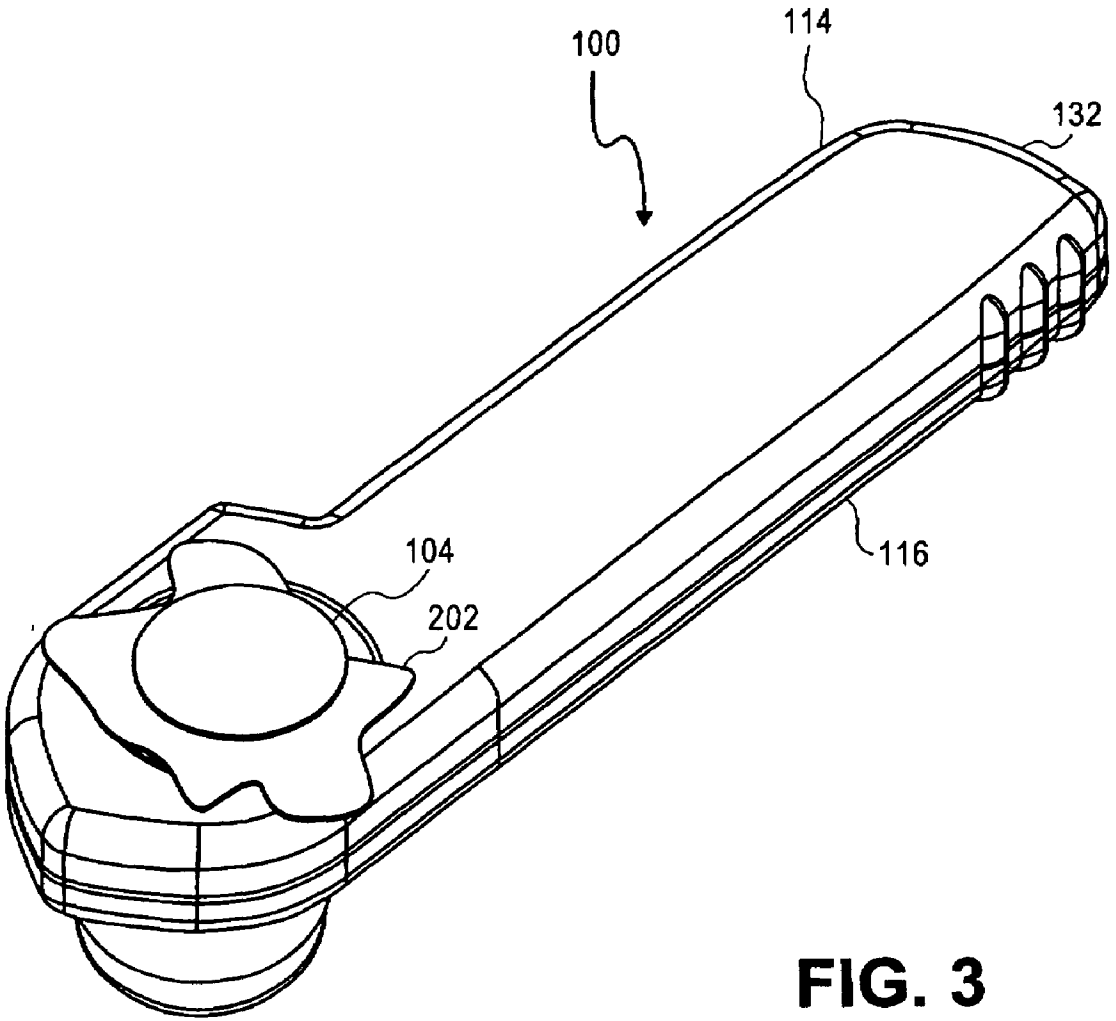
FIG. 3 illustrates a security tag, a tack assembly and an article in a fastened position in accordance with one embodiment.

FIG. 3 illustrates a security tag, a tack assembly and an article in a fastened position in accordance with one embodiment. FIG. 3 may illustrate the end of the attachment operation to fasten security tag 100 to an item, such as article 202. Once pointed end 112 of tack shank 106 is inserted through article 202, pointed end 112 may be inserted into upper housing aperture 120. Force may be applied to tack head 104 until tack head 104 is seated in concentric rampart 122. Tack assembly 102 may remain attached to security tag 100 by a tack retaining system. In one embodiment, for example, the tack retaining system may include a wedge biased by a rubber spring, as discussed in more detail below. Once seated, tack assembly 102 and security tag 100 may be securely attached to article 202. Once attachment operations have been properly performed, the detachment of security tag 100 from article 202 may be accomplished using magnetic detaching device 602.

Figure 4:
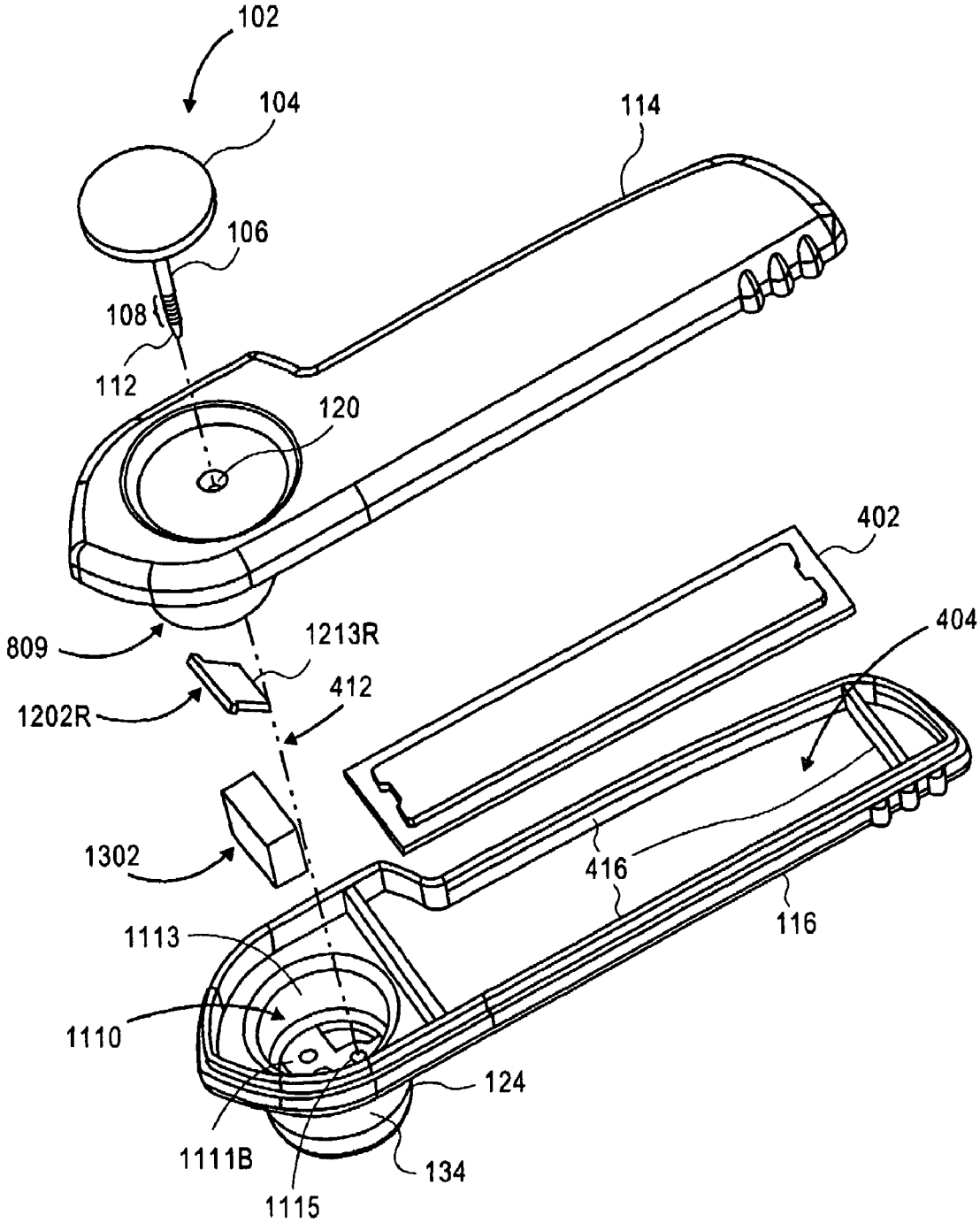
FIG. 4 illustrates a first perspective view of a disassembled security tag in accordance with one embodiment.

FIG. 4 illustrates a first perspective view of a disassembled security tag in accordance with one embodiment. FIG. 4 illustrates a first perspective view for a disassembled security tag 100 suitable for use as a reusable security tag. The first perspective view illustrates in particular the exterior of upper housing 114, and the interior of lower housing 116.

In one embodiment, security tag 100 may include a sensor 402. Sensor 402 may comprise any sensor capable of generating a detectable signal, such as a magnetic sensor, an acoustic magnetic sensor, a Radio-Frequency (RF) sensor, or other type of sensor. In one embodiment, for example, sensor 402 may comprise the UltraMax Sensor. The signal may be detected by an EAS monitoring system. The EAS monitoring system may include, for example, a transmitter/receiver ("transceiver") to detect the signals, and inform a monitoring system of the presence or absence of security tag 100 in the surveillance zone.

In one embodiment, lower housing 116 may have a sensor compartment 404. Sensor compartment 404 may be representative of, for example, the second compartment discussed with reference to FIG. 1A. Sensor compartment 404 may comprise a plurality of walls 416 to define an area large enough for a given sensor. In one embodiment, for example, sensor 404 may be an UltraMax Sensor having the dimensions of 1.73 inches long, 0.46 inches wide and 0.085 inches thick. Other lengths and sizes can accommodate other detection technologies. Walls 416 may correspond to similar walls for upper housing 114.

In one embodiment, lower housing 116 may also have a pocket 1110, as described with reference to FIG. 11. Pocket 1110 may provide a bearing surface 1111B for a rubber spring 1302, as described in more detail with reference to FIG. 13. The circular inside wall 1113 may guide and secure circular protrusion 809 of upper housing 114 when upper housing 114 and lower housing 116 are joined together to form security tag 100.

Figure 5:
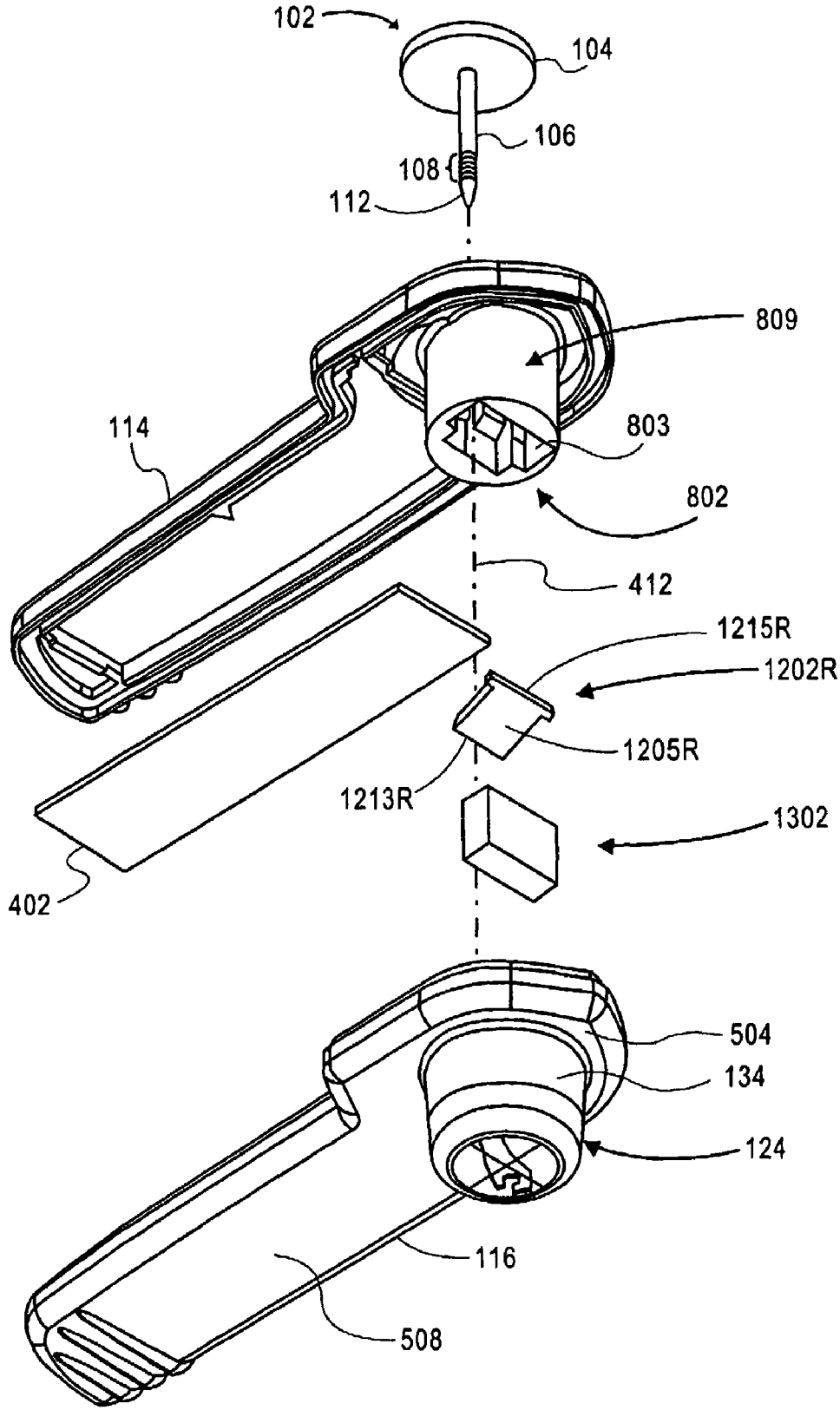
FIG. 5 illustrates a second perspective view of a disassembled security tag in accordance with one embodiment.

FIG. 5 illustrates a second perspective view of a disassembled security tag in accordance with one embodiment. FIG. 5 illustrates a second perspective view for a disassembled security tag 100 suitable for use as a reusable security tag. The second perspective view illustrates in particular the interior of upper housing 114, and the exterior of lower housing 116.

In one embodiment, upper housing 114 may include a wedge compartment 802 that is formed within protrusion 809, as described in more detail with reference to FIG. 8A. Wedge compartment 802 may be representative of, for example, the first compartment discussed with reference to FIG. 1A. Wedge compartment 802 may comprise a plurality of side walls 803 to define an area large enough for a wedge 1202R as described in more detail with reference to FIG. 12A, and a rubber spring 1302 as described in more detail with reference to FIG. 13. For example, wedge compartment 802 may be designed to receive and loosely constrain wedge 1202R and rubber spring 1302. Compartment 802 may also be defined by a plurality of posts, recesses, or other structures that define an area that receives wedge 1202R and rubber spring 1302. Once housings 114 and 116 are joined at seam 118, the first and second compartments may be closed and sealed. Sensor 402 may be securely contained, although not deformed, within sensor compartment 404. Wedge 1202R and rubber spring 1302 may be securely contained within wedge compartment 802 thereby forming a tack retaining system.

Positioning rubber spring 1302 between wedge surface 1205R and the bearing surface 1111B may cause wedge 1202R to be biased inwardly into wedge compartment 802. When tack assembly 102 is inserted through upper housing aperture 120 along line 412, tack shank 106 may intersect tack retaining edge 1213R of wedge 1202R, causing wedge 1202R to pivot approximately about pivot edge 1215R against the bias of rubber spring 1302. Tack shank 106 may slide along tack retaining edge 1213R and be biased by rubber spring 1302 into a passing tack groove 108 of tack shank 106. During the attachment operation, a portion of tack shank 106 may move into lower housing shank hole 1115. Once tack retaining edge 1213R is biased into a tack groove 108 at tack lip 107 (see FIGS. 8D and 9A), tack shank 106 cannot be retracted from aperture 120 unless the tack holding strength of the tack retaining system is overcome. In this manner security tag 100 and tack assembly 102 may be locked or fastened together to complete the attachment operation. This may be referred to herein as a "lock condition" or "locked condition."

In one embodiment, lower housing 116 may include a surface 508. Protrusion 124 may be integrally formed with surface 508. The diameter of protrusion 124 may be smaller than the size of tag head 126. In one embodiment, the diameter of protrusion 124 is approximately 0.55 inches, and may protrude 0.45 inches. The smaller size of the protrusion 124 may create a shoulder area 504. Shoulder area 504 may be relatively flat, and may be used to assist seating first end 130 and protrusion 124 into a magnetic detaching device during the detachment operation.

In one embodiment, the detachment operation may refer to detaching or releasing tack assembly 102 from wedge 1202R of security tag 100. Once tack assembly 102 is released from wedge 1202R, tack assembly 102 may be withdrawn from security tag 100. Once tack assembly 102 has been withdrawn from security tag 100, article 202 may be removed from tack body 106, thus completing the detachment operation. This may be referred to herein as an "unlocked condition." The detachment operation may be described in greater detail with reference to FIG. 6.

Figure 6:
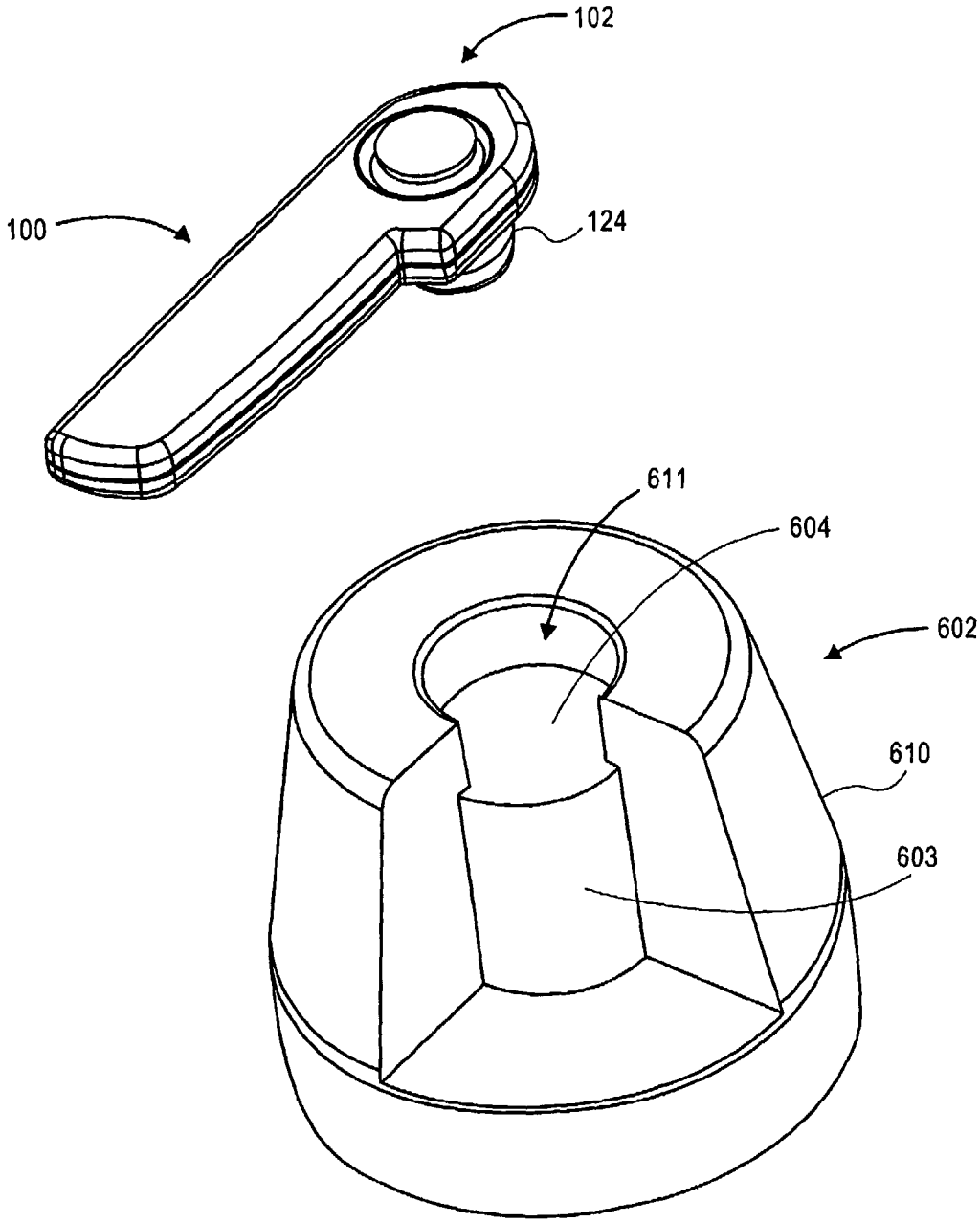
FIG. 6 illustrates a cutaway view of a security tag and tack assembly aligned with a magnetic detaching device in accordance with one embodiment.

FIG. 6 illustrates a cutaway view of a security tag and tack assembly aligned with a magnetic detaching device in accordance with one embodiment. FIG. 6 shows a view of security tag 100 being aligned over a magnetic detaching device 602. Magnetic detaching device 602 is shown in a cutaway view for clarity. Magnetic detaching device 602 may comprise, for example, a magnet assembly 603 and a housing 610. The housing 610 may be, for example, suitable for countertop mounting where the tag receiving hole 611 is above the surface of the countertop. A different housing with a bezel may be suitable for mounting in a hole in the countertop such that the opening for tag receiving hole 611 is flush or nearly flush with the countertop surface. The embodiments are not limited in this context.

In one embodiment, magnetic detaching device 602 may have a tag interface. The tag interface may be arranged to interface with the detacher interface of security tag 100. In one embodiment, for example, the tag interface may comprise tag receiving hole 611. The diameter for the opening of tag receiving hole 611 may be designed to accept tag protrusion 124 loosely for easy insertion by the user, yet still assure proper tag location for detachment. The depth of tag receiving hole 611 may be arranged to allow proper detachment of the tack from the tag, which is typically slightly less than the length of the tag protrusion 124. In one embodiment, for example, the external configuration shown for magnetic detaching device 602 has been designed to interface with the embodiments of security tag 100 as described with reference to FIGS. 1A and 1B. The embodiments, however, are not limited in this context as long as the detacher interface and tag interface are compatible.

Figure 7:
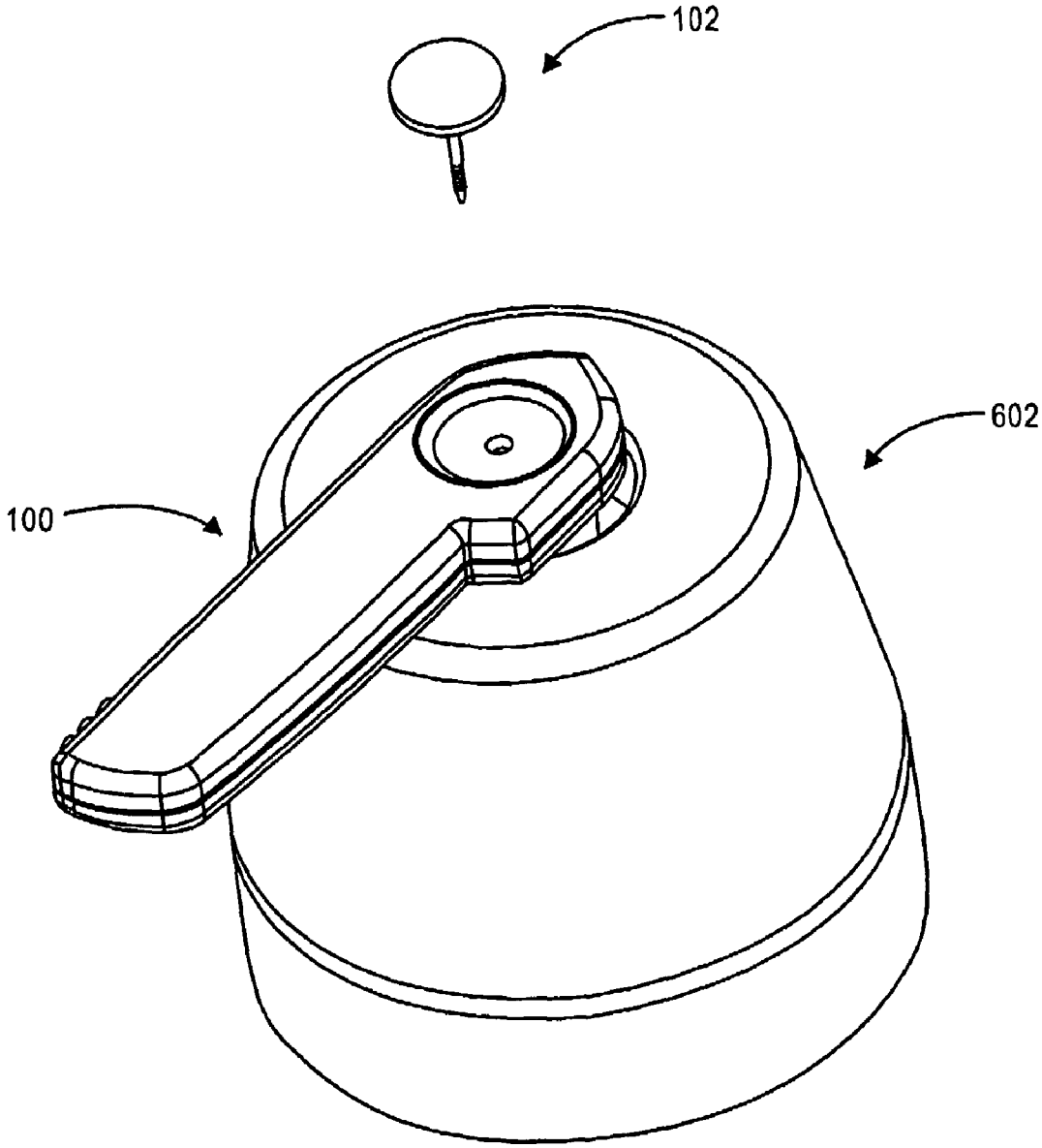
FIG. 7 illustrates a security tag inserted into a magnetic detaching device in accordance with one embodiment.

FIG. 7 illustrates a security tag inserted into a magnetic detaching device in accordance with one embodiment. FIG. 7 illustrates security tag 100 when placed within magnetic detaching device 602. More particularly, FIG. 7 illustrates security tag 100 and tack assembly 102 as seated within or on magnetic detaching device 602. This position may facilitate the detachment of tack assembly 102 from security tag 100.

Figure 8A:
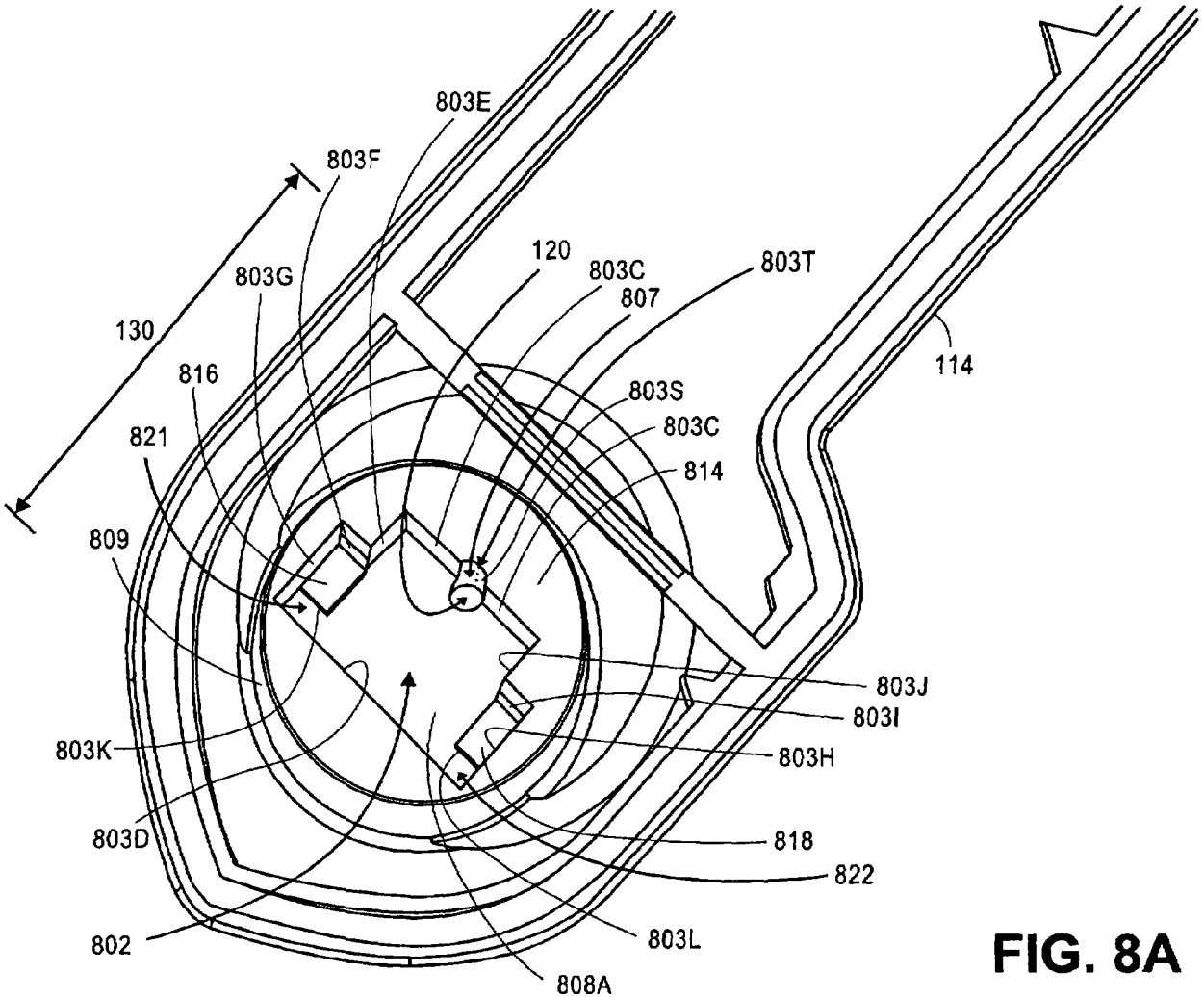
FIG. 8A illustrates an interior view of an upper housing for a security tag in accordance with one embodiment.
Figure 12A:
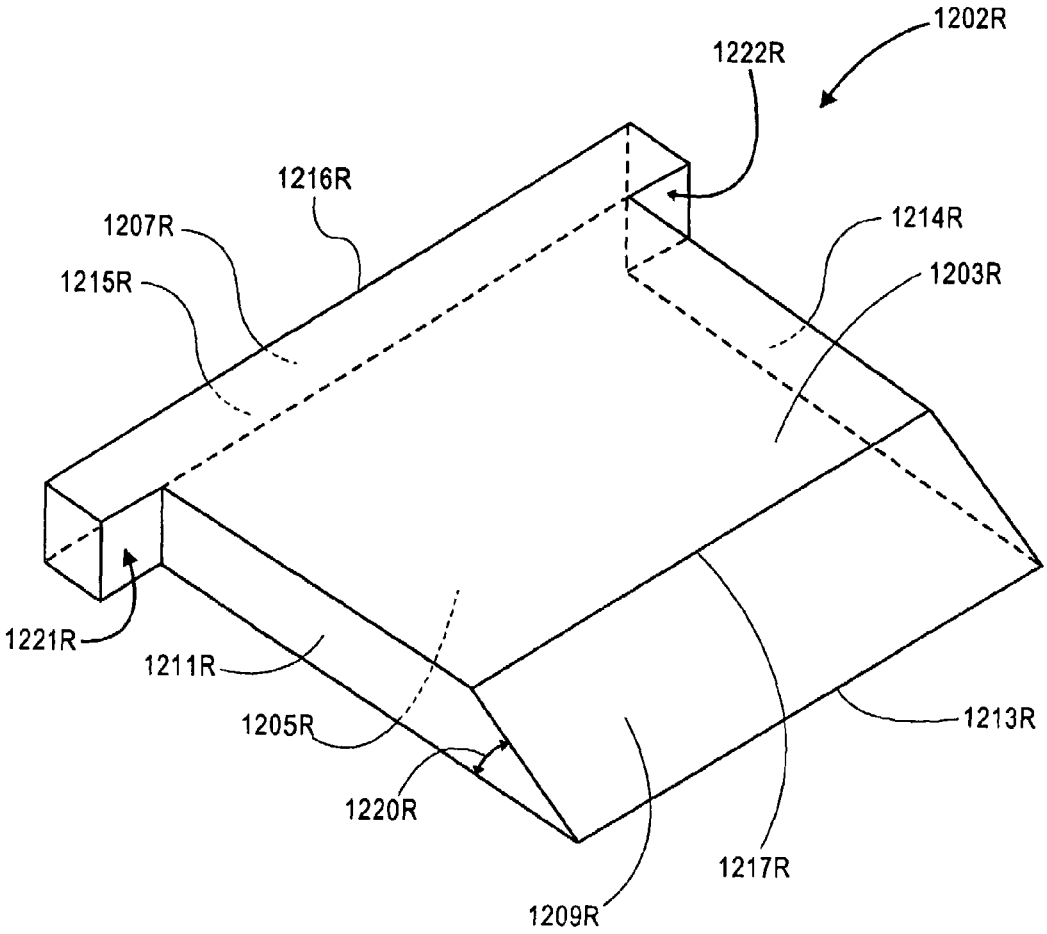
FIG. 12A illustrates a first view of a wedge for a security tag in accordance with one embodiment.
Figure 12B:
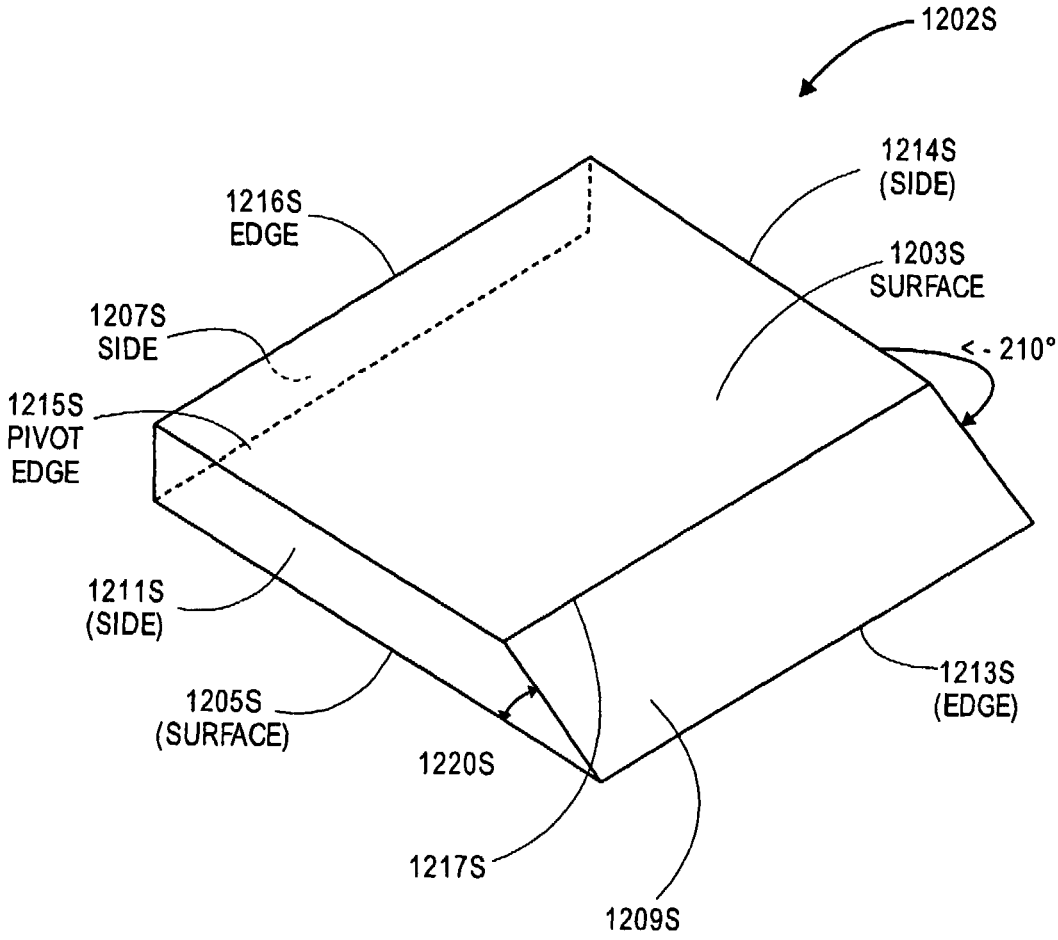
FIG. 12B illustrates a second view of a wedge for a security tag in accordance with one embodiment.

FIG. 8A illustrates an interior view of an upper housing for a security tag in accordance with one embodiment. FIG. 8A shows a detailed view of a wedge compartment 802 of upper housing 114, and in particular the wedge compartment 802 for a tack retaining system as arranged within end 130. This arrangement may be suitable for use in both a reusable or single-use security tag. One difference between the two implementations is the shape of the wedge. In a reusable security tag, the wedge may have axel protrusions as shown in FIG. 12A, which are not necessarily present in the wedge used for a single-use security tag as shown in FIG. 12B. The use of an "R" suffix to the wedge designator numeral may refer to a tack retaining system suitable for use with a reusable security tag (e.g., 1202R, 1213R, and so forth). The use of an "S" suffix to the wedge designator numeral may refer to a tack retaining system suitable for use with a single-use security tag (e.g., 1202S, 1213S, and so forth). If no wedge designator numeral suffix is used (e.g. 1202, 1213, and so forth), the description may relate to one or both the reusable wedge 1202R and the single use wedge 1202S. The embodiments are not limited in this context.

As shown in FIG. 8A, wedge compartment 802 may comprise several internal walls. A tack shank hole 807 may comprise the space in which tack shank 106 can move and occupy along line 412, as shown in FIG. 2. Tack shank hole 807 may extend through upper housing 114, beginning at aperture 120 and through a top wall 808A, entering wedge compartment 802 and partially through a front wall 803C to a top surface 814 of a protrusion 809.

The location of front wall 803C may vary in accordance with a desired implementation. For example, front wall 803C may be positioned more distant from back wall 803D than shown in FIG. 8A, where it is coincident with a wall 803T. As shown in FIG. 8A, wall 803C is approximately 0.016 inches closer to back wall 803D than is a wall 803T. Further, wall 803C has a semi-circular surface cut through to clear for tack shank hole 807. The portion of a tack shank bearing surface 803S most distant from back wall 803D may comprise bearing wall 803T. The semi-circular surface may provide several advantages, such as assisting to guide tack shank 106 when inserted, to provide a semi-circular bearing surface 803S for circular tack shank 106 which provides a slightly higher pullout force (Fpo) relative to having a flat bearing surface. The pullout force Fpo may refer to an amount of separation force between security tag 100 and tack assembly 102 that is needed to forcibly extract tack assembly 102 from security tag 100. There may be other factors to be considered in locating wall 803C, as discussed further below.

When lower housing 116 is joined to upper housing 114, tack shank hole 807 extends further into the lower housing shank hole 1115 where hole 807 terminates (see FIG. 4). When tack shank hole 807 is not occupied, surface 1203 of a wedge 1202 may lay flat against top wall 808A with tack retaining edge 1213 touching or nearly touching front wall 803C. Wedge 1202 may fit in wedge compartment 802 closely but with sufficient clearance that wedge 1202 is free to pivot approximately about pivot edge 1215. For example, wedge side 1211 is movably close to a side wall 803E, wedge side 1214 is movably close to a side wall 803J, wedge pivot side 1207 is movably close or touching back wall 803D, and tack retaining edge 1213 is movably close to front wall 803C and covers most of tack hole 807. In a reusable security tag, wedge axel protrusions 1221R and 1222R may loosely reside in their respective recesses 821 and 822 so they can pivot without significant resistance.

Figure 8B:
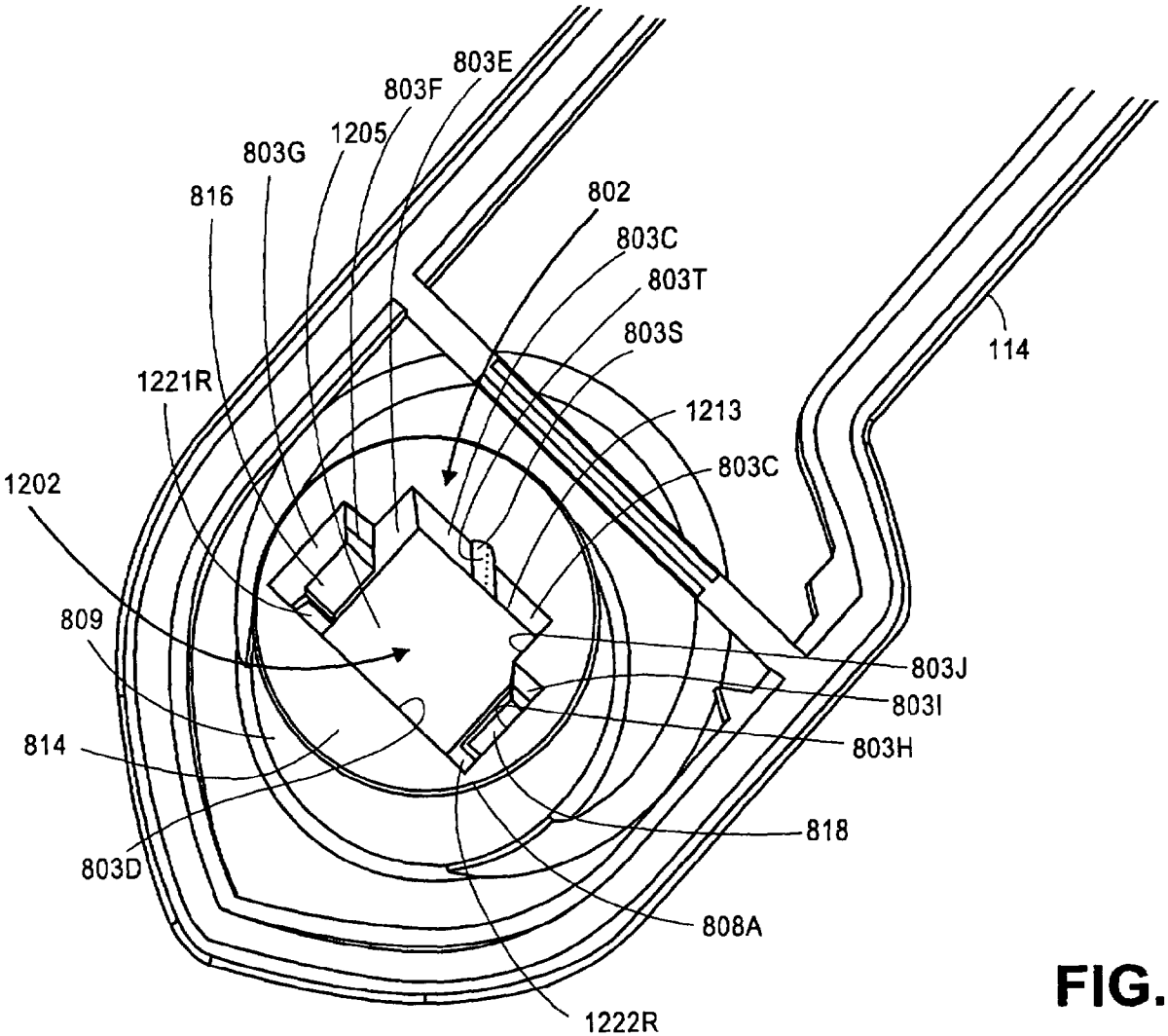
FIG. 8B illustrates an interior view of an upper housing with a wedge inserted for a security tag in accordance with one embodiment.

FIG. 8B illustrates an interior view of an upper housing with a wedge inserted for a security tag in accordance with one embodiment. FIG. 8B shows wedge 1202 as inserted into wedge compartment 802 and lying flat on top wall 808A. Once wedge 1202 is in place, rubber spring 1302 may be placed in its portion of wedge compartment 802. In a reusable security tag, protrusions 1221R and 1222R may be positioned in their respective recesses 821 and 822.

Figure 8C:
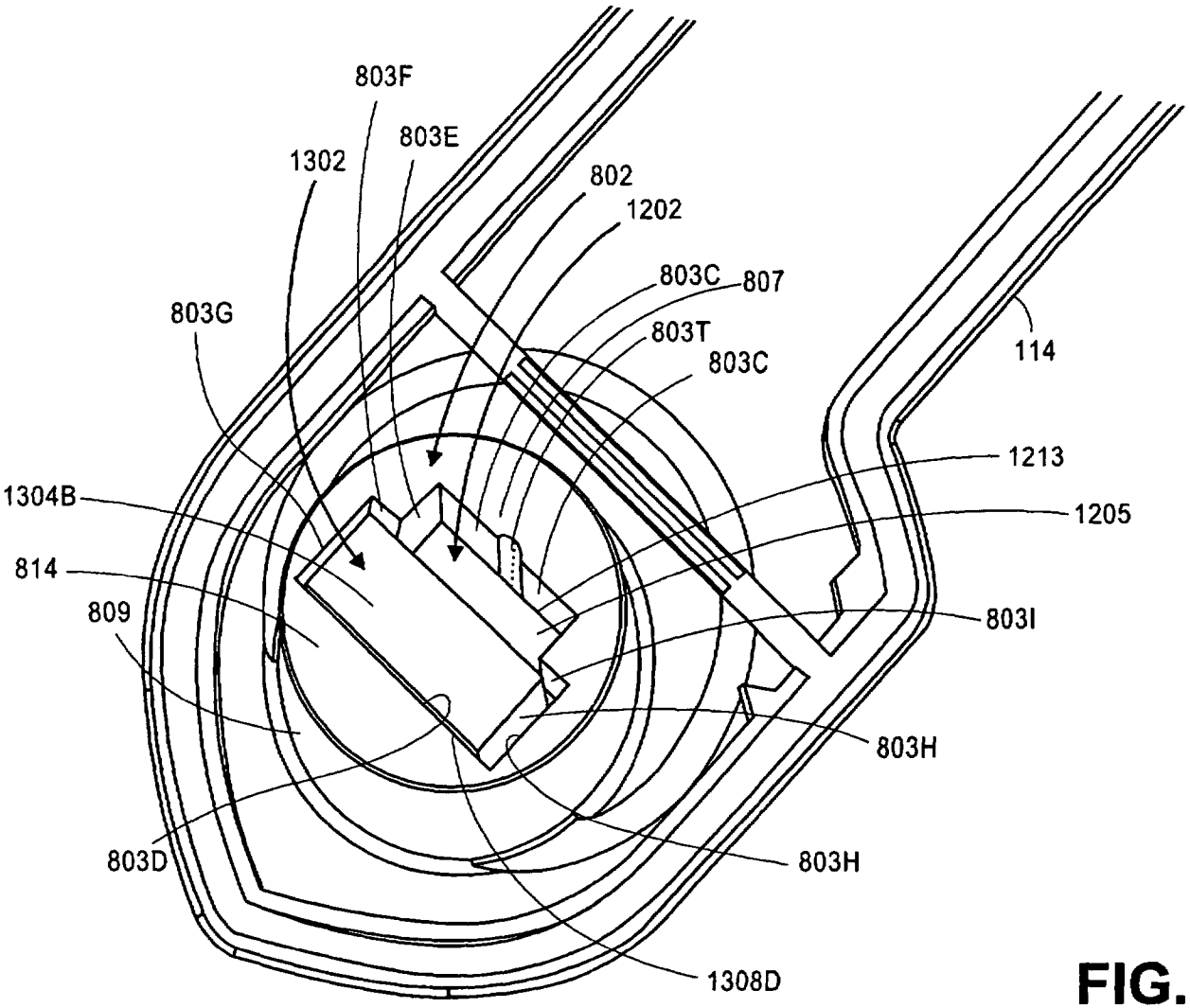
FIG. 8C illustrates an interior view of an upper housing with a wedge and rubber spring inserted for a security tag in accordance with one embodiment.

FIG. 8C illustrates an interior view of an upper housing with a wedge and rubber spring inserted for a security tag in accordance with one embodiment. FIG. 8C shows wedge 1202 and rubber spring 1302 as positioned within wedge compartment 802 in accordance with one embodiment. A side 1304A of rubber spring 1302 is inserted into wedge compartment 802, keeping rubber spring surface 1308D adjacent to back wall 803D. Rubber spring 1302 is further guided by pocket side walls 803F, 803G, 803H, and 803I, until rubber spring side 1304A rests on surface 1205 of wedge 1202. In one embodiment, the width of rubber spring 1302 may be greater than the width of wedge 1202, which fits closely in the extended portion of the wedge compartment 802 from sidewall 803G to sidewall 803H. In this manner, the location of rubber spring 1302 on wedge 1202 may be controlled. The embodiments are not limited in this context.

Controlling the location of rubber spring 1302 may assure that tags built in a production environment have a reproducible rubber spring bias on wedge 1202 for reliable and consistent detaching. The location of rubber spring 1302 may also reduce or prevent the effects of "slamming" in a single-use security tag. Slamming may refer to a user striking the bottom of protrusion 124 against a hard surface, which may cause a single-use security tag to attain a permanent unlock condition without the use of magnetic detaching device 602. This may occur since the bias of rubber spring 1302 is toward one end of wedge 1202S. The vertical force caused by slamming may operate on the center of gravity of wedge 1202S thereby causing wedge 1202S to twist or rotate under the force of the slam. The effects of slamming may be reduced or eliminated, however, by moving the bias of rubber spring 1302 to the center of gravity of wedge 1202S, as described with reference to FIG. 31. The embodiments are not limited in this context.

In one embodiment, the distance from wedge surface 1205 to bearing surface 1111B is less than the height of rubber spring 1302. Consequently, rubber spring 1302 may be compressed when upper housing 114 and lower housing 116 are joined to construct security tag 100. This may cause wedge 1202 to be biased against top wall 808A of wedge compartment 802. In a reusable security tag, this may also bias axel protrusions 1221R and 1222R into their respective recesses 821 and 822.

Figure 8D:
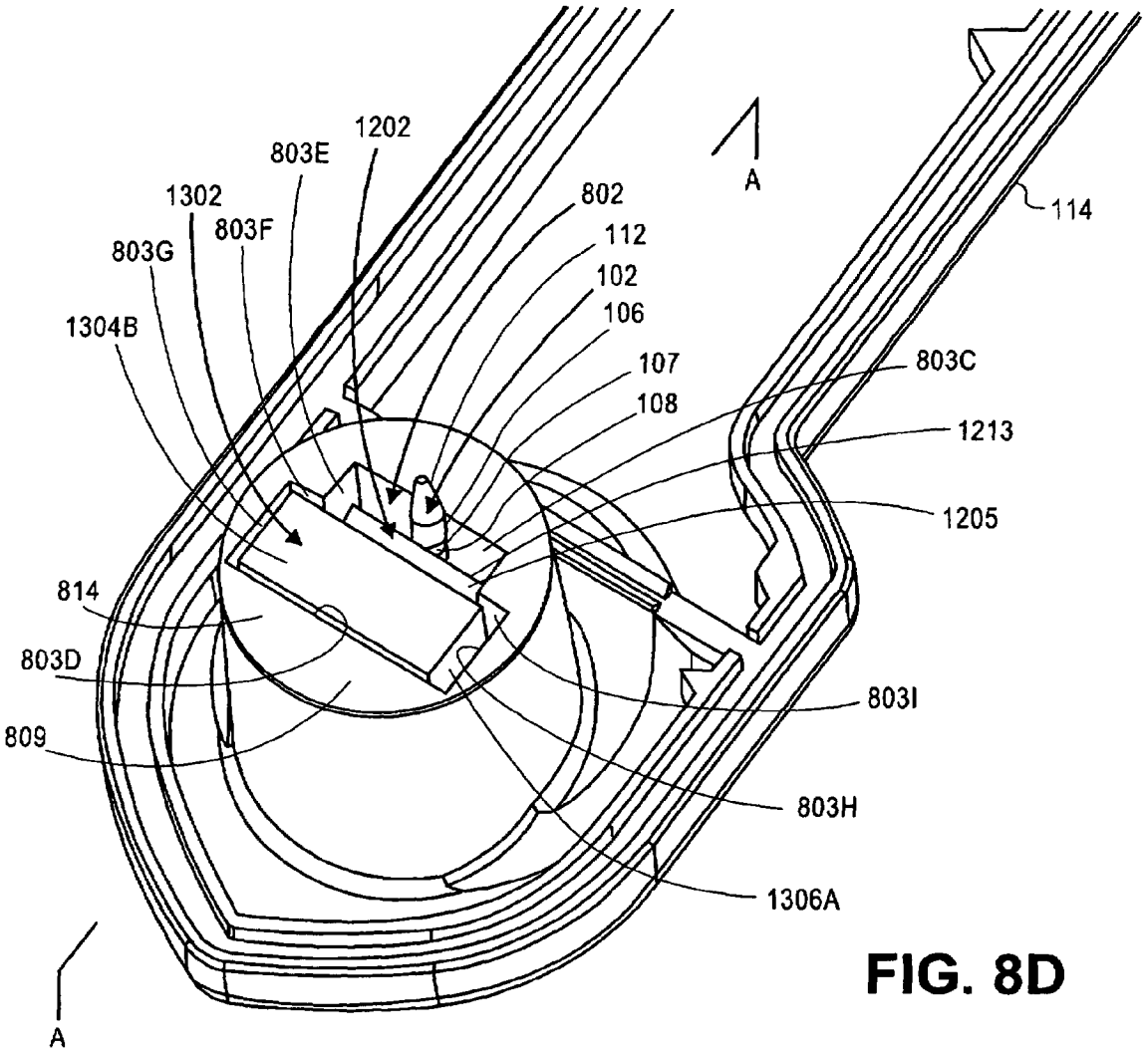
FIG. 8D illustrates an interior view of an upper housing with a wedge, rubber spring, and tack shank inserted for a security tag in accordance with one embodiment.

FIG. 8D illustrates an interior view of an upper housing with a wedge, rubber spring, and tack shank inserted for a security tag in accordance with one embodiment. FIG. 8D shows another view into wedge compartment 802. This view is depicted as though lower housing 116 is joined to upper housing 114 where lower housing 116 is transparent. Thus, wedge surface 1203 is biased against top wall 808A of wedge compartment 802, as it would be in a completed security tag 100.

Figure 9A:
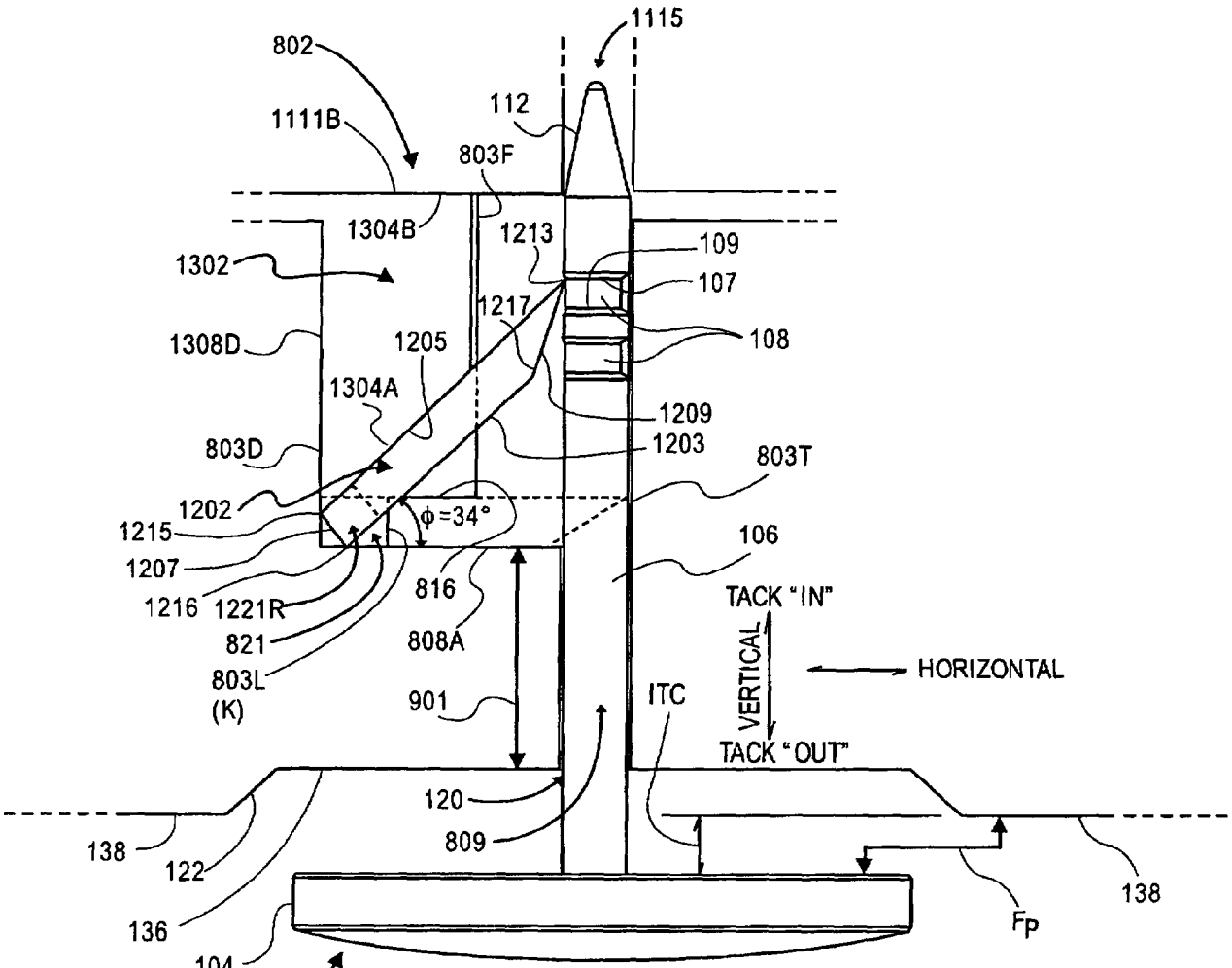
FIG. 9A illustrates the partial section A-A of FIG. 8D in accordance with one embodiment.

FIG. 9A illustrates a partial section A-A of FIG. 8D in accordance with one embodiment. Axel protrusion 1221R is shown for reference. FIG. 9A may be used to assist in describing insertion operations of tack assembly 102 into security tag 100. As shown in FIG. 8D and FIG. 9A, pointed end 112 of tack shank 106 may be inserted into security tag 100 through aperture 120 and into tack hole 807. During insertion, pointed end 112 may contact inclined surface 1209 of wedge 1202 causing wedge 1202 to pivot counterclockwise approximately about wedge edge 1215 against the bias of rubber spring 1302 until tack shank 106 begins to slide by the tack retaining edge 1213 of wedge 1202. Further insertion may cause tack groove 108 and lip 107 of tack shank 106 to come adjacent to tack retaining edge 1213 which is then biased into tack groove 108 against lip 107 by rubber spring 1302. Accordingly, tack retaining edge 1213 may be positioned within tack groove 108, thereby preventing tack assembly 102 from being pulled out of security tag 100 unless the holding strength of the tack retaining system is overcome. In this position, tack assembly 102 may be fastened or locked to security tag 100, and the locked condition is attained. In one embodiment, for example, the wedge angle Ǿ may be approximately 34° when in the locked condition.

FIG. 9A also illustrates a feature concerning the detachment process of the reusable tack retaining system. FIG. 9A depicts the recess 821 in which protrusion 1221R resides, and not shown, but by symmetry recess 822 where protrusion 1222R resides. The depth of the recesses 821/822 is the vertical dimension of walls 803L/803K. During detachment, as the tag 100 approaches the detacher per FIG. 6, the wedge 1202R is urged to rotate counterclockwise about approximately edge 1215R. As the tag gets closer to seating in the detacher, the magnetic attractive force becomes stronger until wedge 1202R rotates enough for edge 1213R to clear lip 107 releasing the tack from the tag. The tag may become fully seated in the detacher (See FIG. 7) immediately after the tack is released. Typically, the tag is fully seated in the detacher, the tag being held in the detacher by the magnetic force attracting the wedge 1202R, and then the tack is removed from the tag. The tack retaining system may be designed such that when the tag is seated, a given magnetic strength "S" is just sufficient to release the tack (unlock condition), or the magnetic strength may exceed the value "S" by for example 25% and the tack retaining system will still release the tack. An operational problem may arise if the magnetic strength of the detacher far exceeds the value "S". The wedge may rotate further compressing the rubber spring 1302 to a point where the wedge approaches verticality and the edge 1213R of wedge 1202R is attracted to contact wall 1111B. This may cause protrusions 1221R and 1222R to be pulled out of their respective recesses 821 and 822, and the expanding rubber spring 1302 to push the protrusion portions of edge 1216R onto walls 816/818 which may constitute a permanent unlock condition. To remedy this condition, the dimensioning of the tack restraining system is such that walls 803L and 803K are sufficiently long vertically, and the wedge length is sufficient, that when edge 1213R contacts wall 1111B, the protrusions 1221R and 1222R cannot be pulled out of their respective recesses 821 and 822.

Referring again to FIG. 9A, one design constraint for a security tag may include the amount of pull force (Fp) needed to forcibly separate tack assembly 102 from security tag 100 without a detaching device 602. This force may be referred to as the "pullout force" (Fpo). For example, assume a pull force (Fp) in the "tack out" direction is applied to tack assembly 102 in an attempt to separate tack assembly 102 from surface 138 of security tag 100. This may occur when a person attempts to pull on cloth 202 and tack assembly 102 in a vertical direction away from security tag 100. Since groove lip 107 of tack groove 108 is engaged with tack retaining edge 1213, the vertical force pulls on tack retaining edge 1213 which attempts to pivot wedge 1202 clockwise about approximately edge 1215. Clockwise pivoting of wedge 1202, however, attempts to put the tack retaining edge 1213 within tack hole 807 while the tack shank 106 is still therein. Consequently, tack shank 106 may become wedged in security tag 100. This may sometimes be referred to herein as a "wedge effect." Wedge 1202 will retain tack assembly 102 in security tag 100 unless the tack holding strength of the tack retaining system is overcome (e.g., Fp>Fpo).

As shown in FIG. 9A, when tack assembly 102 is locked in security tag 100 where tack retaining edge 1213 is in contact with lip 107, there is a certain vertical distance between the bottom of tack head 104 and tag surface 138. This distance may be referred to as an "initial tack" clearance. Increasing Fp may cause some yielding and/or deforming of components of the tack retaining system, which results in "additional tack clearance" (ATC) adding to the initial tack clearance. If the components did not yield or deform, there would be no additional tack clearance. Additional tack clearance is typically not desirable because it may expose more of tack shank 106 to potential bending or cutting, thereby making security tag 100 more vulnerable and easier to defeat. There may be several design techniques to accommodate or reduce additional tack clearance, as described in more detail below.

Figure 9B:
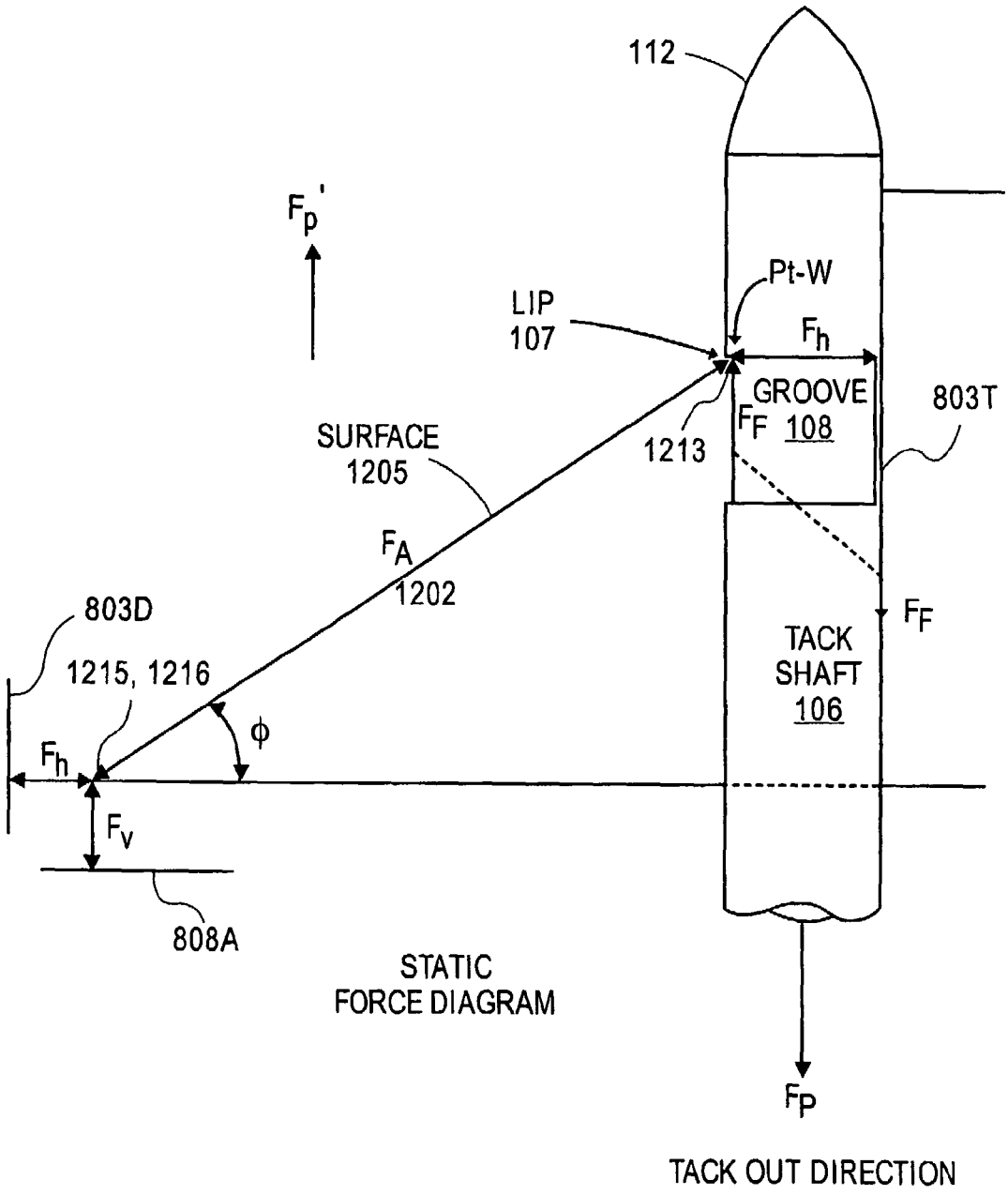
FIG. 9B illustrates a force diagram for components of FIG. 9A in accordance with one embodiment.

FIG. 9B illustrates a static force diagram for the tack retaining system components of FIG. 9A in accordance with one embodiment. In order for Fp not to pull tack assembly 102 out of security tag 100, there must be an equal but opposite force Fp' holding tack assembly 102 in security tag 100. This may describe a static or non-movement condition. If Fp becomes large enough to pull the tack out of the tag while in locked condition, that value of Fp is referred to as the pullout force Fpo as stated earlier.

In the static force diagram shown in FIG. 9B, Fp may refer to the applied pull force on tack assembly 102 from security tag 100, and Pt—W may refer to the point where tack retaining edge 1213 engages groove lip 107 in groove 108. Further, the static force diagram and derived static equations assume that all tack restraining system components do not yield or deform, including walls 803D, 808A, 803T, wedge 1202 and tack shank 106.

In accordance with static mechanics, the following equations may be derived:

$$Fp'=Fp=Fv+Ff;$$

$$Fv=Fa\times\sin ø;$$

$$Ff=\beta\times Fh;\text{ and}$$

$$Fh=Fa\times\cos ø.$$

wherein β may represent the static coefficient of friction between the tack shank and wall 803S/803T. For example, β may approximate 0.5 as determined by experimentation measured at 4 pounds (lbs) and 26 lbs of Fh. These equations may be rewritten in the following form:

$$Ff=\beta\times Fa\times\cos ø;$$

$$Fp=Fv+Ff=Fa\times\sin ø+\beta\times Fa\times\cos ø=Fa(\sin ø+\beta\times\cos ø);\text{ and}$$

$$Fa=Fp/(\sin ø+\beta\times\cos ø).$$

For a wedge angle ø of 34°, the following may be derived:

$$Fp'=Fp=Fv+Ff;$$

$$Fa=1.027\times Fp;$$

$$Fh=Fa\times\cos ø=0.851\times Fp;$$

$$Ff=\beta\times Fh=\beta\times Fa\times\cos ø=0.426\times Fp;\text{ and}$$

$$Fv=Fa\times\sin ø=0.574\times Fp.$$

Figure 10:
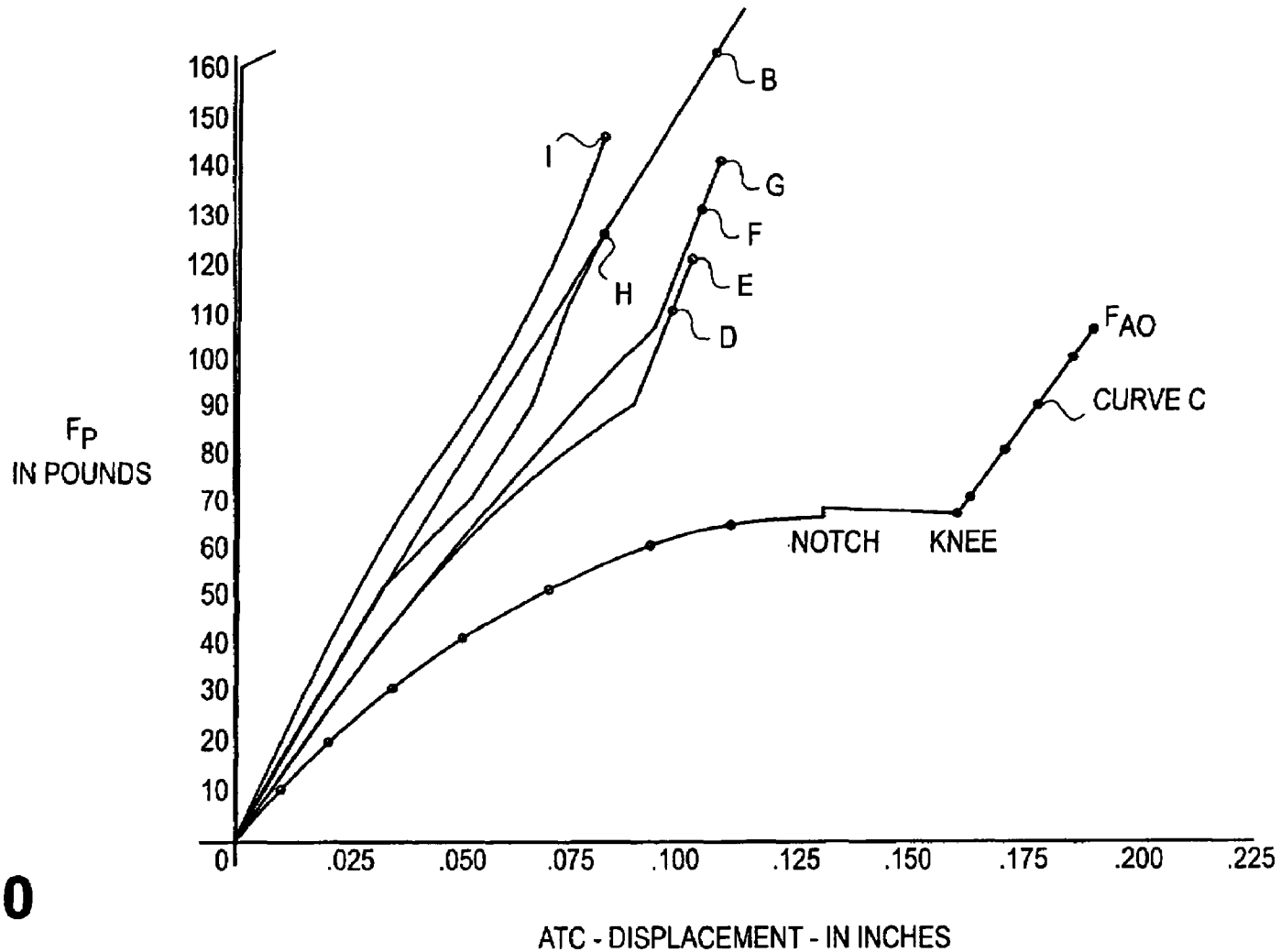
FIG. 10 illustrates a set of curves representing pullout force in accordance with several embodiments.

Based on these equations, Fp will always be countered by an Fp' that equals Fp, so increasing the value of Fp should cause no movement of tack assembly 102, that is no additional tack clearance occurs. Curve A of FIG. 10 shows the relationship of additional tack clearance verses Fp for such ideal constraints. Tests for the embodiment shown in FIG. 8D have shown that as the pull force Fp continues higher there is a gradual yielding of the tack retaining system components until the tack assembly 102 is forcibly released from security tag 100. Curve C of FIG. 10 is an example of how additional tack clearance may occur as a result of tack restraining components gradually yielding under the strain of increasing Fp. By employing certain improvements to the embodiment of FIG. 8D yielding curve C, curves much closer to the ideal curve A may be attained, such as curves D, E, F, G, H, and I, as will be discussed below. Concerning the curves A and C of FIG. 10, the curves are relative in the information they provide. For example, if the Fp scale only went to 0.5 pounds instead of 160 lbs, curve A and curve C would look very much alike. Also, if the Fp scale went to a million pounds, Curve A and curve C would appear to release at approximately 0 lbs. The scales used herein may encompass values desired to protect merchandise against most human theft attempts on the retail floor. For example, the direct hand to hand pull force a person can generate is about 80 pounds. Therefore the Fpo of a security tag on a garment, where the direct pull of the tack from the tag is a possible defeat mode, should be at least 80 pounds. Generally, the higher the Fpo of a security tag the higher the perceived quality of the tag. Another factor of quality is the additional tack clearance produced by Fp; the less the better. Additional tack clearance affords a potential thief more of the tack shank (106) or tack head to attack with bending, prying, or cutting devices, for example. The amount of additional tack clearance for different security tags in the industry today, for any given Fp, varies greatly. Good performance of a tag embodiment concerning Fp and tack displacement would be one which yields a curve between curve A and curve B of FIG. 10. A good Fpo for a security tag may have a specification value of at least 125 pounds, for example.

As stated above, increasing Fp may cause no additional tack clearance under certain ideal constraints. For the configuration of FIG. 9A, these ideal constraints may include, but are not limited to, the following: (1) the distance from back wall 803D to tack bearing wall 803T does not increase; (2) the diameter of tack groove 108 does not decrease; (3) the wedge 1202 length from pivot edge 1215 to tack retaining edge 1213 does not decrease; (4) the thickness of wall 901 does not decrease; and (5) the vertical distance between surface 136 and surface 138 does not decrease. These ideal constraints are difficult to maintain in practical implementation, however, since all materials yield to some extent when force is applied to them.

The first constraint involves the distance from back wall 803D to tack bearing wall 803T. Applied pull force Fp may cause groove lip 107 to pull on tack retaining edge 1213 toward top wall 808A. This may urge wedge 1202 to pivot clockwise back to its pre-tack insertion position. With tack retaining edge 1213 engaged in groove 108 at lip 107, however, tack 108 prevents horizontal movement of edge 1213 into the solid metal of groove 108 so that wedge 1202 cannot pivot back to the pre-tack insertion position. This may create a jamming or wedging effect, wherein a vertical "tack out" motion of tack retaining edge 1213 cannot occur unless some horizontal motion of tack retaining edge 1213 into tack groove 108 occurs at the same time. As a result, Fp acting on tack retaining edge 1213 may cause a resultant horizontal force (Fh) on groove 108 that causes tack shank 106 to bear against tack bearing wall 803T (bearing surface 803S), and wedge pivot edge 1215 to bear against back wall 803D. A resultant vertical force. (Fv) may cause wedge edge 1216 to bear against top wall 808A. Another resultant vertical force may be frictional force (Ff). The frictional force Ff may bear vertically on bearing wall 803T (bearing surface 803S). These walls are all part of the upper housing 114 which is typically a solid molded part made of a material such as ABS plastic. Alternatively, the part may be machined from a solid piece of the material. ABS plastic is resilient to some extent, but it may also deform permanently to some extent when force is applied. Thus under the stress of Fp, the wedge compartment wall 803D in contact with wedge 1202 and wedge compartment wall 803T/803S in contact with the tack shank 106 may yield somewhat thereby causing some additional tack clearance to occur.

The second constraint involves the diameter of tack groove 108. In one embodiment, for example, tack shank 106 may comprise a material such as steel. The steel shank may be sufficiently hardened to prevent it from deforming under force Fh as exerted by tack retaining edge 1213 on groove 108. For example, tack shank 106 may be implemented using steel hardened to a Rockwell Hardness of approximately RC 48. The yield of the tack groove 108 is thus is negligible, provided that the tack retaining edge 1213 is sufficiently softer than RC 48, for example RC 40. If the hardness of the tack shank 106/groove 108 is sufficiently softer than edge 1213, more yield and thus more additional tack clearance is expected from this source. This may include extruding of the tack shank 106 at lip 107, and/or cutting of the shank 106 at groove 108.

The third constraint involves the wedge 1202 length Lw from pivot edge 1215 to tack retaining edge 1213. Some embodiments may have a wedge hardness of approximately RC 40, and a harder tack having a hardness of approximately RC48. Further, in some embodiments, the angle of tack retaining edge 1213 may comprise approximately 30° (1220) with a tip end radius of no more than 0.002" to fit well within the intersection of tack groove 108 and tack lip 107. The intersection of the lip 107 and the groove 108 is about 90° with an internal radius of no more than 0.002", and is defined as tack contact point Pt—W per FIG. 9B. Dimensions are not limited in this context, but the tack retaining edge 1213 must fit compatibly into Pt—W. Under the influence of applied Fp and the resultant force component Fh, the portion of the tack retaining edge 1213 in contact with the tack at Pt—W may deform. The typically softer tack retaining edge 1213 is forced onto/into the typically harder tack contact point Pt—W, and as Fp increases, edge 1213 forms around and into Pt—W taking the inverse shape of the Pt—W contact area of the tack. The result is that a concave semi-circular ledge is formed in the tack retaining edge 1213 that conforms to and mates with up to ½ of tack lip 107, and around part of groove 108 and part of the shank 106 in the contact area. Essentially, with proper hardness and relative hardness of the wedge and tack shank, a form fitted seat for the tack lip 107 may be created. The size and depth of the semi-circular ledge (seat) is dependent upon the maximum Fp imposed as well as the hardness values selected for the wedge and for the tack. The more Fp applied, the larger the form fitted seat that is created (up to ½ of tack lip 107), and typically the larger the retaining strength of the tack retaining system. If wedge 1202 is made of a much harder material such as RC 58, tack retaining edge 1213 may not form about the contact area. Rather, the RC 58 wedge 1202 under the influence of Fv may shear off a softer tack (RC 48) at Pt—W. If the wedge and thus edge 1213 hardness is RC 30, the semi-circular ledge may form but potentially strip out or extrude under low values of Fp because edge 1213 is too soft. If the wedge hardness is about RC 48 and the tack hardness is about RC 40, the semi-circular ledge will form to some extent but the tack may partially extrude with increasing Fp. Hardness and relative hardness of the wedge 1202 and tack shank 106 may be of different values and the tag/tack will function normally up to an Fp of about 15 pounds, but the Fp/additional tack clearance curves may vary greatly. In one embodiment, a balanced result may be achieved at a wedge hardness of RC 40 and a tack hardness of RC 48. Other hardness's may produce desired balanced results, and the values are not limited in this context. Thus the wedge length Lw may be reduced by the depth of the formed semi-circular ledge and cause some permanent additional tack clearance.

The fourth constraint involves the thickness of wall 901. Compression of typically solid plastic wall 901 is relatively minor for values of Fp of up to >200 pounds and thus adds negligibly to the additional tack clearance. Edge 1216 may be forced against wall 808A by a portion of a resultant force Fv, but the effect on additional tack clearance is relatively minor and may disappear completely when the wedge angle is 0°. Compression of wall 901 under the net separation force Fp may not be significant compared to the net additional tack clearance.

The fifth constraint involves the vertical distance between surface 136 and surface 138. The distance between surface 136 and surface 138 may tend to decrease slightly since the separation force Fp is between the entire surface 138 and the entire under side of tack head 104, and further, tack shank 106 is engaged with the plastic walls under surface 136 (e.g., 808A and 803S). Because surfaces 136 and 138 are offset at rampart 122, the housing may tend to yield resiliently and/or deform at the offset, and surfaces 136 and 138 may tend to be drawn together under the force Fp. Proper design of wall thicknesses and diameter of rampart 122 may prevent this issue from adding any significant amount of additional tack clearance for Fp values of well over 100 pounds compared to the net additional tack clearance. If there was no rampart 122, this issue would not exist.

Figure 9C:
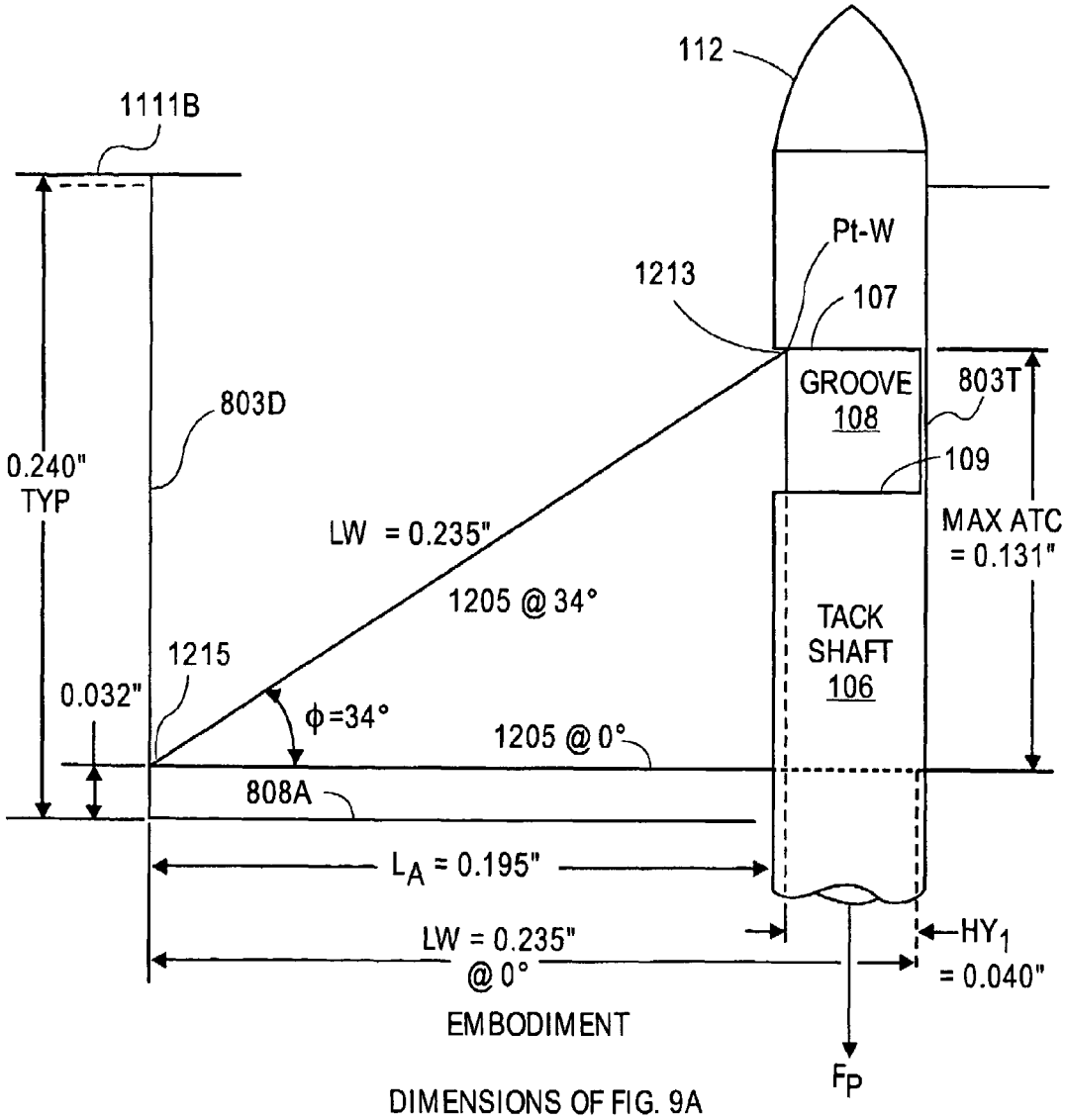
FIG. 9C illustrates a dimensional diagram for components of FIG. 9A in accordance with one embodiment.

FIG. 9C illustrates a dimensional diagram for components of FIG. 9A in accordance with one embodiment. FIG. 9C shows the dimensions and initial conditions with security tag 100 and tack assembly 102 in a locked condition and with a small value of Fp applied just sufficient to cause tack retaining edge 1213 is engaged with lip 107. More particularly, FIG. 9C may show various dimensions of wedge compartment 802, such as the length (Lw) of wedge 1202 from edge 1215 to Pt—W that is inside tack groove 108 under groove lip 107, and the horizontal length (La) from back wall 803D to a point directly below Pt—W, which is set to 0.195 inches by design for the embodiment of FIGS. 8D and 9A. From these given dimensions, the wedge angle Ø is calculated to be 34°, and the additional tack clearance possible is 0.131 inches, barring an over rotation issue to be explained further below. It is worthy to note that the additional tack clearance dimension of 0.131 inches corresponds substantially with the notch of curve C in FIG. 10. Wedge 1202 may need to lie flat on wall 808A for the additional tack clearance of 0.131 inches to be realized. Correspondingly, wedge 1202 should pivot approximately about edge 1215 from Ø=34° to Ø=0°. This means that the Lw of 0.235 inches lies flat in a length of La set to 0.195 inches. This is a dichotomous condition unless some constraints yield. In fact, under an applied Fp of 65 pounds, the wedge does lie flat on wall 808A in the embodiment of FIG. 8D. At an Fp of 65 pounds, semi-circular ledge having a depth of approximately 0.020 inches forms in tack retaining edge 1213 about tack groove 108, groove lip 107, and tack shank 106. This means the Lw reduces from 0.235 inches to 0.215 inches. At the Fp of 65 pounds, a depression of about 0.010 inches develops in wall 803T (803S), and further, wall 803D develops a depression of about 0.010 inches made by edge 1215 and wedge surface 1207. Consequently, dimension La increases from 0.195 inches to 0.215 inches. Accordingly, wedge 1202 fits flat on wall 808A where Fp is equal to 65 pounds due to the net yield of tack retaining edge 1213, walls 803T (803S), and back wall 803D.

The aggregate yield of all the tack retaining system components is incremental with each increment of force Fp applied. Thus, a first increment of Fp from 0 will cause a first increment of additional tack clearance. For example, when Fp increases from 0 to five pounds, the tack clearance may increase from 0 to 0.0033 inches, and so forth. This would produce the linear curve B of FIG. 10. This curve rate of 1500 pounds/inch approximates the curve of some conventional security tags. The increment of additional tack clearance, however, typically becomes larger per the same increment of Fp as Fp becomes larger. Curve C of FIG. 10 may illustrate this non-linearity.

By attempting to forcefully separate tack assembly 102 from tag 100 one or more of the tack retaining system components may yield slightly and cause some additional tack clearance. There are typically two types of yield, referred to as "resilient" and "permanent." The yields of the metal elements (e.g., metal tack and/or metal wedge) as previously discussed are almost totally permanent. The metals may permanently deform and therefore the yield contribution to additional tack clearance becomes permanent. The yields of the plastic elements, however, may have both resilient and permanent components. Some of the yielding by the plastic elements contributing to the additional tack clearance may be recoverable when Fp is removed, while some is not. The net additional tack clearance for a given pull force Fp will therefore have a permanent component and a recovered component. For example, for a pull force Fp of 50 pounds that is less than or equal to the Fpo, the additional tack clearance may comprise approximately 0.040 inches. When Fp is removed, however, the additional tack clearance may revert to 0.020 inches. This means that there is a permanent additional tack clearance of 0.020 inches, and a resilient (recoverable) additional tack clearance of 0.020 inches. A second applied Fp should not cause further permanent additional tack clearance unless the second Fp is greater than the first Fp. Typically, the largest normal usage Fp is less than 20 pounds, and the permanent additional tack clearance is less than 0.007 inches. When added to the initial tack clearance of typically 0.040 inches, the permanent additional tack clearance is not significant. Experiments have shown that some embodiments may have a permanent additional tack clearance of between 25-80% of the net additional tack clearance, dependent upon the Fp applied.

The resulting relationship of the additional tack clearance as a function of the applied force Fp is presented as curve C of FIG. 10. It is worthy to note that curve C lies well outside the desired area between curve A and curve B. At an applied force Fp of approximately 65 pounds, the additional tack clearance may comprise 0.131 inches corresponding to the notch in curve C. The additional tack clearance from the notch to the knee in curve C is a result of a slight increase in Fp causing the tack to move as much as an additional 0.032 inches beyond where the wedge angle is 0°. This occurs because after the wedge rotates clockwise to 0° about approximately edge 1215, it may further rotate clockwise about edge 1217 when it contacts wall 808A until wedge surface 1209 lies flat on wall 808A. This rotation about edge 1217 is referred to herein as "over rotation." The resultant additional downward movement of edge 1213, in contact with lip 107, is the additional tack clearance of up to 0.032 inches between the notch and knee of curve C. As this occurs, edge 1215 moves vertically scraping wall 808D which may offer some resistance to over rotation. The portion of curve C from 65 pounds at the knee to 105 pounds at Fpo is a result of groove 108 and lip 107 being forced through the opening between the semi-circular ledge formed on wedge tack retaining edge 1213 and surface 803S when the wedge angle is at 0° or less due to over rotation. When the wedge angle is at about 0°, the semi-circular ledge in tack retaining edge 1213 may be fully formed around one side of tack groove 108 and under lip 107 and the opposite side of tack groove 108 and lip 107 may be pressed into and somewhat deform surface 803S. Thus, in order for the tack shank 106 to be pulled through the "groove 108 size" opening, the opening must be forcibly enlarged. In the embodiment described with reference to FIGS. 8D, 9A, 9B, and 9C, the pull force Fp required to pull tack shank 106 through the "groove 108 size" opening may therefore equal approximately 105 pounds (release point of curve C). The process of pulling tack shank 106, groove 108 and groove lip 107 through the "groove 108 size" opening may include extruding some or all the semi-circular ledge from tack retaining edge 1213, extruding some or all of surface 803S, extruding some or all of groove lip 107, or causing the plastic walls in contact with wedge 1202 to yield further. The net yield from the knee to Fpo is additional tack clearance of about 0.030 inches as shown in curve C of FIG. 10.

Although the embodiment described with reference to FIGS. 8A, 8B, 8C, 8D, 9A, 9B, 9C, and curve C of FIG. 10 may be used in an EAS security system, the embodiment may have some characteristics that can be improved upon. These characteristics may include: (1) curve C of FIG. 10 is outside of the desired area between curve A and curve B; (2) the Fpo is not more that the desired 125 pounds; (3) wedge 1202 and tack 100 may become substantially jammed and cannot be detached with the detacher of FIG. 6 when Fp pulls the wedge 1202 to about 25° or lower, which is primarily a function of a frictional force Ff described below; (4) after more than a certain value of Fp is applied and then removed, and the tag is "un-jammed", the wedge will not re-catch the tack groove lip 107; (5) over rotation causes additional tack clearance after the wedge 1202 angle has reached 0°; (6) the single use configuration may be manipulated to the permanent unlock condition with a magnetic detacher weaker than at least strength "S".

To detach the tack 100 from the tag 102, the wedge 1202 must be in a "free condition," which may refer to freely rotating under the influence of the detacher of FIG. 6. The garment being protected may offer a small resistance to the wedge attaining the free condition. For example, the garment being protected may fit snugly between the tack head and tag (see FIG. 3) providing a small "tack out" pressure on the tack causing tack retaining edge 1213 to be held in the groove 108 at lip 107 such that the detacher of FIG. 6 may not readily release the tack retaining system. A slight "tack in" finger pressure (Fi) on the tack head will cause the tack to move 0.003" to 0.004" which is sufficient to release the wedge to the free condition, allowing wedge edge 1213 to be rotated to the unlock position when the tag is positioned on the detacher per FIG. 7. Requiring a small Fi on the tack head to detach the tack from the tag is characteristic of virtually all magnetically releasable ball clutches used on security tags today and it is seldom if ever a problem. This "tack out" pressure provided by the garment is herein referred to as "garment pressure".

When in the free condition, the only tack retaining system restraint on the wedge 1202 to keep it from rotating is the bias of the rubber spring 1302, which can be overcome by the detacher of FIG. 6 to release the tack. A jammed wedge 1202 can be forced to the free condition by pushing on the tack head, thus pushing the tack shank 106 into the tag 102 by hand. The push in force (Fi) required depends on more than one factor, but primarily upon the amount of Fp applied. At a wedge angle of about 34°, the wedge may be in the free condition. As Fp is applied the wedge angle reduces as the plastic walls and the wedge resiliently yield and/or deform. From the previously derived equations, the frictional force Ff ($Ff=Fp\times\beta\times\cos Ø/\sin Ø+\beta\times\cos Ø$) resists any movement of the tack, and the vertical force Fv ($Fv=Fp\times\sin Ø/\sin Ø+\beta\times\cos Ø$) strains to hold the tack in the tag. These forces are effectively in the "tack in" direction opposing the Fp applied. At some point the Fp is removed. The resilient portion of the net yield now attempts to recover. This recovery force Fh' is primarily horizontal (plastic recovering back towards its original pre-pull position) and applies resultant forces on the wedge and tack. A new Ff' ($Ff'=Fh'\times\beta$) now exists resisting any movement of the tack. A new Fv' ($Fv'=Fh'\times\tan Ø$) now exists in the "tack in" direction. If Fv' is larger than Ff', the net force is in the "tack in" direction and the tack and wedge will move to the free condition without requiring any hand push in force (Fi) on the tack head. If Ff' is larger than Fv', the net force does not allow movement of the tack and wedge and the tack retaining system will not move to the free condition automatically but will require some amount of Fi on the tack head to attain the free condition (e.g., un-jam the tack). Tests have shown that, for example, no hand push Fi on the tack is required to attain free condition after an Fp of about 15 lbs has been applied and then removed. After an Fp of 20 pounds, the Fi required to attain the free condition is about 5 pounds. After an Fp of 40 to 50 lbs, a Fi of about 15 lbs is required (wedge angle of about 20°) to attain free condition. After an Fp of 65 lbs (wedge angle=0°), a Fi of about 35 lbs is required to attain free condition.

Thus it can be appreciated that the frictional force Ff' between tack shank 106 and surface 803S/wall 808T may not always allow wedge 1202 and tack assembly 102 to automatically retreat to the free condition. Rather, the frictional force Ff' may need to be overcome by a force Fi on the tack head to put wedge 1202 in the free condition. The particular amount of Fi required to cause the tack retaining system to reach the free condition may vary with the Fp applied and corresponding wedge angle Ø attained, and to some extent the slope and shape of lip 109. Other factors could involve the time elapsed between Fp and Fi applied, and the difference in temperature when Fp and Fi are applied. Thus a desirable characteristic is to have little or no Fi required when in normal use where Fp could reach 20 to 30 lbs or when even more Fp is applied (e.g., Fi required should be minimized).

The discussion of the jamming characteristic (3) above describes typical results for the subject embodiment of FIGS. 8D and 9A, where the housings 114 and 116 are made of ABS plastic, the tack shank 106 has two circular grooves 108 about tack shank 106 that are approximately 0.040 inches long and spaced about 0.040 inches apart, the tack shank hardness is approximately RC 40, the wedge hardness is approximately RC 45, the surface of the grooves 108 are parallel to the surface of shank 106 and 0.003"/0.004" deep, both groove lips 107 and 109 are at an angle of 90° with respect to the shank 106 surface, and the first groove lip 107 is about 0.12 inches from the point.

In some embodiments, for example, it may be desirable to limit the wedge angle to approximately 15° or higher. When the semi-circular ledge is formed by wedge angles of about 15° or less, and then tack assembly is pushed back to the free condition by Fi, the semi-circular ledge may not "re-catch" groove lip 107, thus the tack could easily be removed from the tag by hand. This would be an easy form of defeat if an unauthorized user could pull on tack assembly 102 with sufficient force to cause the wedge angle to reach about 15° or less. One reason that this problem can occur is that the formed face of wedge tack restraining edge 1213 can have a length of about 0.011 inches under the semi-circular ledge. When tack assembly 102 is pushed back into security tag 100, the yield of the plastic recovers somewhat so the angle that the formed end of the semi-circular ledge engages tack groove 108 is different than when it was formed. The depth of groove lip 107 is about 0.003 inches. This means that the wedge angle cannot be less than arctan 0.003/0.011=15°. The value can be different for different hardness values of tack assembly 102 and wedge 1202, and different amounts of plastic yield recovery.

In some embodiments, for example, it may be desirable to prevent wedge 1202 from pivoting beyond 0°. When wedge 1202 rotates clockwise from 34° to 0° it is flat on top wall 808A as is wedge edge 1217. Additional Fp may be sufficient to cause wedge 1202 to rotate further clockwise about edge 1217. As a result, wedge 1202 may pivot clockwise further about edge 1217, causing edge 1215 to then move primarily vertically and scrape back wall 803D. Once the pivoting about edge 1217 begins, the semi-circular ledge of edge 1213 may move down as much as the thickness of the wedge 1202 and away slightly from tack lip 107/groove 108, causing the gripping pressure on the tack groove 108 to be reduced and thus less extrusion of the semi-circular ledge of edge 1213 and wall 808S required to reach pullout. Pivoting about edge 1217 may cause the tack retaining system to have as much as 0.032 inches more additional tack clearance and a lower pullout force. Curve C of FIG. 10 shows this additional tack clearance as the distance between the notch and the knee. If the wedge angle was limited to for example 15° or higher, and/or if the wedge surface 901 was completely supported, no pivoting about edge 1217 could occur and Fpo would not be affected.

Referring again to FIGS. 8D, 9A, and 9I, FIG. 9I illustrates a partial section A-A of FIG. 8D in accordance with one single-use embodiment. FIG. 9I may aid in describing the ratcheting effect in a single-use tack retaining system. A potentially undesirable characteristic of the embodiment of FIG. 8D and FIG. 9I is that the single use tack retaining system is subject to possible defeat by tack manipulation. Assume the configuration of FIG. 9A as a reusable (R) tack retaining system only. The wedge 1202R is constrained to rotational movement about the axel protrusions 1221R and 1222R. When the tag 100 is placed in the magnetic detacher of at least sufficient strength "S", the wedge rotates enough (possibly requiring a slight push down on the tack head to counteract garment pressure) against the bias of rubber spring 1302 so that tack retaining edge 1213R clears lip 107 and the tack 102 can be withdrawn from the tag 100. When the tag is removed from the magnetic detacher, it reverts to the rest condition.

In the single use configuration of FIG. 9I, the desire is to release the tack assembly 102 from the tag 100 by placing the tag 100 onto a magnetic detacher of at least sufficient strength "S". The wedge 1202S rotates and edge 1216S translates enough (possibly requiring a slight push down on the tack head to counteract garment pressure) against the bias of rubber spring 1302 so that tack retaining edge 1213S clears lip 107, the wedge 1202S rotates to be parallel with tack shank 106, and the tack 102 can be withdrawn from the tag 100 (the tag went from lock condition to permanent unlock condition). When the tag is removed from the magnetic detacher, it stays in the unlocked condition permanently.

One difference between the reusable configuration and the single use configuration is the translational movement of the wedge 1202S required to attain the permanent unlock condition. As can be seen in FIG. 9I, the wedge edge 1216S is not restrained from moving to the right except for the frictional force at the contact point where edge 1216S rests on wall 808A. This frictional force is dependent upon the vertical component of the compression force bias of rubber spring 1302 and a related coefficient of friction ω. Further, there is a horizontal component of the compression force of rubber spring 1302 which tends to push the wedge edge 1216S to the right from its first position, which may cause the edge 1216S to move to the right until the frictional force and the horizontal component of force are equal. If the tack is pushed in beyond the lock condition so groove 108 slides on edge 1213S and then further so lip 109 pushes edge 1213S to the left by the depth of the groove 108, the edge 1216S may move slightly to the right to a second position. At this point, if the tack is pulled in the "tack out" direction, edge 1213S will catch in lip 107 and further pulling may drive the edge 1216S back to a point where edge 1215S contacts wall 808D as shown in FIG. 9I. If the tack is pulled so that edge 1213S just falls back in groove 108, however, the edge 1213S may remain in the second position. The result is that edge 1213S has been moved to the right slightly by manipulating the tack. If the tag is placed on a detaching magnet of less strength than "S", and this simple push-pull manipulation of the tack is repeated causing edge 1213S to be lifted and lowered over lip 109, the magnetic bias of the lesser magnet may allow the edge 1216S to be "ratcheted" to the right until the wedge 1202S is advanced to the permanent unlock condition. Ratcheting is thus a form of defeat similar to "slamming" and should be corrected.

It is worthy to note that before the tack is inserted, wedge 1202S surface 1203S lies flat on wall 808A, biased to wall 808A by the compression force of rubber spring 1302. When the tack is inserted to the point where the wedge is at approximately 34°, edge 1215S may be slightly to the right of wall 808D due to the relative vertical and horizontal components of the rubber spring compression force on the wedge 1202S. If this condition exists, the first position of edge 1216S may not be when edge 1215S is touching wall 808D as is shown in FIG. 9I, but slightly to the right.

One aspect of this issue is that there may be an instability of the position of the wedge 1202S because edge 1216 may be moved along horizontal surface 808A by manipulating the tack thereby making it possible attain the permanent unlock condition by using a detacher of less strength than the proper detacher of at least strength "S".

Figure 9D:
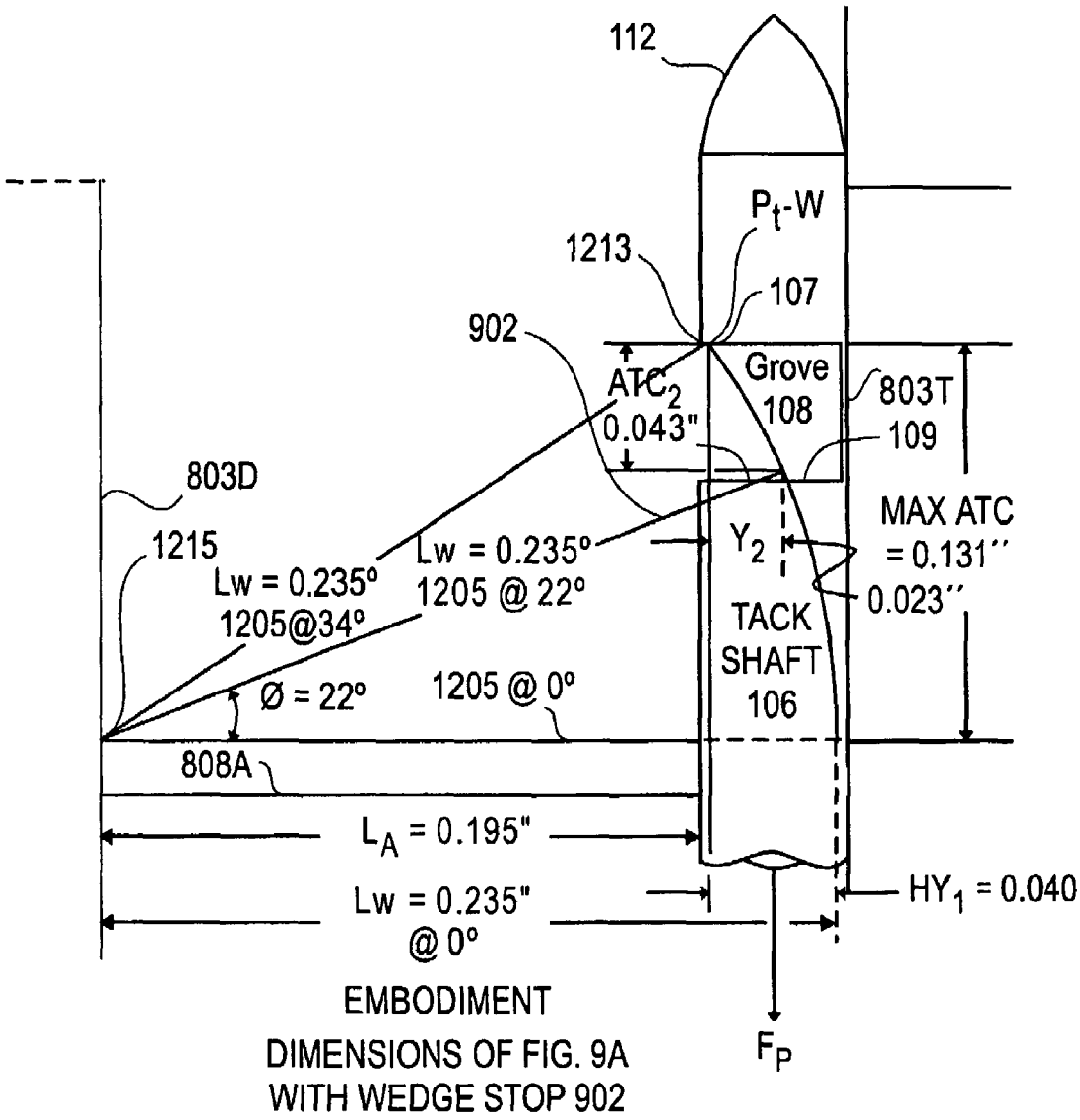
FIG. 9D illustrates a second dimensional diagram for components of FIG. 9A in accordance with one embodiment.

FIG. 9D illustrates a second dimensional diagram for components of FIG. 9A in accordance with one embodiment. FIG. 9D may be useful in describing a first of several possible modifications that have been implemented to improve the operation of the embodiment shown in FIGS. 8A, 8B, 8C, 8D, 9A, 9B, 9C, 9I, and curve C of FIG. 10. For example, to eliminate the re-catch characteristic (4) and the over rotation characteristic (5) which depend on the wedge 1202 attaining angles of 15° or less, and greatly improve the jamming characteristic (3), a first modification may include installing a wedge stop (e.g., wedge stop 902 shown in FIG. 9D, and other FIGS. discussed below) in order to keep the wedge angle from becoming less than 22°. Wedge stop 902 may reduce the additional tack clearance from 0.131 inches at 0° to 0.043 inches at 22°, as shown as ATC2 in FIG. 9D (0.131 inches–

0.235 inches X sin 22°=0.131 inches−0.088 inches=0.043 inches). It is worthy to note that derived dimensions herein discussed are approximate due to the manufacturing and yield tolerances of the tack retaining system components. If adding the wedge stop 902 was the only modification made, the Fpo may be reduced. Consider FIG. 9D where the wedge surface 1205 angle rotates to 0° compared to where it rotates to only 22°. The net amount of horizontal yield of the tack retaining system is a measure of the force holding the tack between the wedge edge 1213 and wall 803T, e.g., for wedge 1202 to rotate from 34° to 0°, the net horizontal yield becomes 0.235 inches X cos 0°−0.235 inches X cos 34°=0.235 inches−0.195 inches=0.040 inches (See HY1 in FIG. 9D). The net amount of horizontal yield of the tack retaining system with wedge stop 902 when wedge 1202 rotates from 34° to 22° may be 0.235 inches X cos 22°−0.235 inches X cos 34°=0.218 inches−0.195 inches=0.023 inches (See HY2 in FIG. 9D). Therefore, the aggregate horizontal yield imposed may be reduced from 0.040 inches to 0.023 inches, thus reducing the size of the formed seat for lip 107/groove 108 in the edge 1213, and thus reducing the amount of extrusion required to release the tack, e.g., the pullout force Fpo may be reduced. This arrangement may solve the issues of characteristics (4) and (5) and improve characteristic (3), but the pullout force possible may be further reduced and must be compensated for by further Fpo enhancement modifications.

Figure 9E:
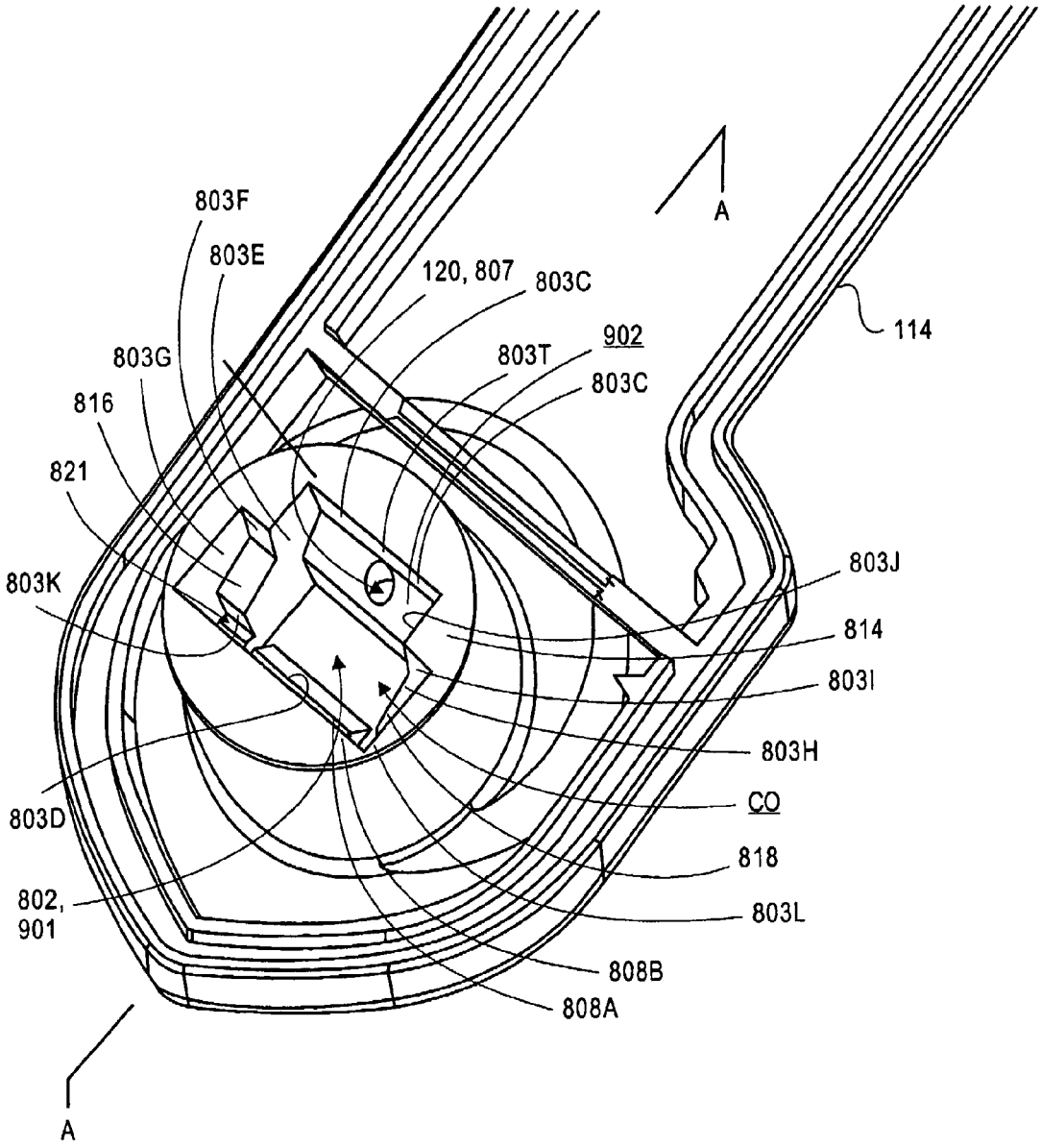
FIG. 9E illustrates an interior view of an upper housing for a security tag in accordance with one embodiment.
Figure 9F:
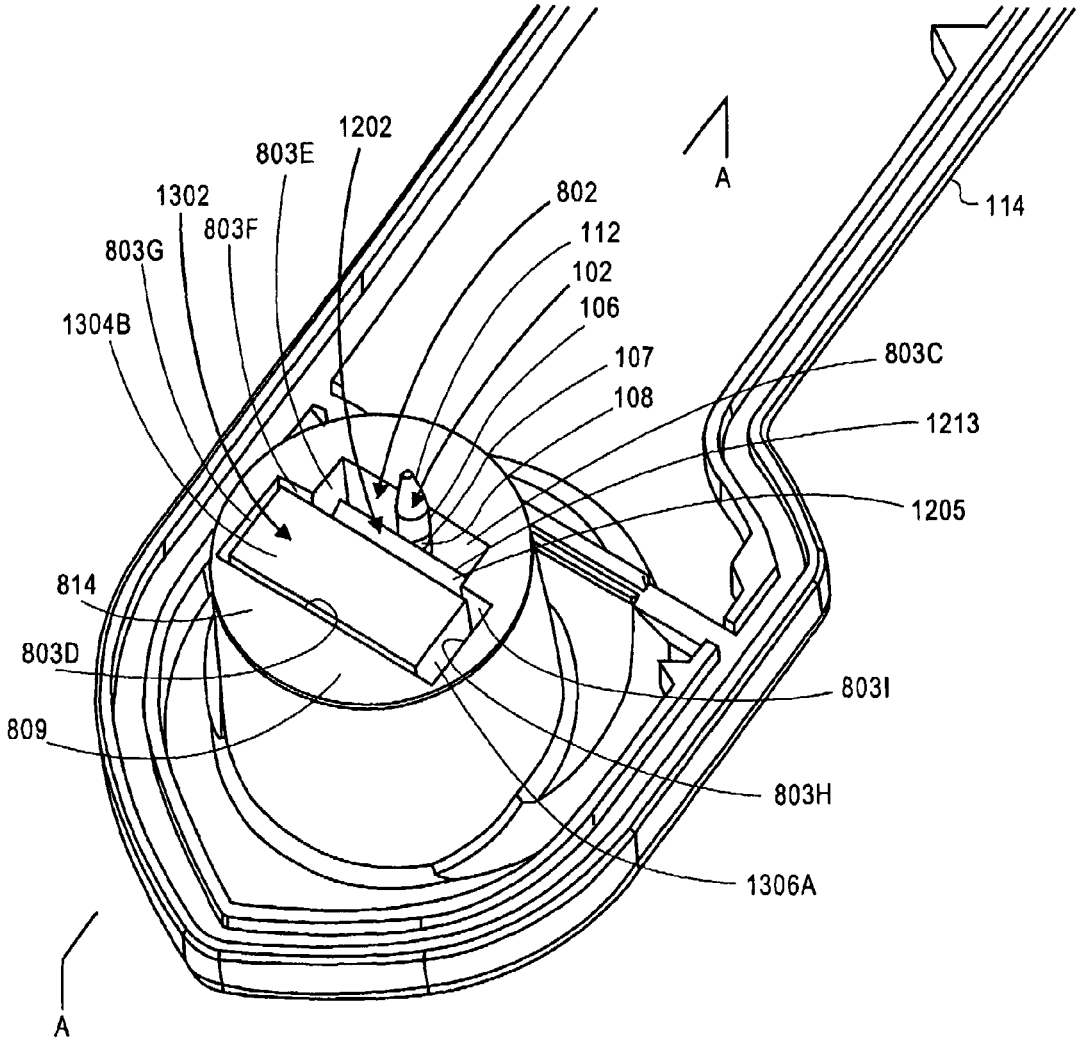
FIG. 9F illustrates an interior view of an upper housing with a wedge, rubber spring, and a tack shank inserted for a security tag in accordance with one embodiment.

FIG. 9E illustrates an interior view of an upper housing for a security tag in accordance with a second embodiment. FIG. 9E shows a detailed view of an improved wedge compartment 802 of upper housing 114. In particular, the wedge stop 902 is shown, a "cored out" area is shown as well as several other features described below. This arrangement is suitable for use in both a reusable or single-use tag. FIG. 9F illustrates an interior view of an improved upper housing with a wedge, rubber spring, and a tack shank inserted for a security tag in accordance with a second embodiment. The rubber spring 1302 in FIG. 9F is shown compressed as if the lower housing 116 was attached to the preferred upper housing 114 forming a complete tack retaining system.

Figure 9G:
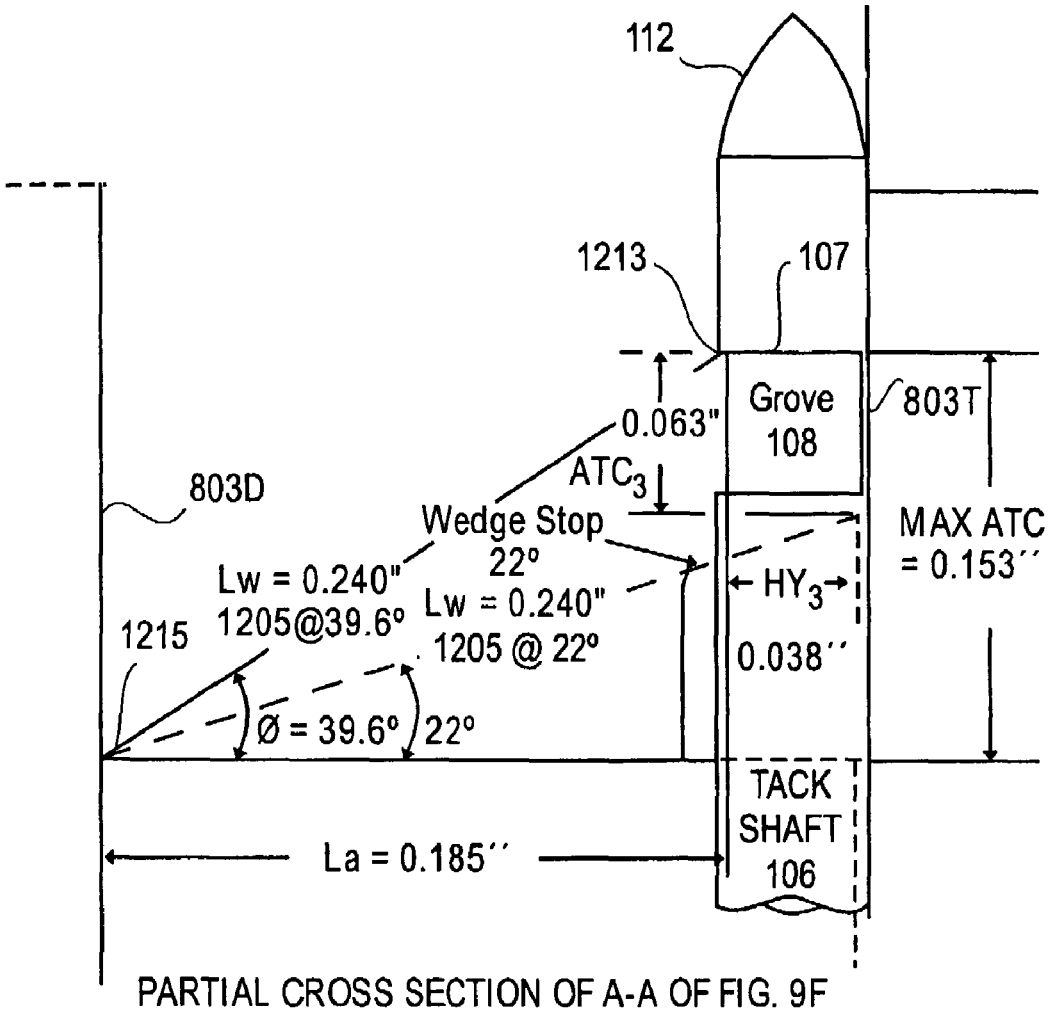
FIG. 9G illustrates a dimensional diagram for components of FIG. 9F in accordance with one embodiment.
Figures 9H, 9I:
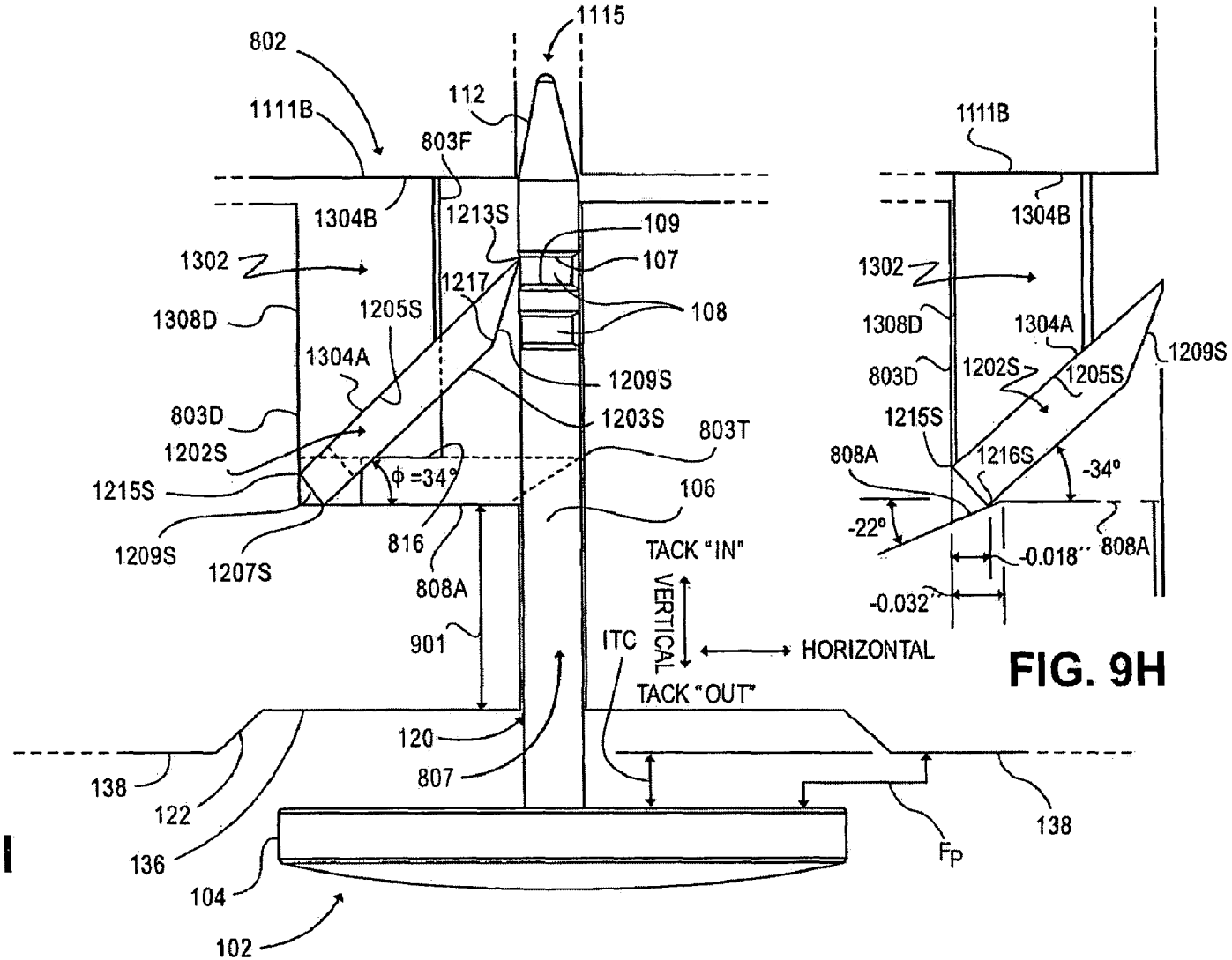
FIG. 9H illustrates the partial section A-A of FIG. 8D in accordance with a single use embodiment.
FIG. 9I illustrates the partial section A-A of FIG. 8D in accordance with a single use embodiment.

FIG. 9G illustrates a dimensional diagram for components of FIG. 9F in accordance with a second embodiment. FIG. 9G is a partial cross section A-A of FIG. 9F showing some dimensions and may be instrumental in describing improvements to the embodiment of FIGS. 8A, 8B, 8C, 8D, 9A, 9B, 9C, 9I, and curve C of FIG. 10. A second modification to improve the curve C characteristic (1) and Fpo characteristic (2) above, and to compensate for the loss of Fpo caused by introducing the wedge stop 902, may be implemented. La may be reduced from 0.195 inches of FIG. 9D to 0.185 inches of FIG. 9G to help establish a higher initial wedge angle Ǿ in an effort to further improve curve C and Fpo. Further, the initial Lw may be increased from 0.235 inches of FIG. 9D to 0.240 inches of FIG. 9G. Initial wedge angle was thus increased from 34° to 39.6°. These changes rendered a maximum possible additional tack clearance, if wedge stop 902 was not incorporated, from 0.131 inches of FIG. 9D to 0.153 inches of FIG. 9G (barring the issue of over rotation as explained earlier). The net horizontal yield when the wedge 1202 rotates from 39.6° to 22° is now equal to (0.240 inches X cos 22°−0.024 inches X cos 39.60=0.223 inches−0.185 inches=0.038 inches) 0.038 inches (See HY3 of FIG. 9G), which is improved over the 0.023 inches discussed above in the first modification. Yet another improvement is that the possible additional tack clearance has been reduced from 0.131 inches when the wedge angle rotated from 34° to 0° per FIG. 9C, to only 0.063 inches when the wedge angle rotates from 39.6° to 22° (0.240 inches X sin 39.6°−0.240 inches X sin 22°=0.153 inches−0.090 inches=0.063 inches), as indicated by ATC3 in FIG. 9G. Wall 803C is made coincident with wall 803T as seen in FIG. 9E since tack shank 106 is well supported by the increased length of tack hole 807 (From FIG. 8A to FIG. 9E) which now extends through wedge stop 902. Another salient reason was to improve issues concerning ultrasonic welding. Wedge stop 902 sloped top surface may support wedge surface 1209 prior to tack entry. A third modification to further improve characteristics (1) and (2) above, and to compensate for the loss of Fpo caused by introducing the wedge stop 902, may be implemented. The embodiment shown in FIG. 9E may be molded using hi-impact ABS plastic or polycarbonate plastic to reduce the amount of plastic yield even more to improve curve C of FIG. 10 and the Fpo. A forth modification to further improve characteristics (1) and (2) above, and to compensate for the loss of Fpo caused by introducing the wedge stop 902, may be to change the tack and wedge hardness. Typical security tacks in use today have a hardness of approximately RC 40. The wedge of the embodiment of FIG. 8D has a hardness of approximately RC 45. There is a tendency therefore for the wedge to cut and/or extrude the softer tack under the stress of Fp, and the semi-circular ledge may not form well in the edge 1213. This may lead to a lower Fpo than if the ledge was formed better. Tests have indicated that higher values are possible with a tack hardness of approximately RC 50 and a wedge hardness of approximately RC 43, thus this change may improve curve C of FIG. 10.

FIG. 9H illustrates the partial section A-A of FIG. 8D in accordance with a second single-use embodiment. FIG. 9H may be useful in describing the effect of sloped surface 808*a* on the wedge 1202S in a single-use embodiment. Ratcheting concerns the single-use tack retaining system only, referring to FIGS. 9H and 9I, with some reference to FIG. 9E. In one embodiment, a portion of top wall 808A may be sloped at approximately 22° from horizontal beginning approximately 0.032 inches from back wall 803D as shown in FIG. 9H (in contrast to no sloped surface in FIG. 9I). Before the tack 102 is inserted, wedge 1202S is biased flat on wall 808A by the compression force of rubber spring 1302 as stated before, with edge 1216S touching or virtually touching wall 808D directly above sloped surface 808*a*. The sloped portion may comprise surface 808*a* as shown in FIG. 9H. When tack shank 106 is inserted to where the wedge angle is approximately 34°, the edge 1216S of the wedge pivot end rests on the sloped surface 808*a*. When tack shank 106 and wedge 1202S are in the locked condition, edge 1216S is approximately 0.018" from back wall 803D resting on the sloped surface 808*a* in the first position. As described earlier concerning FIG. 9I, the compression force of the rubber spring 1302 has a net horizontal component that urges edge 1216S to the right, and the compression force has a net vertical component that, coupled with a coefficient of friction ω, provides a frictional force on edge 1216S that urges no movement. If the horizontal force component overcomes the frictional force, edge 1216S will move to the right until the net vertical component diminishes to where the frictional force and the net horizontal force are equal. When the sloped surface 808*a* is added, another component of force on edge 1216S is added urging edge 1216S to move to the left. This bias to the left is a function of at least the net vertical component of the compression force of rubber spring 1302, and the angle of the sloped surface 808*a*, and a coefficient of friction ω. The bias to the left plus any frictional force may counteract the bias to the right. If the angle of the sloped surface 808*a* is sufficient, the bias to the left may overcome the bias to the right. If the tag 100 is placed on a magnetic detacher of sufficient strength "S", the wedge 1202S may be rotated and attracted sufficiently to overcome the net bias to the left and translate edge 1216S off of sloped surface 808*a* and onto flat surface 808A where resistance to the translational movement of edge 1216S may become much less because the bias to the left has been eliminated. Thus a condition has been established that the magnetic detacher strength of at least "S" is required to translate edge 1216S from the sloped surface 808*a* to the flat surface 808A. The sloped surface is equally effective in the configuration of FIGS. 9E and 9F and so it may be adapted. The only difference is that the wedge angle when in locked condition (i.e., 39.6° versus 34°) causes a small difference in the distance that edge 1216S must traverse on surface 808*a* to get to surface 808A (0.016 to 0.013 inches in the embodiment of FIG. 9F). A further improvement is introduced by removing or "coring out" (See "CO" in FIG. 9E and FIG. 20) all or a portion of wall 901 from surface 808A so that edge 1216S does not slide on a surface 808A after it translates off of sloped surface 808*a* shown in FIG. E, but "falls" into the cored out hole shown in FIG. 9E and FIGS. 14 through 31, which offers no resistance to translational movement of edge 1216S or rotational movement of the wedge 1202S, so that the whole wedge 1202S immediately begins a virtually uninhibited counterclockwise rotation around the expanding rubber spring to the permanent unlock condition. Thus, a threshold has been established whereby a magnetic detacher of at least strength "S" is required to advance the edge 1216S over the end of sloped surface 808*a* (ledge 808*b*) and into the uninhibited rotation of the wedge 1202S, aided by the expanding rubber spring 1302, to the permanent unlock condition. The same sloped surface 808*a* may prevent ratcheting. If tack shank 106 has sufficient tack clearance and is pushed in and ratcheting is attempted, wedge edge 1216S may move to a second position slightly to the right of the first position but still on sloped surface 808*a*. When the tack shank 106 is pulled back to its first position, the wedge edge 1216S may return to its first position due to the sufficient slope of sloped surface 808*a*. Whereas the bias of rubber spring 1302 may tend to hold edge 1216S in the second position when in contact with a horizontal surface 808A as per FIG. 9I, the same bias tends to push the edge 1216S back down the sloped surface 808*a* to its first position due to the sufficient slope of sloped surface 808*a*. Thus, the sloped surface 808*a*, with sufficient slope, reduces or eliminates the ratcheting characteristic. In this embodiment, 22° is sufficient slope for the smooth sloped surface 808*a*. Surface 808*a* may also provide better control of wedge pivot end during assembly. It is noted here that the sloped surface 808*a* is an option providing smooth travel for the edge 1216S to the ledge 808*b*. This configuration could be replaced with a flat surface 808*a* and a fence like barrier providing a threshold that edge 1216S must surmount before the wedge 1202S can attain uninhibited rotation to the permanent unlock condition. The sloped surface 808*a* is chosen for smooth translational movement of edge 1216S and ease of molding.

In one embodiment, a portion of wall 901 may be removed or "cored out" from the surface of top wall 808A to facilitate operation of the single-use tack retaining system as discussed above. It is not necessary to core out a portion of wall 901 in the reusable tack retaining system because the protrusions 1221R and 1222R residing in recesses 821 and 822 prevent wedge 1202R from rotating into the cored out area. However, coring out of wall 901 to the extent shown in FIG. 9E and FIGS. 14 through 31, may assist in the molding process without substantially reducing the strength of the tag, so the cored out area of wall 901 is shown in views of both the single-use and reusable tack retaining systems henceforth. Another change seen in FIG. 9E is the improved position of walls 816 and 818 and walls 803K and 803L. Walls 816 and 818 are sloped to be parallel with the wedge surface 1205 when in the rest condition, providing for a virtually even surface for the entire surface 1304A of the rubber spring to bear against. Additionally, referring to the reusable embodiment, walls 803K and 803L are extended vertically to intersect walls 816 and 818 respectively at their improved position. This may provide deeper recesses 821 and 822 to better contain protrusions 1221R and 1222R of the wedge.

Figure 11:
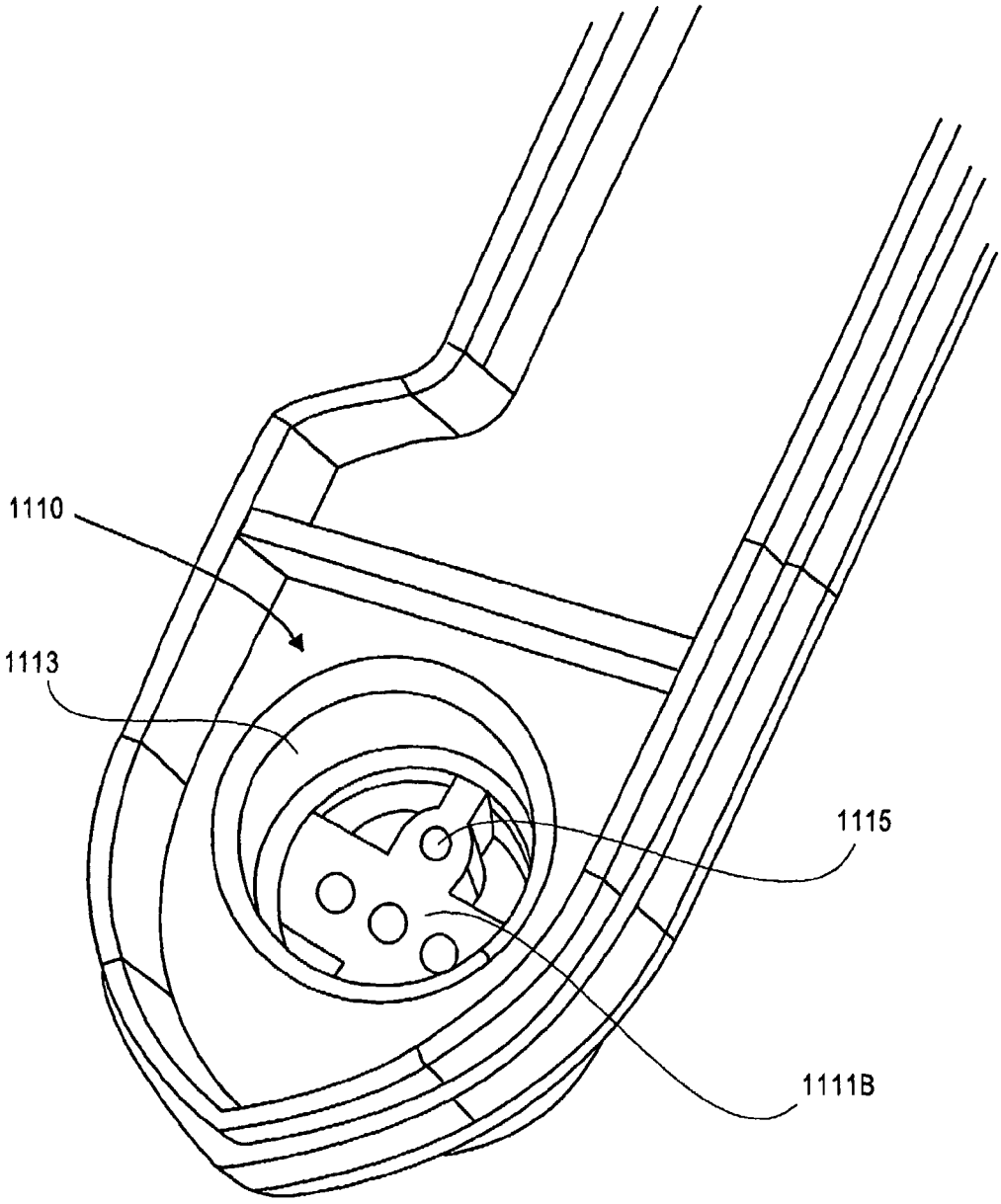
FIG. 11 illustrates an interior view of a lower housing for a security tag in accordance with one embodiment.

FIG. 11 illustrates an interior view of a lower housing for a security tag in accordance with one embodiment. As previously described, lower housing 116 may have pocket 1110. Pocket 1110 may provide bearing surface 1111B for rubber spring 1302, as described in more detail with reference to FIG. 13. The circular inside wall 1113 may guide and secure circular protrusion 809 of upper housing 114 when upper housing 114 and lower housing 116 are joined together to form security tag 100.

FIG. 12A illustrates a first view of a wedge for a security tag in accordance with one embodiment. FIG. 12A illustrates a wedge 1202R suitable for use with a reusable tack retaining system. In one embodiment, for example, wedge 1202R may be formed using magnetically attractable steel. Wedge 1202R may have a shape that is approximately 0.240 inches by 0.240 inches by 0.032 inches thick. Protrusions 1221R and 1222R may assist wedge 1202R for reuse. Protrusions 1221R and 1222R may each have the approximate dimensions of 0.032 inches by 0.032 inches by 0.032 inches. The embodiments are not limited in this context.

Wedge 1202R may have alternate arrangements as well. For example, wedge pivot side 1207R may be rounded from end to end including axel protrusions 1221R and 1222R, and the intersection of top wall 808A and back wall 803D may be rounded to movably fit the rounded pivot side 1207R. This configuration may potentially provide a better bearing surface for rounded pivot side 1207R, although at additional wedge manufacturing costs. The embodiments are not limited in this context.

FIG. 12B illustrates a second view of a wedge for a security tag in accordance with one embodiment. FIG. 12B illustrates a wedge 1202S suitable for use with a single-use tack retaining system. In one embodiment, for example, wedge 1202S may be similar to wedge 1202R. Wedge 1202S may omit, however, axel protrusions 1221R and 1222R. Since wedge 1202S does not have axel protrusions 1221R and 1222R, compartment 802 of security tag 100 does not need corresponding recesses 821 and 822 to hold axel protrusions 1221R and 1222R. The embodiments are not limited in this context.

In a single-use tack retaining system, for example, wedge 1202S is not only attracted to the magnetic surface, but is also driven to a vertical stance by the magnetic force urging rotational movement around the expanding rubber spring 1302. The magnetic attracting force field direction of the magnet, which is typically perpendicular to the pole surface in the center of the surface, drives the long dimension of wedge 1202S into alignment with the direction of the magnetic attracting force field. The single-use tack retaining system may utilize wedge 1202S and the magnetic rotational effect characteristic to attain a permanent unlock condition for security tag 100.

Certain dimensions may be selected for one or more elements of a single-use tack retaining system in order to allow tack retaining edge 1213S to be rotated from under groove lip 107 of tack shank 106 during detachment operations. At the same time, edge 1216S should be thrust off edge 808*b* (see FIGS. 25 and 26) of surface 808*a* and into the CO area of wall

808A. The movement of edge 1216S is rotational and also slightly down and lateral off of surface 808*a* and edge 808*b* and into CO.

Figure 13:
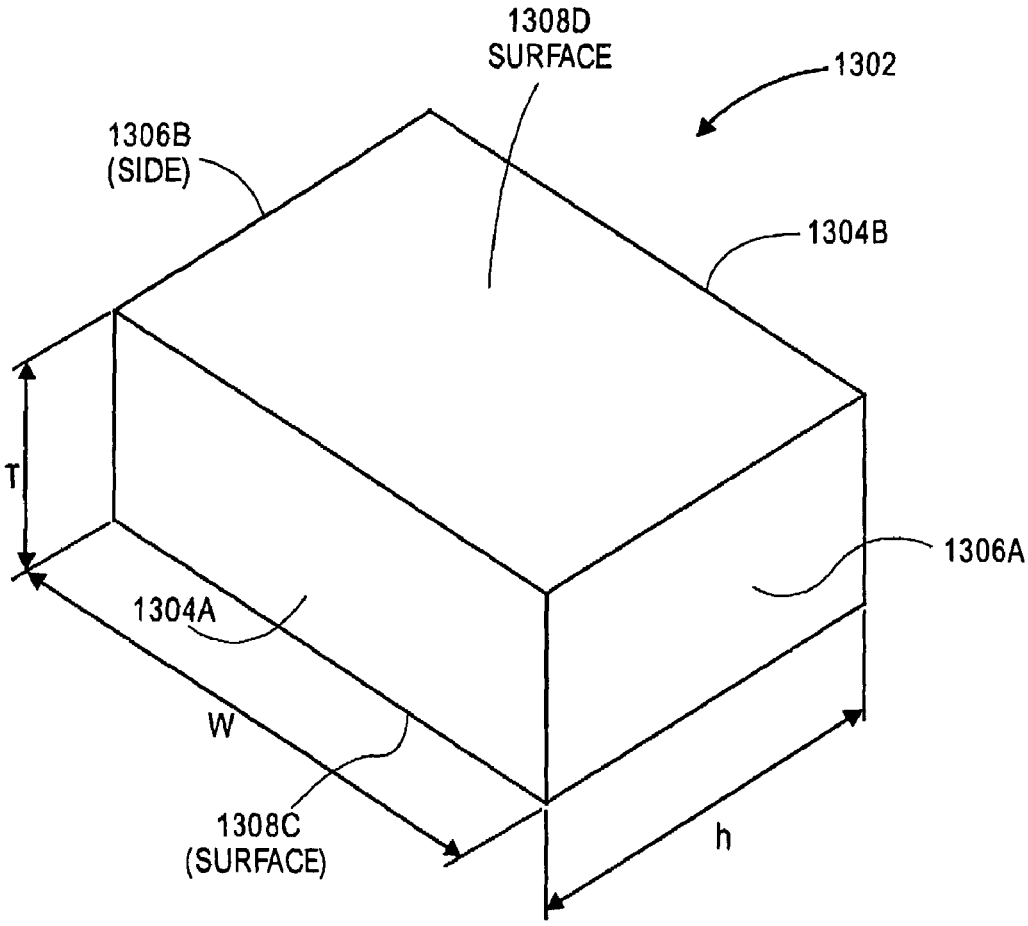
FIG. 13 illustrates a view of a rubber spring for a security tag in accordance with one embodiment.

FIG. 13 illustrates a view of a rubber spring for a security tag in accordance with one embodiment. FIG. 13 illustrates a rubber spring 1302 suitable for use with a reusable security tag or single-use security tag. In one embodiment, rubber spring 1302 may approximate the shape of a rectangular block, having a width w, height h, and a depth t. Rubber spring 1302 may also be implemented using other shapes as desired for a given set of design constraints. One feature of the rubber spring is that it provides a bias that is resilient in all directions relatively uniformly similar to a rubber ball. This feature provides vertical and horizontal components of bias essential in the functioning of the tack retaining system. The embodiments are not limited in this context.

In one embodiment, rubber spring 1302 may be made from a material such as rubber or foam rubber. The rubber material may provide a certain amount of bias (or compression force) suitable for a given implementation. The amount of bias provided by rubber spring 1302 can be changed by the formulation of the rubber product used to make rubber spring 1302. Consequently, the amount of magnetic strength needed for magnetic detaching device 602 may vary in accordance with the amount of bias provided by rubber spring 1302. For example, if rubber spring 1302 is made of a rubber product having a lower firmness and therefore providing a lower bias, magnetic device 602 may be arranged to perform detachment operations using a lower magnetic strength. In another example, if rubber spring 1302 is made of a rubber product having a higher firmness and therefore providing a higher bias, magnetic device 602 may be arranged to perform detachment operations using a higher magnetic strength. The embodiments are not limited in this context.

In one embodiment, rubber spring 1302 may be implemented using a number of different rubber products. For example, the rubber material may comprise PORON Urethane Foam number 4701-40 Soft, or 4701-50 Firm, or 4701-60 Very Firm, all made by Rogers Corporation. In addition to the previously described characteristics, the specific rubber material selected for rubber spring 1302 should offer sufficient stability and durability desired for a given implementation of security tag 100. The dimensions of rubber spring 1302 may also be important for proper detachment as well. The design flexibility offered by potentially modifying one or more characteristics of rubber spring 1302 may allow "scalability" of design for different detachment characteristics for different security tags 100. The embodiments are not limited in this context.

Figure 14:
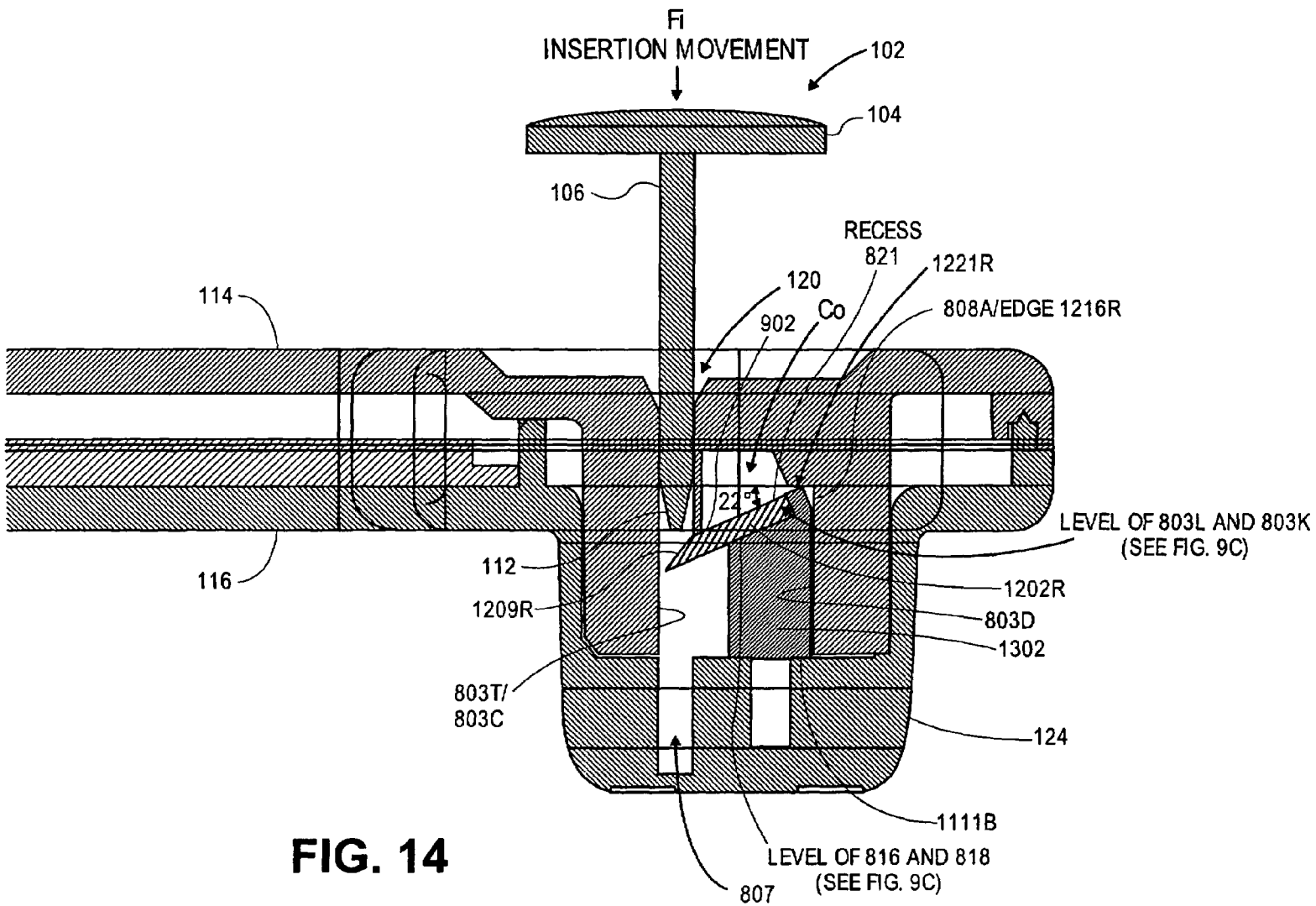
FIG. 14 illustrates a first view of a cross-section taken along line D-D of a reusable security tag with a tack, wedge, and rubber spring in accordance with one embodiment.

FIG. 9E shows the upper cover configuration used in FIGS. 14-31. The improved position of walls 816 and 818 and walls 803K and 803L are indicated for reference in reusable tag cross sections FIGS. 14 through 19. FIG. 14 illustrates a first view of a cross-section taken along line D-D of a reusable security tag with a tack, wedge, and rubber spring in accordance with one embodiment. FIG. 14 is a partial cross section D-D of FIG. 1A with the reusable tack retaining system showing tack shank 106 partially inserted into tack hole 807. The reusable tack retaining system is in a rest condition, and the operations for attaching tack assembly 102 to security tag 100 have been initiated. Pointed end 112 is inserted into aperture 120 and into tack hole 807. Pointed end 112 is approaching inclined surface 1209R of wedge 1202R. Axel protrusions 1221R and 1222R are constrained to their respective recesses 821 and 822, but are allowed to rotate within recesses 821 and 822. In one embodiment, wedge 1202R may be biased with surface 1209R on wedge stop 902 and edge 1216R on sloped surface 808*a* by rubber spring 1302 at a wedge angle Ø of approximately 22° when in the rest condition. Edge 1216R is about 0.012 inches from back wall 808D.

Figure 15:
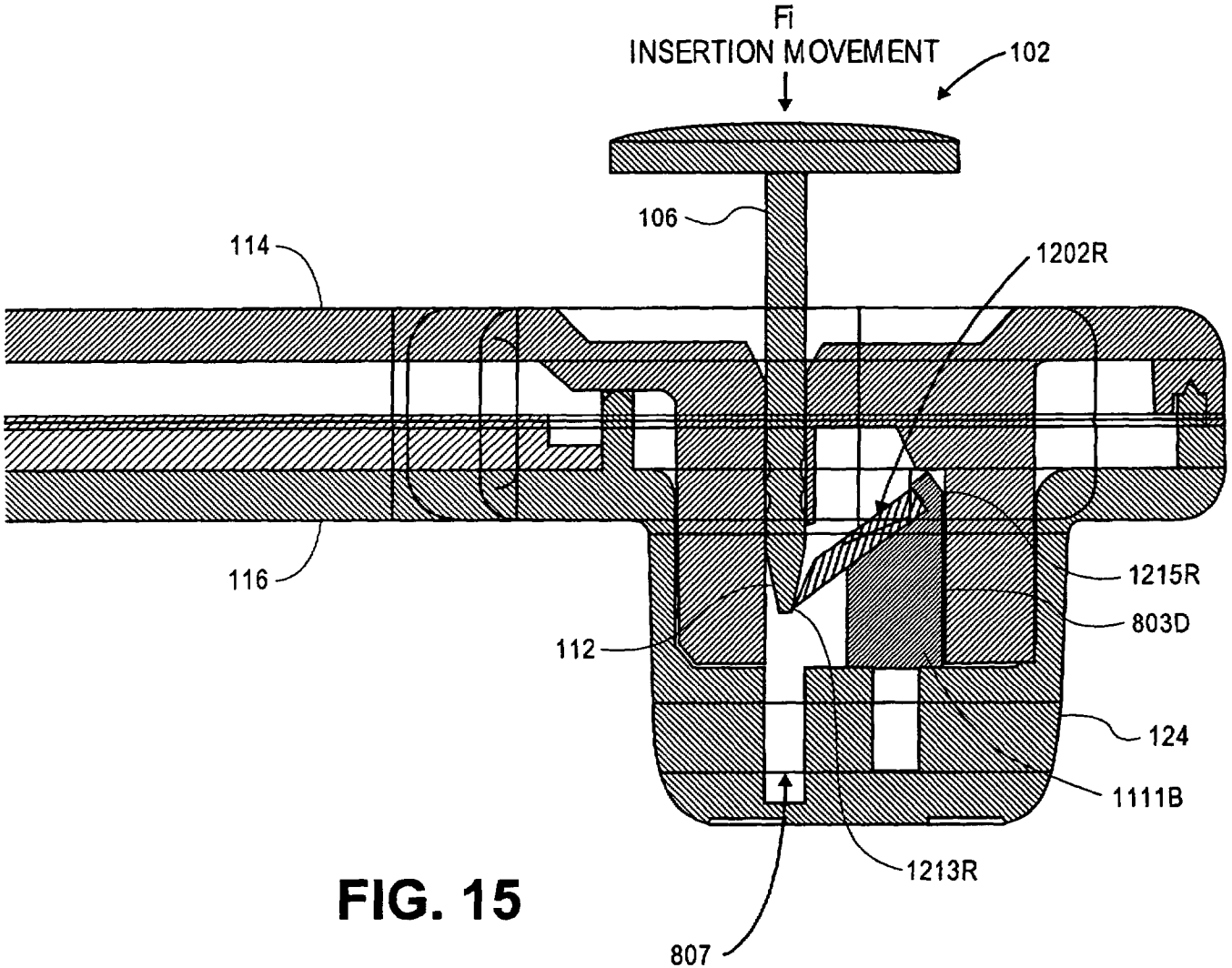
FIG. 15 illustrates a second view of a cross-section taken along line D-D of a reusable security tag with a tack, wedge, and rubber spring in accordance with one embodiment.

FIG. 15 illustrates a second view of a cross-section taken along line D-D of a reusable security tag with a tack, wedge, and rubber spring in accordance with one embodiment. FIG. 15 shows tack shank 106 further inserted into tack hole 807 until pointed end 112 has contacted surface 1209R. Such contact may force wedge 1202R to begin rotating counterclockwise approximately about edge 1215R, and edge 1216R to slide slightly on surface 808*a*. It is worthy to note that wedge 1202R does not necessarily rotate exactly about contact point of edge 1215R and back wall 803D. There may be a small movement of the contact point on wall 808D as wedge angle Ø changes. The movement on back wall 803D may approximate 0.002 inches in total as wedge angle Ø changes from 22° to 40°. This movement may slightly effect the initial tack clearance. Pointed end 112 may slide across surface 1209R such that it is contacting tack retaining edge 1213R. Rubber spring 1302 may compress slightly more between wedge 1202R and surface 1111B. The reusable tack retaining system does not necessarily enter a locked condition since tack assembly 102 could still be retracted from security tag 100.

Figure 16:
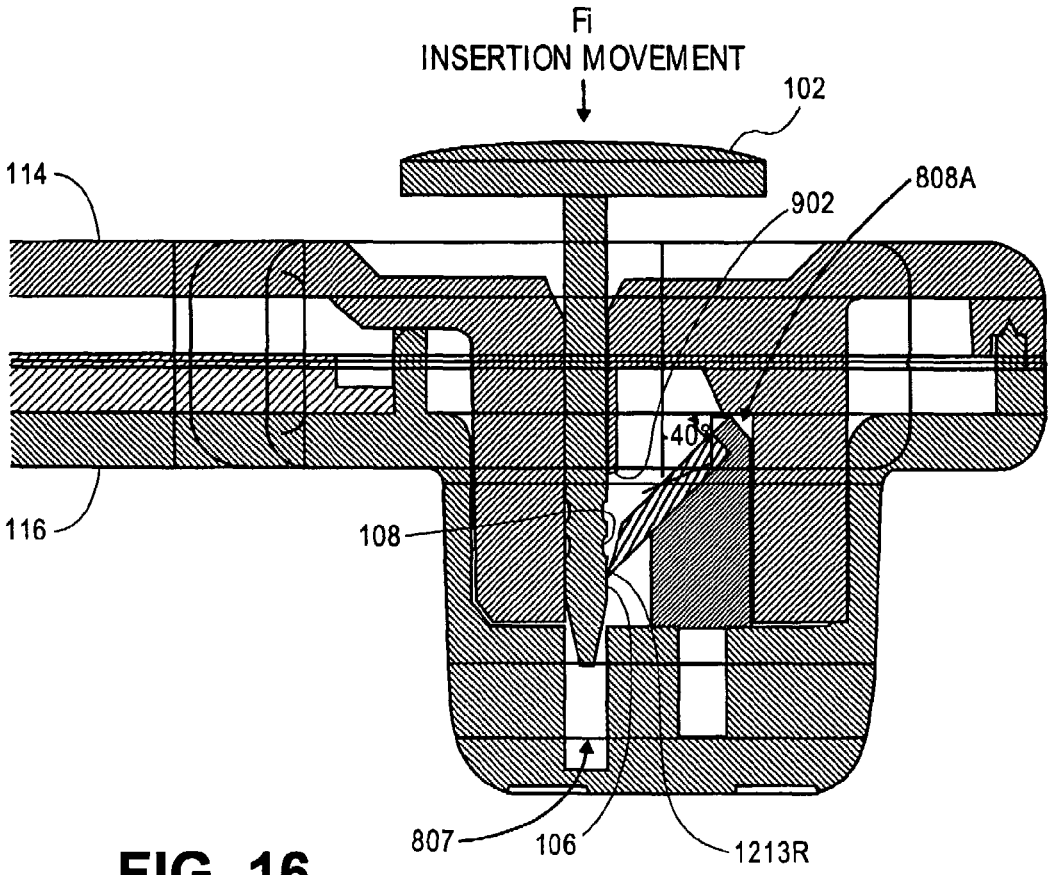
FIG. 16 illustrates a third view of a cross-section taken along line D-D of a reusable security tag with a tack, wedge, and rubber spring in accordance with one embodiment.

FIG. 16 illustrates a third view of a cross-section taken along line D-D of a reusable security tag with a tack, wedge, and rubber spring in accordance with one embodiment. FIG. 16 shows tack shank 106 when inserted further into tack hole 807 until tack shank 106 makes contact with and begins to slide by tack retaining edge 1213R. Wedge angle Ø is approximately 40°. Further insertion of tack shank 106 may position tack retaining edge 1213R adjacent to a first of grooves 108. While tack retaining edge 1213R is in contact with tack shank 106, there is no further counterclockwise rotation of wedge 1202R. The reusable tack retaining system may not yet enter a locked condition since tack assembly 102 could still be retracted from security tag 100.

Figure 17:
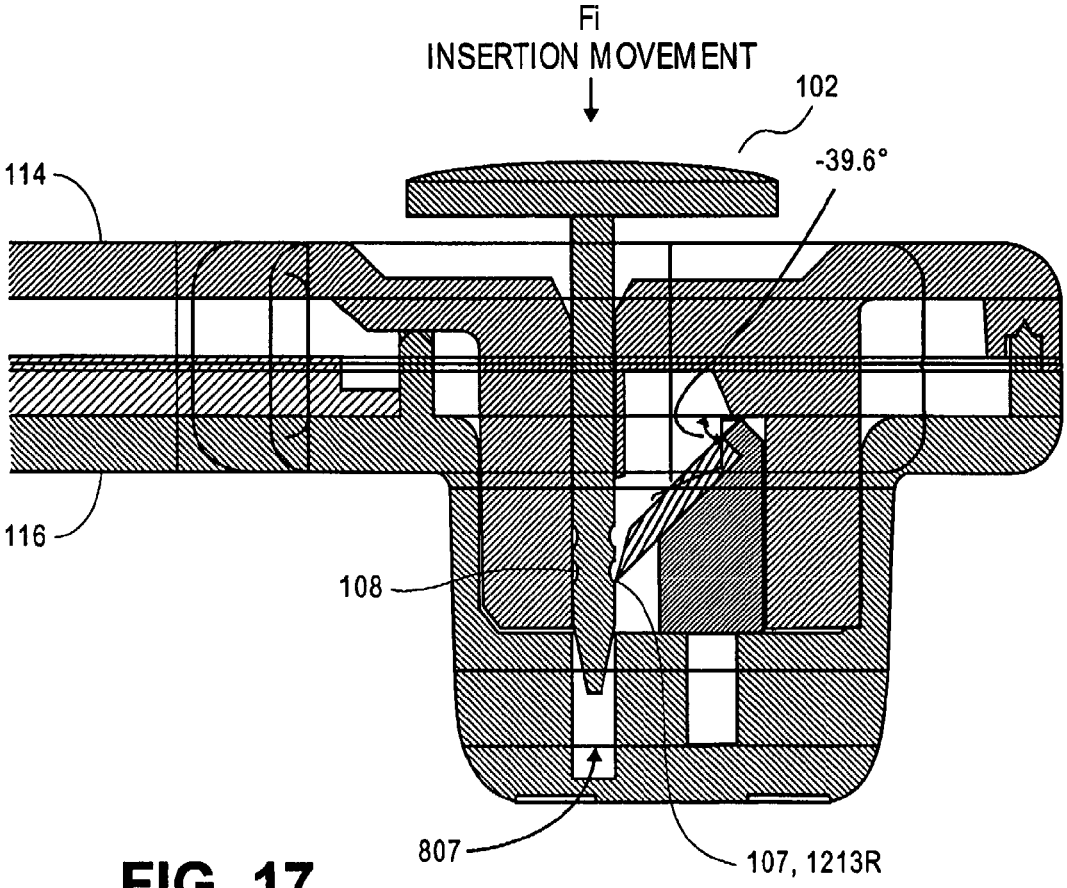
FIG. 17 illustrates a forth view of a cross-section taken along line D-D of a reusable security tag with a tack, wedge, and rubber spring in accordance with one embodiment.

FIG. 17 illustrates a forth view of a cross-section taken along line D-D of a reusable security tag with a tack, wedge, and rubber spring in accordance with one embodiment. FIG. 17 shows tack shank 106 inserted further into tack hole 807 until tack groove 108 is adjacent to tack retaining edge 1213R. At this point, the bias of rubber spring 1302 between wedge 1202R and walls 1111B and 808D may force tack retaining edge 1213R into tack groove 108 via a clockwise rotation of wedge 1202R. Wedge angle Ø is approximately 39.6°, and edge 1216R is approximately 0.019 inches from back wall 808D. Attempts to retract tack assembly 102 from security tag 100 are now prevented by the wedge as previously described. Tack retaining edge 1213R pointed tip end is now biased into the intersection of groove lip 107 of tack groove 108 by rubber spring 1302, thus restraining the tack 102 from being extracted from the tag 100. At this point the reusable tack retaining system is in a locked condition.

In one embodiment, tack assembly 102 may be removed or detached from security tag 100 implemented with a reusable tack retaining system through the use of magnetic detaching device 602. In order to detach tack assembly 102 from security tag 100, security tag 100 should be seated or nearly seated in magnetic detaching device 602. The affects of magnetic detaching device 602 on the reusable tack retaining system to detach tack assembly 102 from security tag 100 may be described in more detail with reference to FIGS. 18 and 19.

Figure 18:
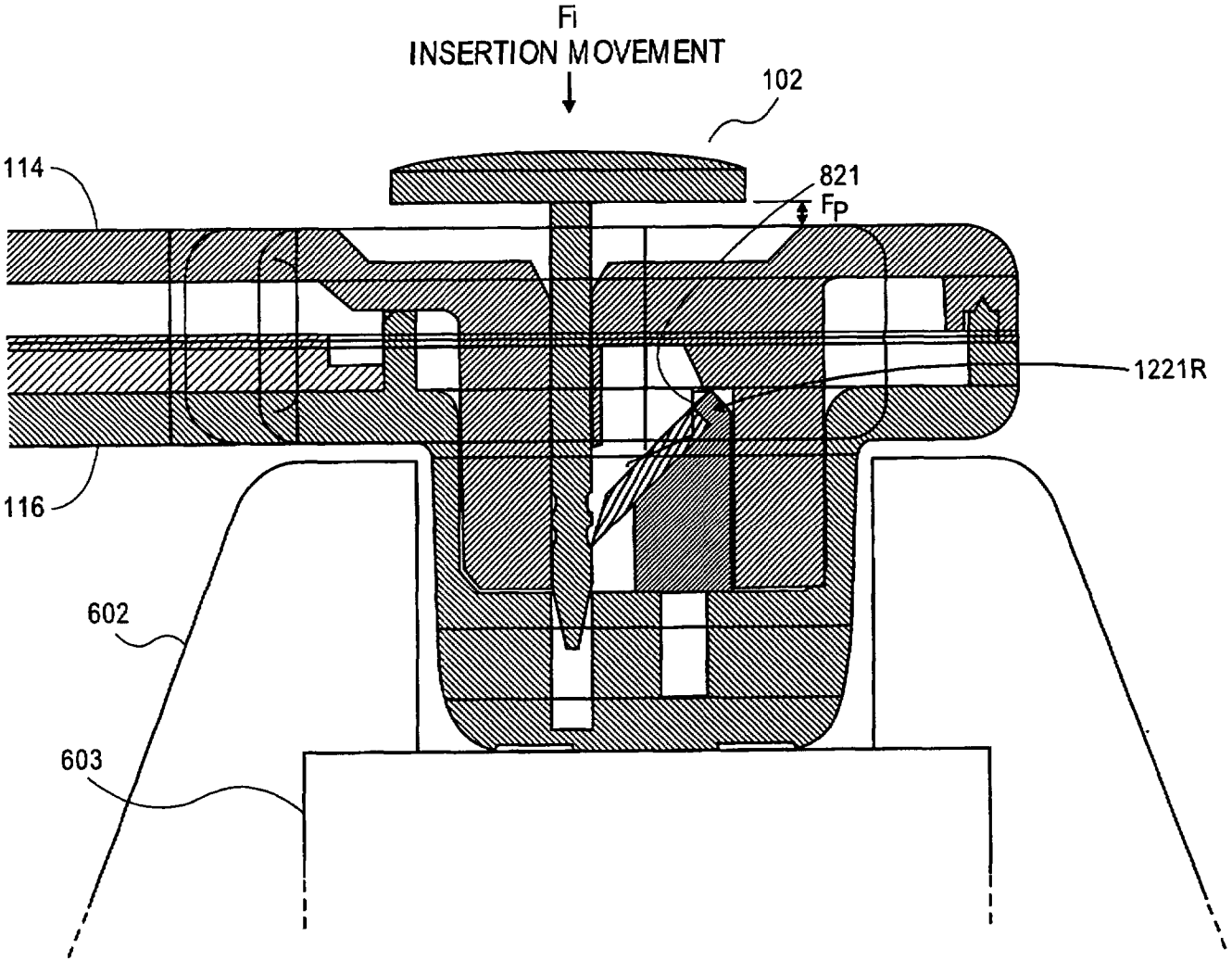
FIG. 18 illustrates a first view of a cross-section taken along line D-D of a security tag with a tack, wedge, rubber spring, and a magnetic detaching device in accordance with one embodiment.

FIG. 18 illustrates a first view of a cross-section taken along line D-D of a reusable security tag with a tack, wedge, rubber spring, and a magnetic detaching device in accordance with one embodiment. FIG. 18 shows the same partial cross section of FIG. 17 but as seated in magnetic detaching device 602. Further, assume sufficient Fp has been applied to hold the position of wedge 1202R in the locked condition when tag 100 is placed in magnetic detacher 602. When Fp is removed, magnetic detaching device 602 should be strong enough to attract wedge 1202R against the bias of rubber spring 1302, causing wedge 1202R to rotate counterclockwise about edge 1215R and axel protrusions 1221R and 1222R which are contained in their respective recesses 821 and 822, such that tack retaining edge 1213R is rotated sufficiently to clear groove lip 107 of tack shank 106.

The condition shown in FIG. 18 may occur without necessarily applying Fp to hold the locked condition since sufficient Fp may already be applied by garment 202 when secured between tack head 104 and security tag 100. In some cases, when security tag 100 is in magnetic detaching device 602, an insertion force Fi may be applied to tack head 104 to move tack shank 106 into security tag 100 sufficiently to allow groove lip 107 to release tack retaining edge 1213R so that detaching operations can be performed. Typically, movement needed for tack shank 106 may approximate 0.004 inches. This type of push-in operation to assist detachment typically exists to some extent for all magnetic clutches. In the vast majority of detachments, however, merely placing security tag 100 in magnetic detaching device 602 will be sufficient to free tack assembly 102 from security tag 100 for detachment operations to be completed.

Figure 19:
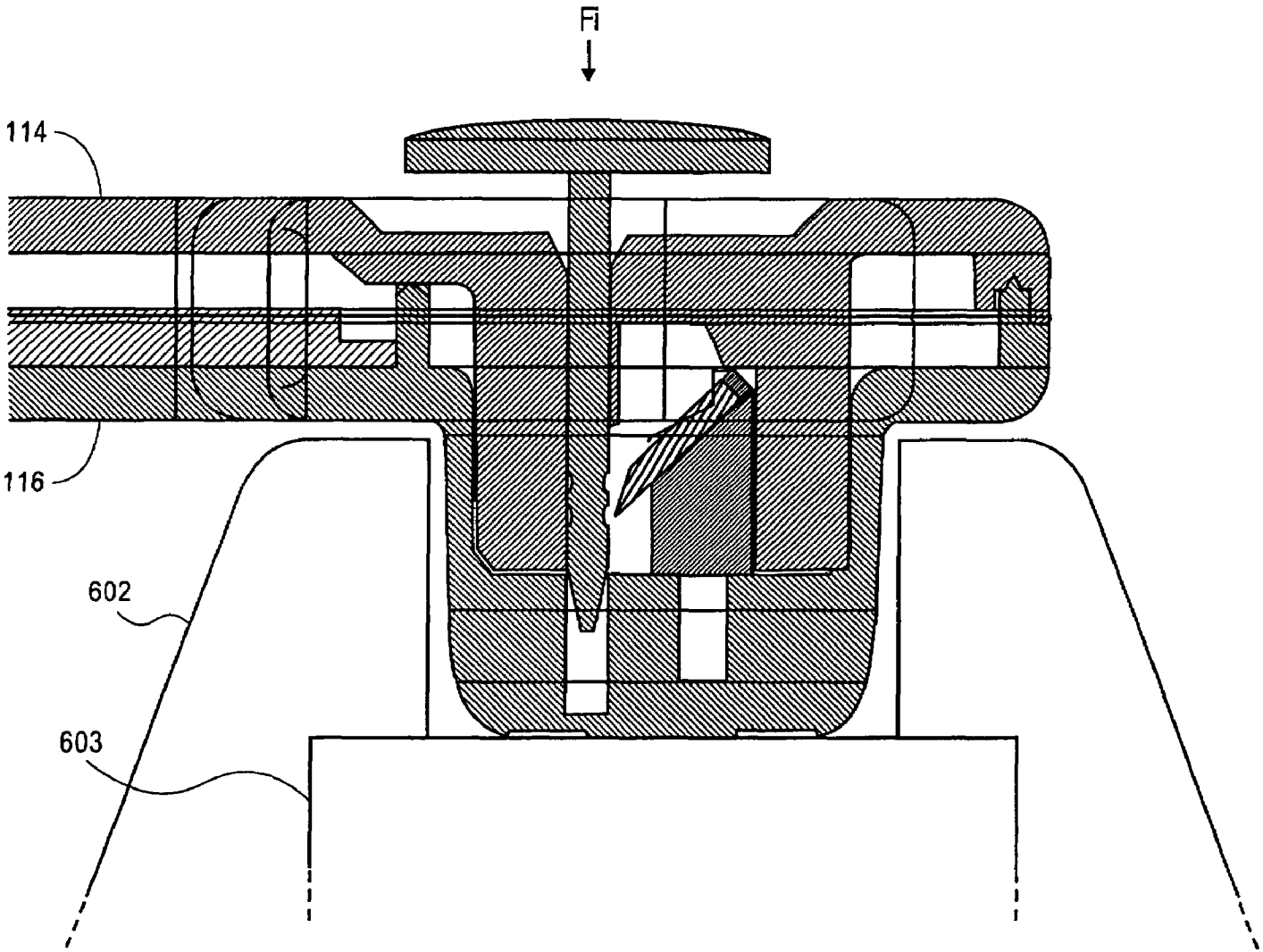
FIG. 19 illustrates a second view of a cross-section taken along line D-D of a security tag with a tack, wedge, rubber spring, and a magnetic detaching device in accordance with one embodiment.

FIG. 19 illustrates a second view of a cross-section taken along line D-D of a reusable security tag with a tack, wedge, rubber spring, and a magnetic detaching device in accordance with one embodiment. FIG. 19 shows the unlock condition after Fp is removed. Groove lip 107 is released from tack retaining edge 1213R and thus tack assembly 102 can be retracted from security tag 100 as long as security tag 100 remains in magnetic detaching device 602. When tack assembly 102 is retracted and security tag 100 is removed from magnetic detaching device 602, the condition of wedge 1202R reverts to the rest condition shown in FIG. 14. If tack shank 106 is left in tack hole 807 when security tag 100 is removed from magnetic detaching device 602, the condition of wedge 1202R may revert to that shown in FIG. 17. This operation may be counter productive however, since the purpose is to detach tack assembly 102 from security tag 100.

Figure 20:
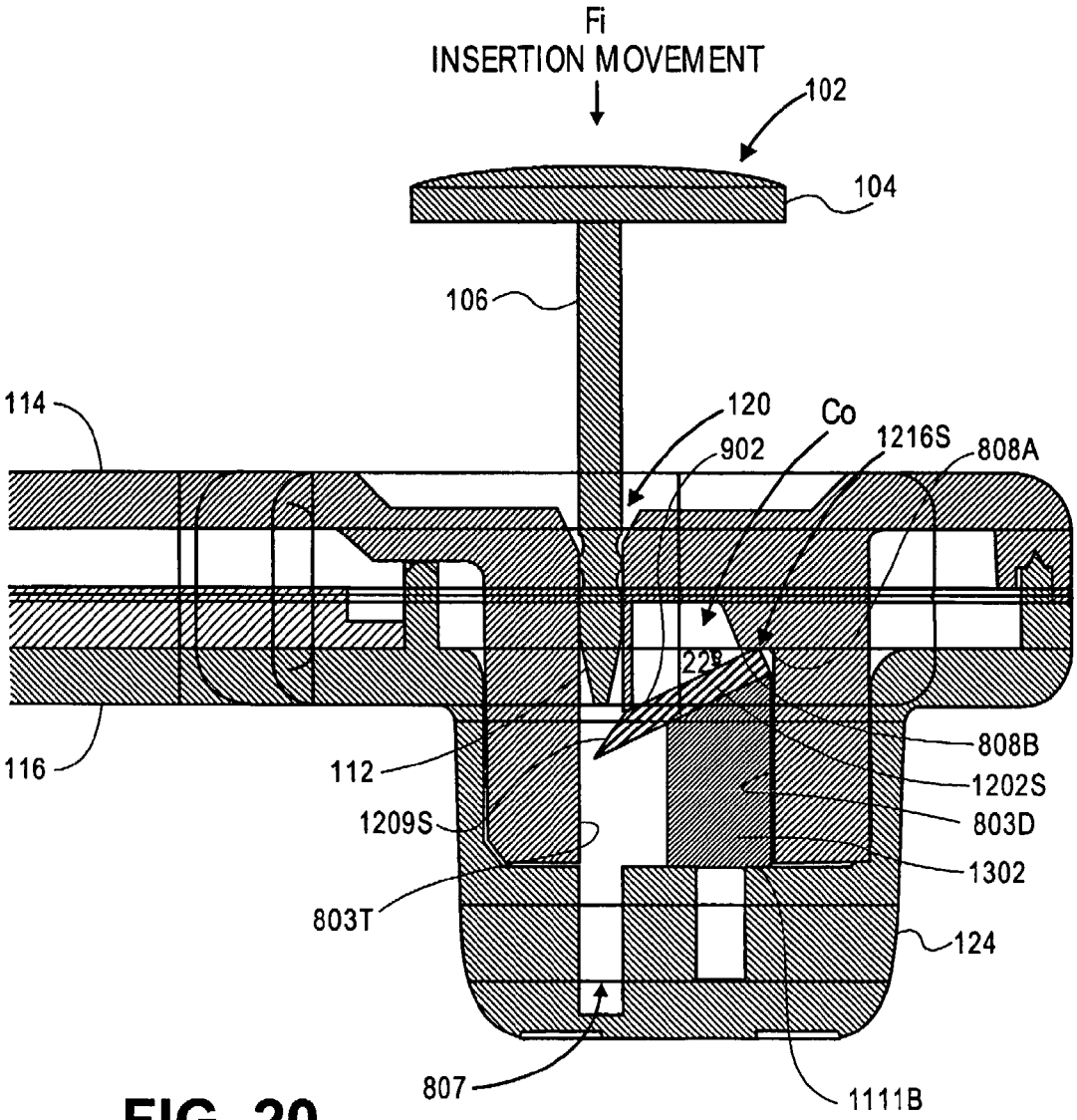
FIG. 20 illustrates a first view of a cross-section taken along line D-D of a single-use security tag with a tack, wedge, and rubber spring in accordance with one embodiment.

FIG. 20 illustrates a first view of a cross-section taken along line D-D of a single-use security tag with a tack, wedge, and rubber spring in accordance with one embodiment. FIG. 20 is a partial cross section D-D of FIG. 1A with a single-use tack retaining system showing tack shank 106 partially inserted into tack hole 807. As shown in FIG. 20, the single-use tack retaining system is in a rest condition, and attachment operations to attach tack assembly 102 to security tag 100 have been initiated. Pointed end 112 may be inserted into aperture 120 and tack hole 807. Pointed end 112 may be approaching inclined surface 1209S of wedge 1202S. Wedge 1202S may be biased against wedge stop 902 and sloped surface 808*a* by rubber spring 1302. In a rest condition, wedge 1202S may be biased with surface 1209S on wedge stop 902 (not fully shown) and edge 1216S on sloped surface 808*a* by rubber spring 1302 at a wedge angle Ǿ of approximately 22° when in rest condition. Edge 1216S is approximately 0.012 inches from back wall 808D and approximately 0.020 inches from ledge 808*b*.

Figure 21:
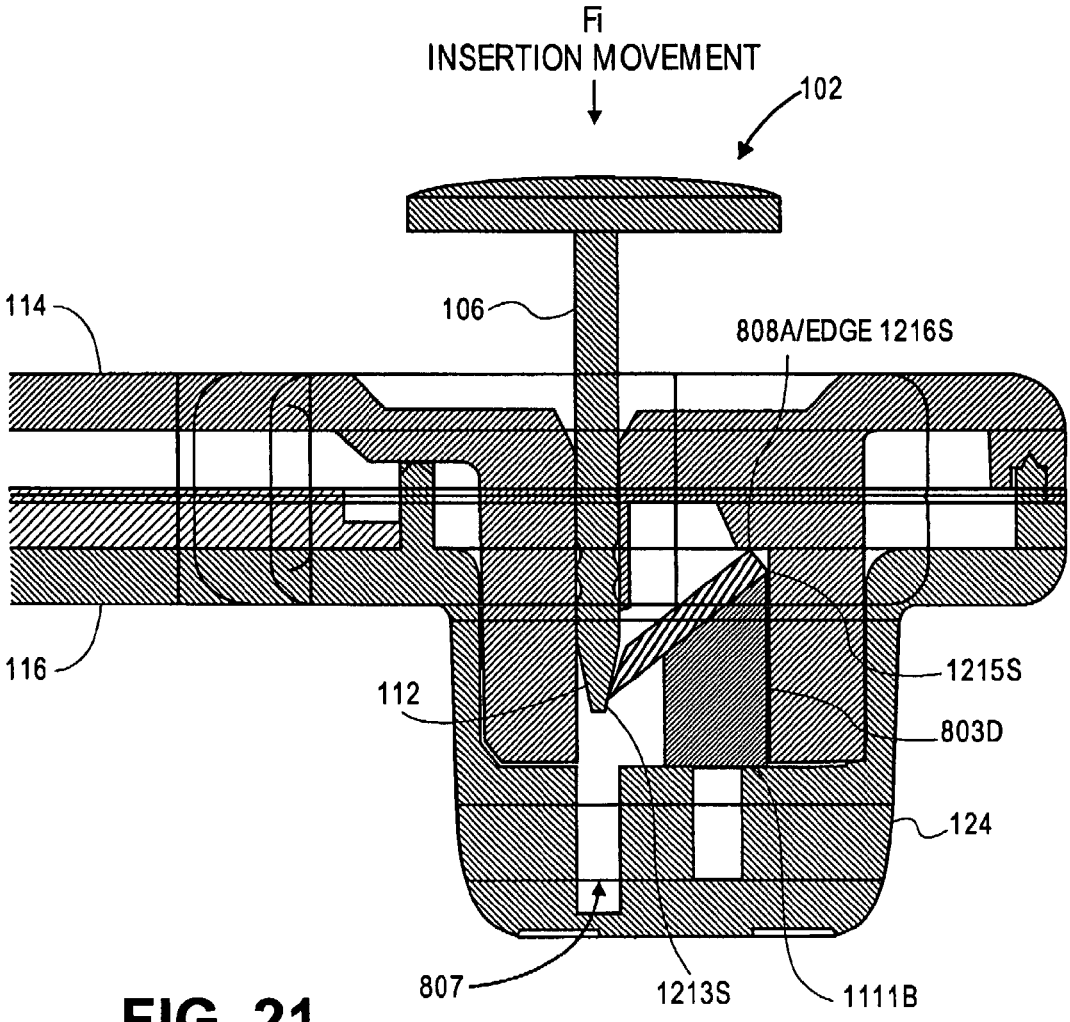
FIG. 21 illustrates a second view of a cross-section taken along line D-D of a single-use security tag with a tack, wedge, and rubber spring in accordance with one embodiment.

FIG. 21 illustrates a second view of a cross-section taken along line D-D of a single-use security tag with a tack, wedge, and rubber spring in accordance with one embodiment. FIG. 21 shows tack shank 106 further inserted into tack hole 807 and where pointed end 112 has contacted surface 1209S. The contact may force wedge 1202S to begin rotating counterclockwise approximately about edge 1215S, and edge 1216S to slide slightly to the left on surface 808*a*. It is worthy to note that wedge 1202S does not necessarily rotate exactly about the rest condition contact point of edge 1215S and back wall 803D. There may be a small movement of the contact point as angle Ǿ changes. The movement on back wall 803D may comprise, for example, 0.002 inches in total when the wedge angle moves from 22° to 40°. The movement may slightly effect the initial additional tack clearance. Pointed end 112 may slide across surface 1209S such that it makes contact with tack retaining edge 1213S. Rubber spring 1302 may compress slightly more between wedge 1202S and surface 1111B. The single-use tack retaining system may not yet enter into a locked condition since tack assembly 102 could still be retracted from security tag 100.

Figure 22:
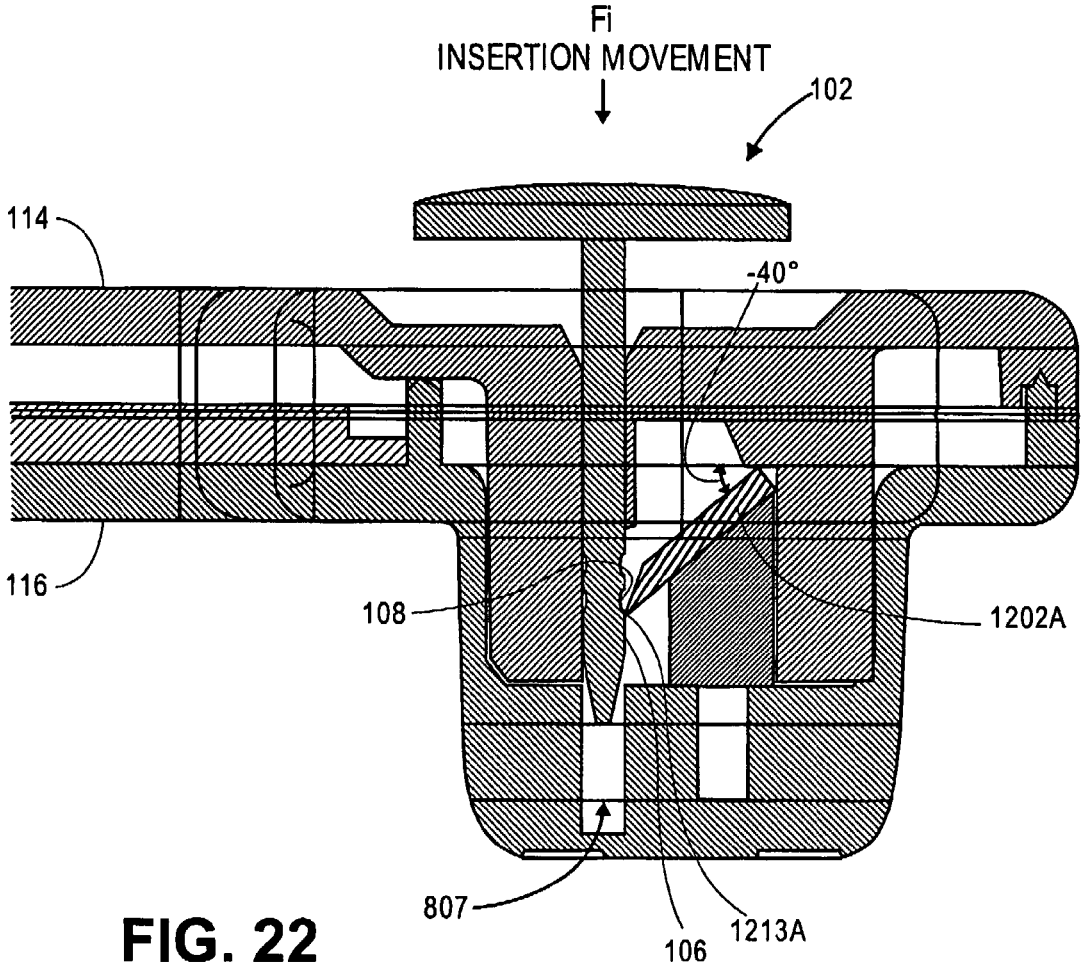
FIG. 22 illustrates a third view of a cross-section taken along line D-D of a single-use security tag with a tack, wedge, and rubber spring in accordance with one embodiment.

FIG. 22 illustrates a third view of a cross-section taken along line D-D of a single-use security tag with a tack, wedge, and rubber spring in accordance with one embodiment. FIG. 22 shows tack shank 106 inserted further into tack hole 807 until tack shank 106 makes contact with, and begins to slide by, tack retaining edge 1213S. Further insertion of tack shank 106 may cause tack retaining edge 1213S to become adjacent to a first tack groove 108. While tack retaining edge 1213S is in contact with tack shank 106, there may be no further counterclockwise rotation of wedge 1202S. The wedge angle Ǿ is approximately 40°. The single-use tack retaining system may not yet be in a locked condition since tack assembly 102 could still be retracted from security tag 100.

Figure 23:
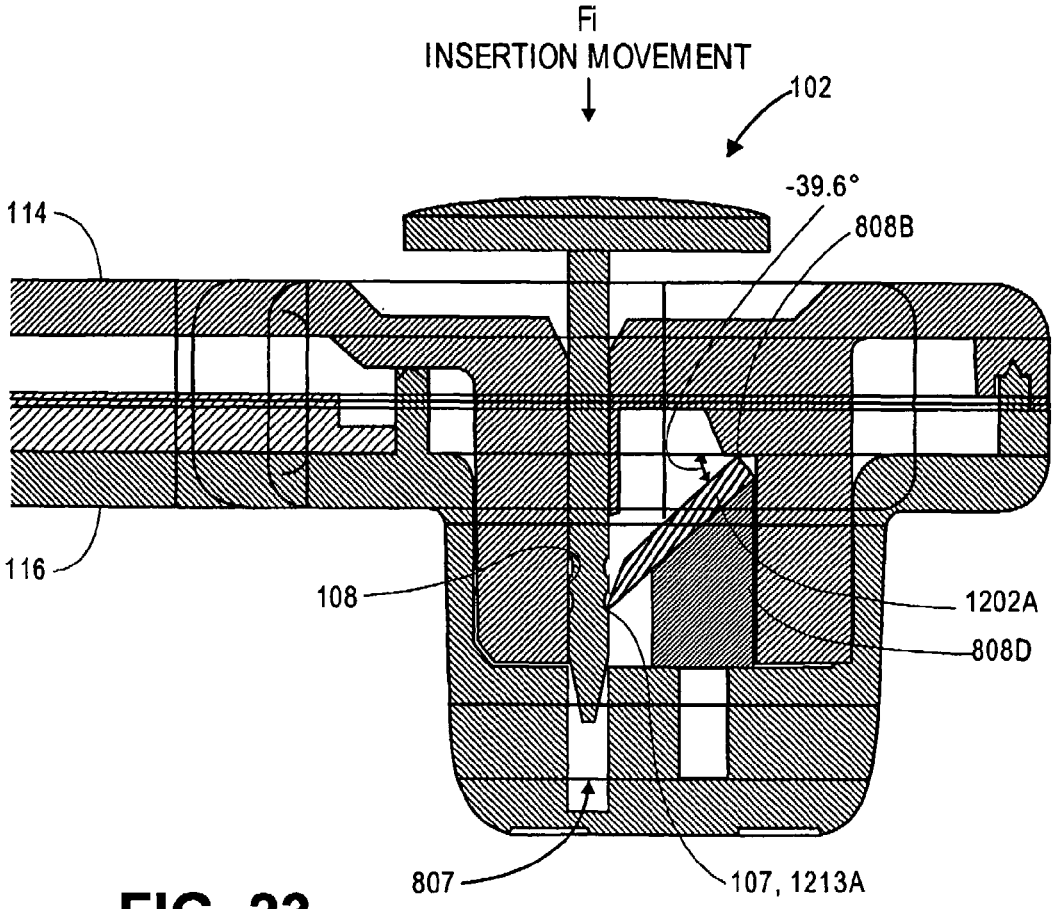
FIG. 23 illustrates a forth view of a cross-section taken along line D-D of a single-use security tag with a tack, wedge, and rubber spring in accordance with one embodiment.

FIG. 23 illustrates a forth view of a cross-section taken along line D-D of a single-use security tag with a tack, wedge, and rubber spring in accordance with one embodiment. FIG. 23 shows tack shank 106 inserted further into tack hole 807 until tack groove 108 is adjacent to tack retaining edge 1213S. At this point, the bias of rubber spring 1302 between wedge 1202S and walls 1111B and 808D may force tack retaining edge 1213S into tack groove 108 via a clockwise rotation of wedge 1202S. Wedge angle Ǿ is approximately 39.6°. Edge 1216S is approximately 0.019 inches from back wall 808D and approximately 0.013 inches from ledge 808*b*. Attempts to retract tack assembly 102 from security tag 100 are now prevented by wedge 1202S as previously described. Tack retaining edge 1213S pointed tip end is now biased into the intersection of groove lip 107 and tack groove 108 thus restraining the tack 102 from being extracted from the tag 100. The single-use tack retaining system is now in a locked condition.

In one embodiment, tack assembly 102 may be removed or detached from security tag 100 as implemented with a single-use tack retaining system through use of magnetic detaching device 602. In order to detach tack assembly 102 from security tag 100, security tag 100 should be seated or nearly seated in magnetic detaching device 602. The affects of magnetic detaching device 602 on the single-use tack retaining system to detach tack assembly 102 from security tag 100 may be described in more detail with reference to FIGS. 24-30.

Figure 24:
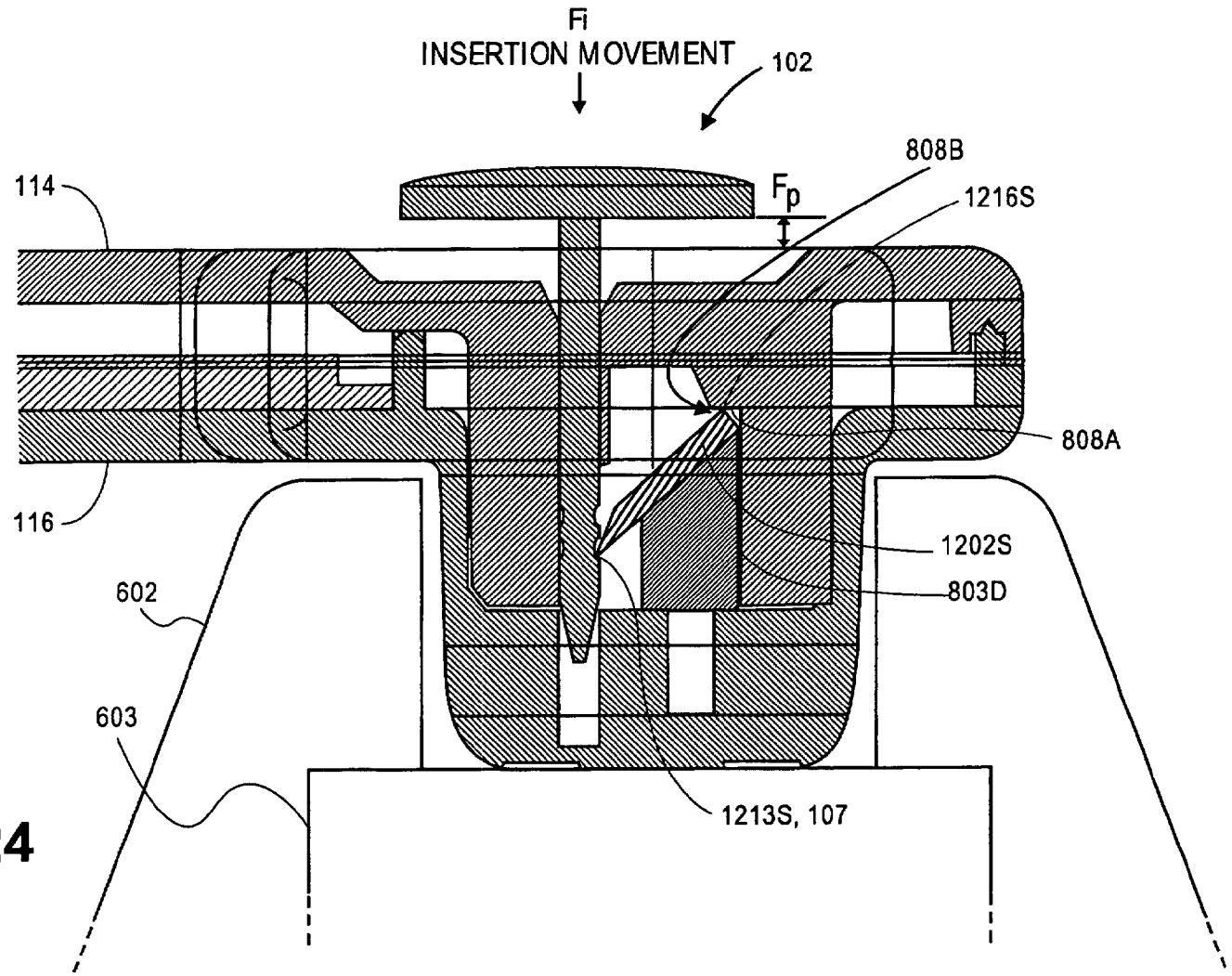
FIG. 24 illustrates a first view of a cross-section taken along line D-D of a single-use security tag with a tack, wedge, rubber spring, and a magnetic detaching device in accordance with one embodiment.

FIG. 24 illustrates a first view of a cross-section taken along line D-D of a single-use security tag with a tack, wedge, rubber spring, and a magnetic detaching device in accordance with one embodiment. FIG. 24 shows the same partial cross section of FIG. 23 but as seated in magnetic detaching device 602. Further, assume sufficient Fp has been applied to hold the position of wedge 1202S in the locked condition when tag 100 is placed in magnetic detacher 602. When Fp is removed, detachment begins. Magnetic detaching device 602 begins to attract wedge 1202S against the bias of rubber spring 1302, thereby urging wedge 1202S to rotate counterclockwise approximately about edge 1215S, and urging translation of edge 1216S to the left on sloped surface 808*a* towards ledge 808*b*.

The condition shown in FIG. 24 may occur without applying Fp to hold the locked condition because sufficient Fp may already be applied by garment 202 when secured between tack head 104 and security tag 100. In some cases, when security tag 100 is placed within magnetic detaching device 602, an insertion force Fi may be applied to tack head 104 to move tack shank 106 into security tag 100 with sufficient depth to allow groove lip 107 to release tack retaining edge 1213S so that detaching can occur. In some cases, for example, tack shank 106 may need to be pushed or moved approximately 0.004 inches to release tack retaining edge 1213S. The occasional use of addition insertion force Fi to assist detachment typically exists to some extent for all magnetic clutches. In the vast majority of detachments, however, merely placing security tag 100 in magnetic detaching device 602 will be sufficient to cause the single-use tack retaining system to attain a permanent unlock condition.

Figure 25:
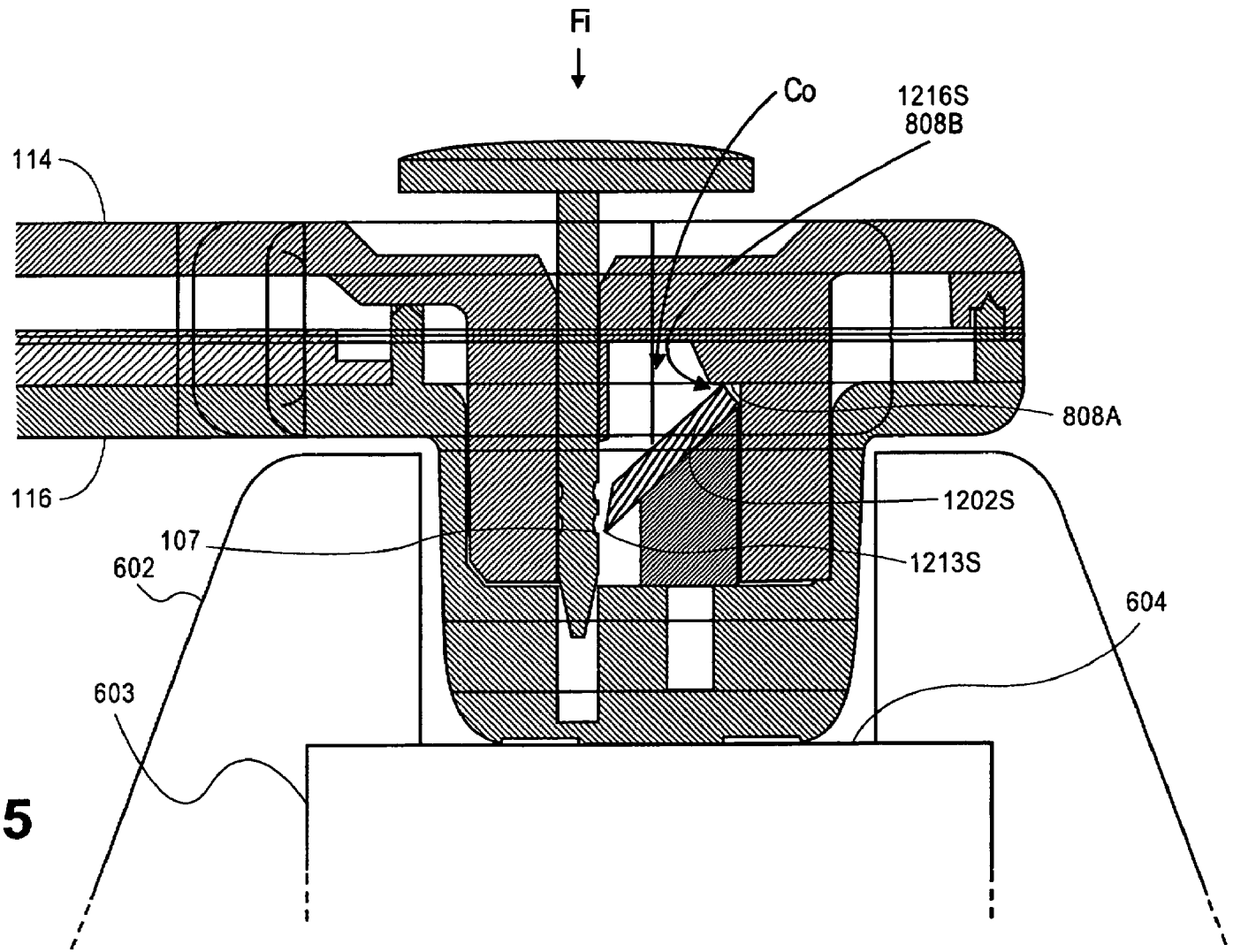
FIG. 25 illustrates a second view of a cross-section taken along line D-D of a single-use security tag with a tack, wedge, rubber spring, and a magnetic detaching device in accordance with one embodiment.

FIG. 25 illustrates a second view of a cross-section taken along line D-D of a single-use security tag with a tack, wedge, rubber spring, and a magnetic detaching device in accordance with one embodiment. FIG. 25 shows the effect of an attractive force from magnetic assembly 603 on wedge 1202S. The magnetic attractive force may cause wedge 1202S to compress rubber spring 1302 slightly more than shown in FIG. 24, and tack retaining edge 1213S may be rotated slightly out from under groove lip 107 and drawn slightly toward magnetic assembly pole surface 604. Virtually at the same instant, edge 1216S may move across surface 808*a* to ledge 808*b*. It is worthy to note that with the reusable tack retaining system, the lateral movement of wedge edge 1216R across surface 808*a* is prevented since axel protrusions 1221R and 1222R are restricted from lateral movement by their respective recesses 821 and 822.

Figure 26:
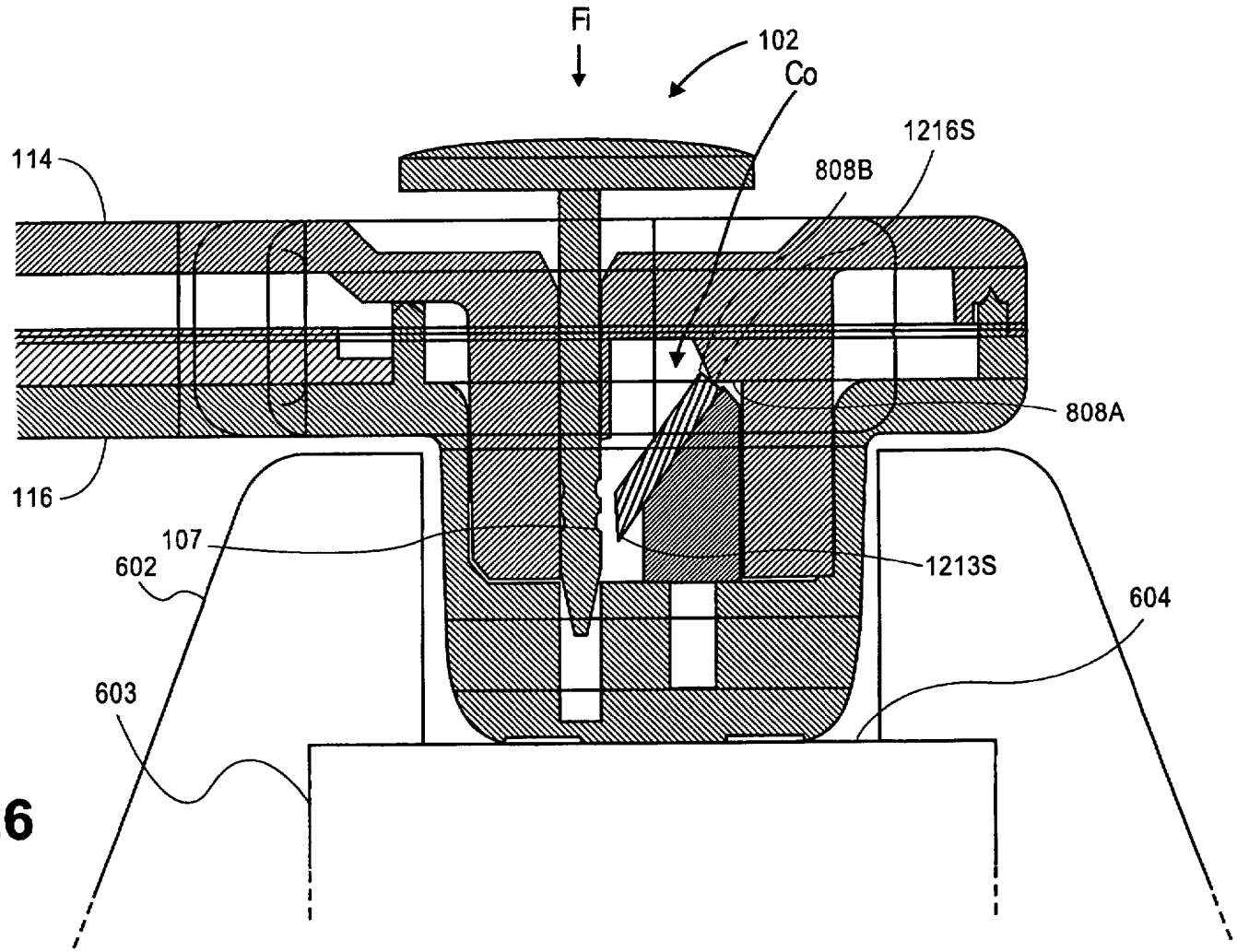
FIG. 26 illustrates a third view of a cross-section taken along line D-D of a single-use security tag with a tack, wedge, rubber spring, and a magnetic detaching device in accordance with one embodiment.

FIG. 26 illustrates a third view of a cross-section taken along line D-D of a single-use security tag with a tack, wedge, rubber spring, and a magnetic detaching device in accordance with one embodiment. FIG. 26 shows tack retaining edge 1213S of wedge 1202S being attracted toward magnetic assembly surface 604 while edge 1216S clears ledge 808*b*. In addition, rubber spring 1302 may begin to expand from the compressed condition shown in FIG. 25, which may push edge 1216S toward tack assembly 102.

Figure 27:
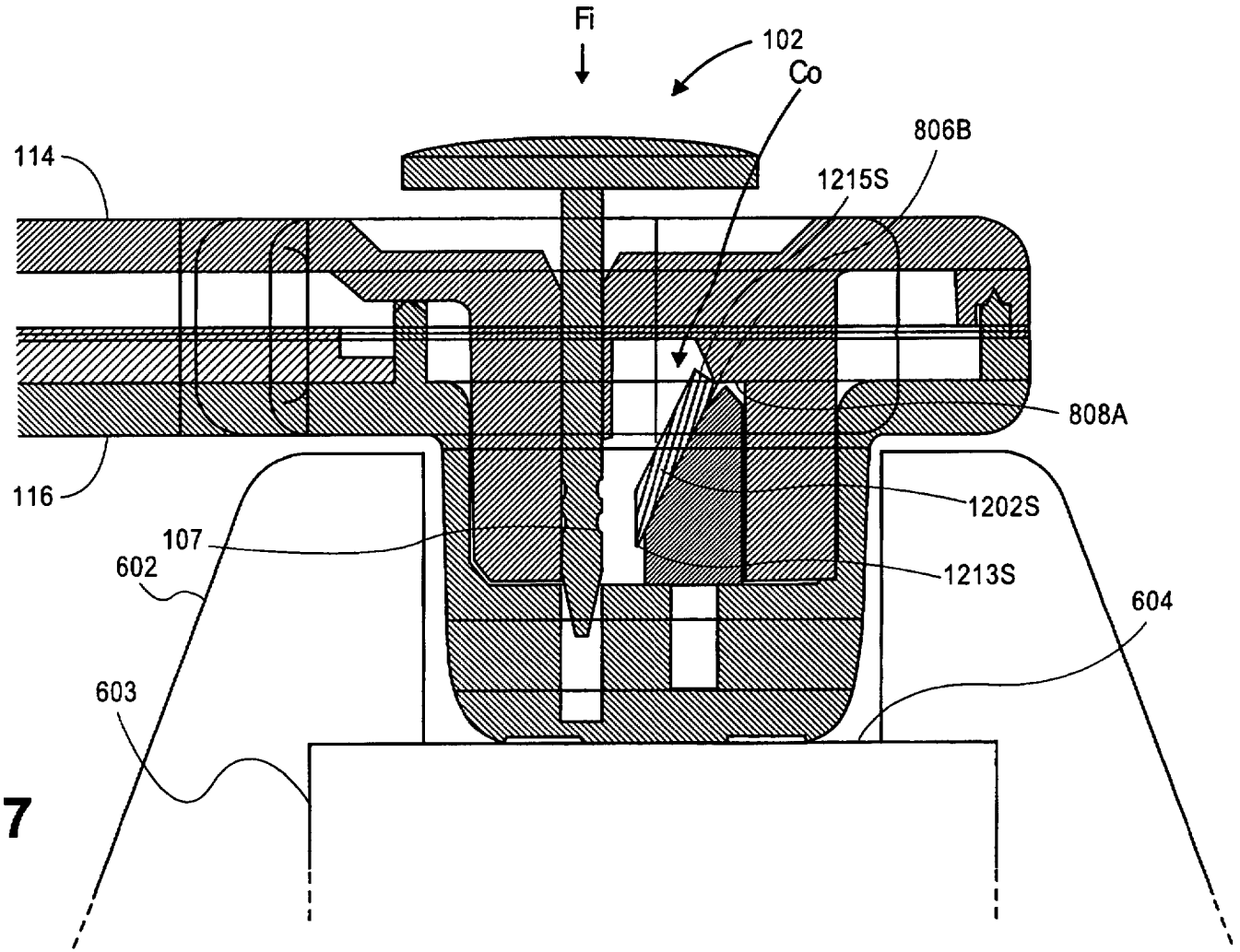
FIG. 27 illustrates a forth view of a cross-section taken along line D-D of a single-use security tag with a tack, wedge, rubber spring, and a magnetic detaching device in accordance with one embodiment.

FIG. 27 illustrates a forth view of a cross-section taken along line D-D of a single-use security tag with a tack, wedge, rubber spring, and a magnetic detaching device in accordance with one embodiment. FIG. 27 shows edge 1213S of wedge 1202S being attracted further toward magnetic assembly surface 604, while edge 1215S clears ledge 808*b*. Further, rubber spring 1302 may continue to expand further from the compressed condition shown in FIG. 26, which may push edge 1216S further toward tack assembly 102.

Figure 28:
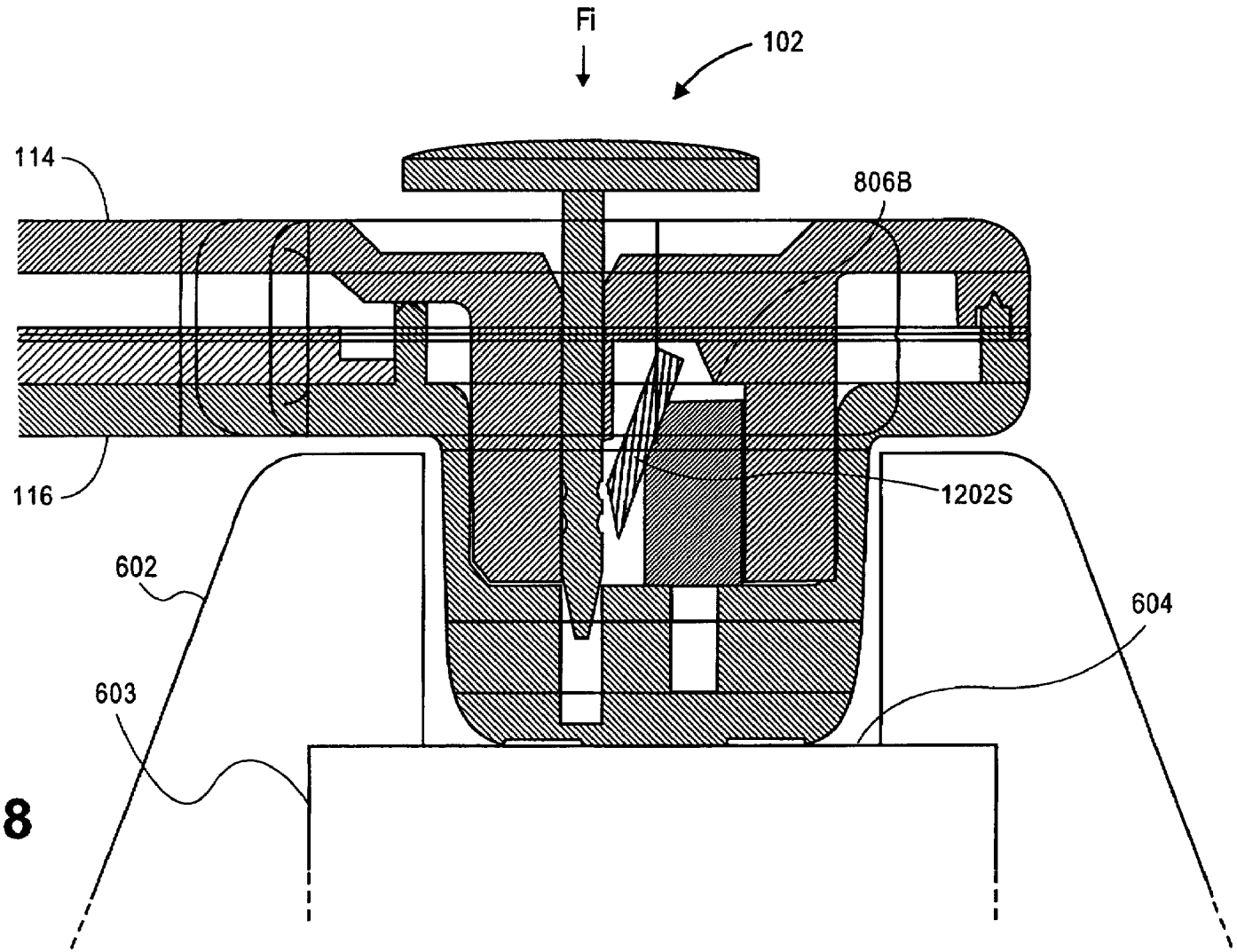
FIG. 28 illustrates a fifth view of a cross-section taken along line D-D of a single-use security tag with a tack, wedge, rubber spring, and a magnetic detaching device in accordance with one embodiment.

FIG. 28 illustrates a fifth view of a cross-section taken along line D-D of a single-use security tag with a tack, wedge, rubber spring, and a magnetic detaching device in accordance with one embodiment. FIG. 28 shows rubber spring 1302 in an expanded position which may help drive wedge 1202S to a substantially vertical position, while magnetic assembly 603 continues to attract tack retaining edge 1213S toward magnetic assembly surface 604, and drive wedge 1202S to a vertical position.

Figure 29:
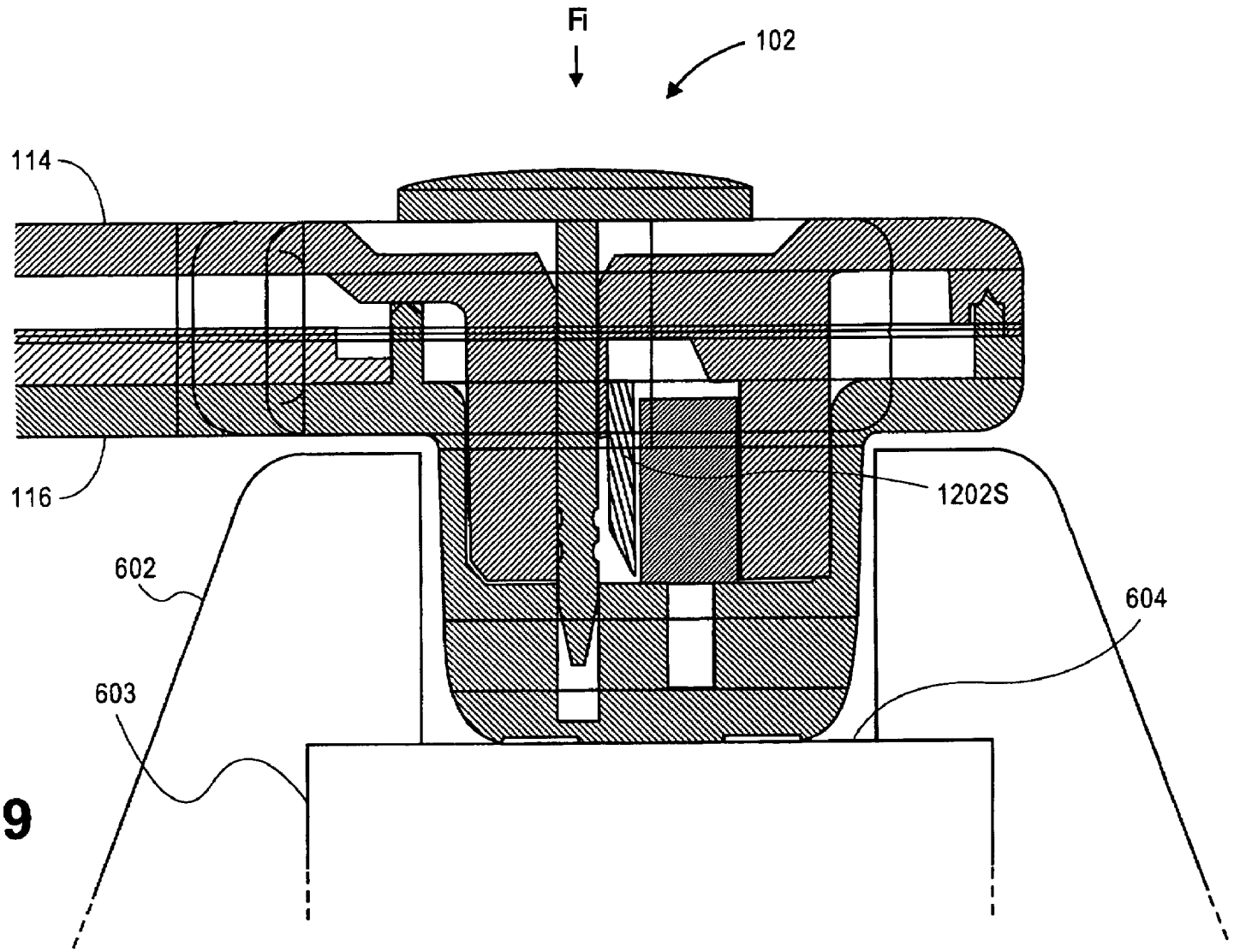
FIG. 29 illustrates a sixth view of a cross-section taken along line D-D of a single-use security tag with a tack, wedge, rubber spring, and a magnetic detaching device in accordance with one embodiment.

FIG. 29 illustrates a sixth view of a cross-section taken along line D-D of a single-use security tag with a tack, wedge, rubber spring, and a magnetic detaching device in accordance with one embodiment. FIG. 29 shows wedge 1202S in a substantially vertical position beside a fully expanded rubber spring 1302. Tack retaining edge 1213S is as close to pole surface 604 as possible, and is in contact with surface 1111B. Tack assembly 102 is completely free from impediment and can be retracted from security tag 100. Security tag 100 is now in a permanent unlock condition.

Figure 30:
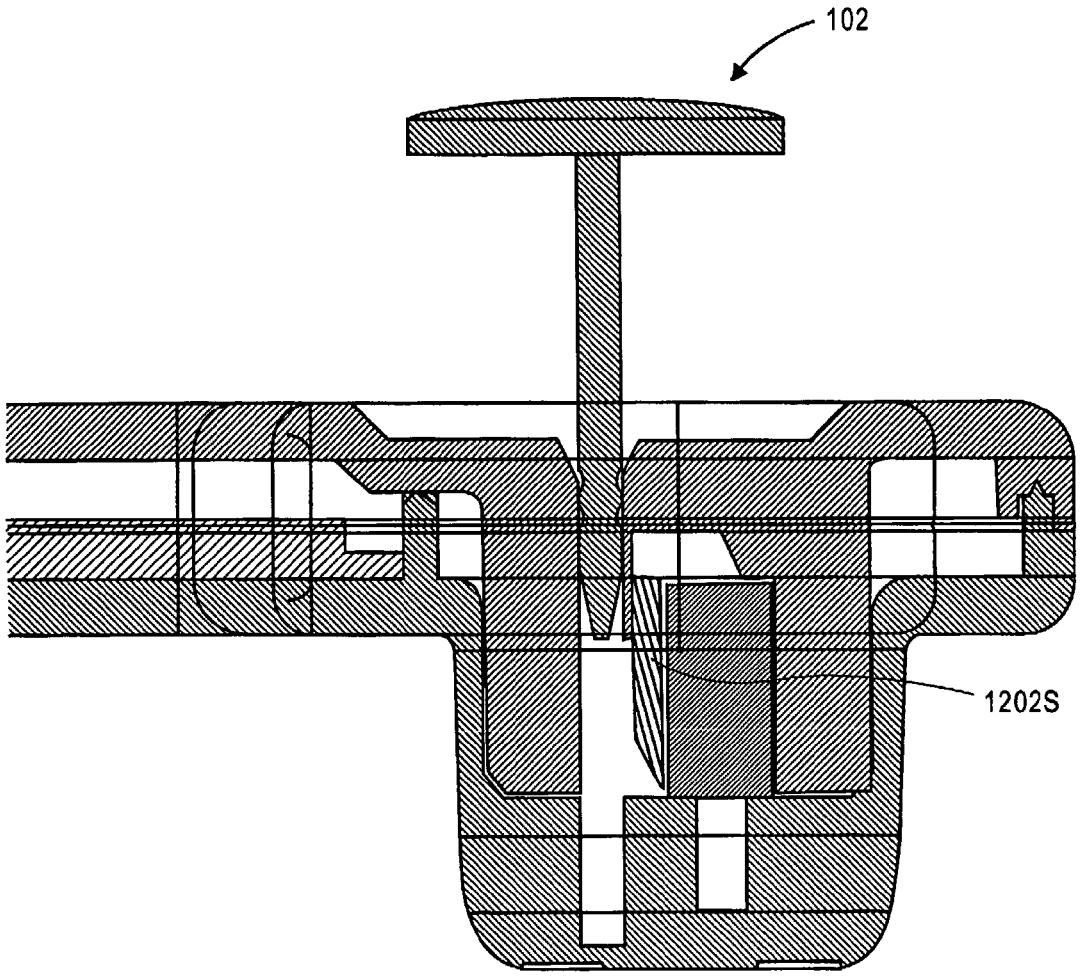
FIG. 30 illustrates a seventh view of a cross-section taken along line D-D of a single-use security tag with a tack, wedge, and rubber spring, in accordance with one embodiment.

FIG. 30 illustrates a seventh view of a cross-section taken along line D-D of a single-use security tag with a tack, wedge, and rubber spring, in accordance with one embodiment. FIG. 30 shows the same permanent unlock condition may exist when security tag 100 is removed from magnetic detaching device 602. Tack assembly 102 may be retracted before or after security tag 100 is removed from magnetic detaching device 602. In the configuration shown in FIG. 29 and FIG. 30, wedge 1202S cannot be restored to the rest condition of FIG. 20 for reuse without disassembling and rebuilding the security tag 100.

Figure 31:
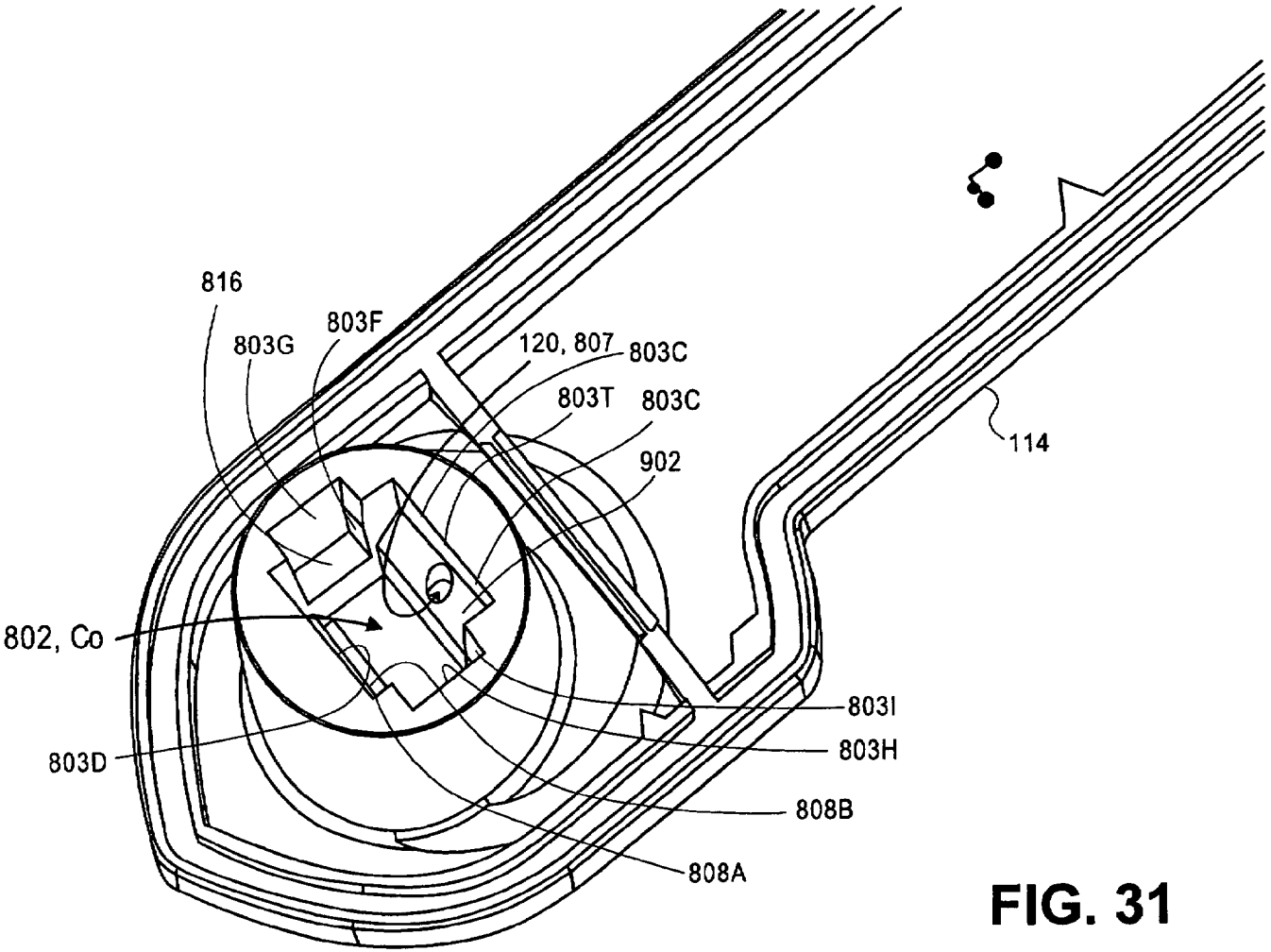
FIG. 31 illustrates an interior view of an upper housing for a single-use security tag in accordance with one embodiment.

FIG. 31 illustrates an interior view of an upper housing for a single-use security tag in accordance with one embodiment. FIG. 31 shows one possible configuration of the single-use tack retaining system compartment 802 to reduce or eliminate the effects of slamming. The identifiers of FIG. 31 are similar to those used for FIG. 9G for comparison purposes. It is worthy to note that the walls controlling the location of rubber spring 1302 have been moved so that rubber spring 1302 is essentially centered over the center of gravity of wedge 1202S. This configuration of wedge compartment 802 virtually eliminates the effects of slamming as defined earlier.

The embodiment of FIG. 8D yielded the Fp-ATC curve C in FIG. 10. The embodiment of FIG. 8D, although it has practical functionality when Fp values do not exceed about 20 pounds, values of Fp above 20 pounds create undesirable characteristics. Improvements to overcome these undesirable characteristics were made resulting in the tack retaining system embodiment of FIG. 9F. The outside appearance and basic functionality of the security tag 100 and the tack 102 did not change, but improvements have been introduced involving both the reusable version and the single-use version of the security tag 100. These improvements primarily involved means of increasing the Fpo and reducing the additional tack clearance for each value of Fp, but special attention was given to preventing defeat of the single-use version by "slamming" or "ratcheting".

Several "pull" tests were performed to verify that the changes made to the first tack retaining system embodiment of FIG. 8D resulting in the tack retaining system embodiment of FIG. 9F did indeed provide the improvements desired. All six pull tests and associated curve discussions that follow reflect on the improved tack retaining system embodiment depicted in FIGS. 9E, 9F, and 9G. Each pull was made on a Chatillon Model USTM machine at a pull rate of 3 inches per minute. Each of pull tests 1-6 involved pulls on four identical tags and tacks, with a first Fp pull to 15 pounds, a second Fp pull to 50 pounds, a third Fp pull to 100 pounds, and a forth Fp pull to Fpo. Pull test 5 added two additional pulls; a fifth identical tag for a pull to an Fp of 25 pounds, and a sixth identical tag for a pull to an Fp of 120 pounds. Pull test 6 added two additional pulls as well; a fifth identical tag for a pull to an Fp of 25 pounds, and a sixth identical tag for a pull to an Fp of 140 pounds. The tag housings were made of ABS plastic or of polycarbonate plastic as discussed below. All resulting curves are shown in FIG. 10. All pull tests revealed that undesirable characteristics number (4), (5), and (6) were completely overcome by their respective remedies. Improvements to undesirable characteristics (1) and (2) are shown directly in the curves of FIG. 10, and an improvement to (3) is discussed for each pull test. The permanent ATC values are also discussed.

The result of pull test 1 is reflected in curve D. Curve D is typical for a single-use tack retaining system embodiment having an ABS plastic housing, a wedge hardness of RC 47, a tack hardness of RC 40. The Fp=15 lbs pull yielded a permanent ATC of 0.007 inches and a Fi of "0" pounds required to attain the free condition. The Fp=50 lbs pull yielded a permanent ATC of 0.025 inches and an Fi of 2 pounds required to attain the free condition. The Fp=100 lbs pull yielded a permanent ATC of 0.038 inches and an Fi of 5 pounds required to attain the free condition. The forth pull yielded an Fpo of 110 pounds at an ATC of 0.097 inches.

The result of pull test 2 is reflected in curve E. Pull test 2 is essentially a repeat of pull test 1 except that a reusable wedge is used. The only significant difference is that the Fpo is 120 pounds. The extra 10 pounds can be attributed to the larger bearing surface against wall 808D that the reusable wedge has. The ATC at Fpo increased from 0.097 to 0.102 inches.

The result of pull test 3 is reflected in curve F. Pull test 3 is essentially a repeat of pull test 1 except that the housing material is the firmer polycarbonate plastic. Note the major difference is that the Fpo increased from 110 pounds to 130 pounds, and ATC increased from 0.097 to 0.104 inches. The permanent ATC improved about 20% at each Fp value, and Fi was about the same at each Fp value.

The result of pull test 4 is reflected in curve G. Pull test 4 is essentially a repeat of pull test 3 except that a reusable wedge is used. Note the major difference is that the Fpo increased from 130 pounds to 140 pounds, and ATC at Fpo increased from 0.104 to 0.107 inches.

The result of pull test 5 is reflected in curve H. Pull test 5 is essentially a repeat of pull test 1 except that the wedge hardness is approximately RC 42 and the tack hardness is approximately RC 48. An improvement in Fpo from 110 to 125 pounds was accomplished, and a reduction in ATC at Fpo from 0.097 to 0.082 inches was accomplished. The Fp=15 lbs pull yielded a permanent ATC of 0.008 inches and a Fi of "0" pounds required to attain the free condition. The Fp=25 lbs pull yielded a permanent ATC of 0.012 inches and an Fi of 0.4 pounds required to attain the free condition. The Fp=50 lbs pull yielded a permanent ATC of 0.020 inches and an Fi of 2 pounds required to attain the free condition. The Fp=100 lbs pull yielded a permanent ATC of 0.029 inches and an Fi of 5 pounds required to attain the free condition. The Fp=120 lbs pull yielded a permanent ATC of 0.034 inches and an Fi of 6 pounds required to attain the free condition. The sixth pull yielded an Fpo of 125 pounds at an ATC of 0.082 inches.

The result of pull test 6 is reflected in curve I. Pull test 6 is essentially a repeat of pull test 5 except that the housing material is the firmer polycarbonate plastic. An improvement in Fpo from 125 to 145 pounds was accomplished. The ATC at Fpo remained the same. The Fp=15 lbs pull yielded a permanent ATC of 0.004 inches and a Fi of "0" pounds required to attain the free condition. The Fp=25 lbs pull yielded a permanent ATC of 0.007 inches and a Fi of 0.5 pounds required to attain the free condition. The Fp=50 lbs pull yielded a permanent ATC of 0.012 inches and a Fi of 2 pounds required to attain the free condition. The Fp=100 lbs pull yielded a permanent ATC of 0.025 inches and a Fi of 5 pounds required to attain the free condition. The Fp=140 lbs pull yielded a permanent ATC of 0.026 inches and a Fi of 7 pounds required to attain the free condition. The sixth pull yielded an Fpo of 145 pounds at an ATC of 0.082 inches.

The pull test 6 results reflect all improvements to overcome the undesirable characteristics. Fpo is well above 125 pounds, the curve I is between curve A and curve B, and Fi requirements greatly improved. For example, for an Fp of 20 pounds the Fi reduced from 7 to less than 0.5 pounds, for an Fp of 50 pounds the Fi reduced from 15 to 2 pounds, for an Fp of 65 pounds the Fi required reduced from 35 to approximately 3 pounds. In summary, major enhancements in the curve C were made by the wedge stop, higher wedge angle when in locked condition, the firmer material, and the tack being harder than the wedge as described. Operational enhancements not seen on the curves included the following: (1) Fi improvement is primarily attributed to the wedge stop; (2) permanent ATC improved primarily due to using the firmer housing material, (3) ratcheting was reduced or eliminated by incorporating the sloped surface 808*a*, edge 808*b*, and the cored out area; (4) slamming was reduced or eliminated by relocating the rubber spring per FIG. 31; (5) after any strength of pull up to Fpo the tack will always re-catch the wedge, primarily due to the wedge stop; and (6) over-rotation reduced or eliminated by the wedge stop.

From these 6 pull tests performed, a reusable configuration suitable for a production environment may be derived. In one embodiment, for example, the following configuration and values may be used: (1) housing formed of polycarbonate plastic; (2) hardness of tack shank 106 is RC 47-50; (3) tack groove 108 and groove lip 107 should have a depth of 0.003 to 0.004 inches, groove length should be 0.040 inches minimum, and spacing should be approximately 0.040 inches; (4) wedge dimensions should be 0.235 inches to 0.240 inches wide, by 0.032 inches +/−0.001 inches thick, with axel protrusions 1221R and 1222R each being approximately 0.032 inch cubes (as illustrated in FIG. 12A), the angle of sharp edge 1220 should be 30°+/−1 degree and 0.236 inches to 0.242 inches long, and wedge 1202R should have a hardness of RC 40 to RC 43. The embodiments are not limited in this context.

Using the above configuration, the embodiment may have an Fp versus additional tack clearance curve (depicted as curve I in FIG. 10) that is almost linear for Fp from 0 to 145 pounds, additional tack clearance of approximately 0.080 inches at Fpo, and a rate of approximately 1800 pounds/inch. The limits for the rate and pullout value have, to the first order, been reached. Further tests have shown that using the above configuration, changing only to a tack hardness of RC50 to RC52 and a measured wedge hardness of RC45, the Fpo is typically 170 lbs at an ATC of typically 0.090 inches; and the same test using ABS plastic for the housing yields a typical Fpo of 150 lbs at an ATC of typically 0.090 inches.

Other improvements are also possible, but may have higher corresponding costs to consider. For example, although a firmer plastic such as polycarbonate might be used to reduce the plastic yield, the higher cost may not be justified because the slightly less Fpo (and slightly more additional tack clearance) of the softer and less expensive ABS plastic might be acceptable. An Fpo of approximately 125 pounds at an additional tack clearance of about 0.070 inches at an Fp of 100 pounds that is attainable using ABS plastic is better than most conventional reusable security tags. In another example, surface 1207R of wedge 1202R might be rounded to fit loosely into a rounded corner of intersection 803D and 808A. This may result in an increased Fpo by approximately 5 pounds, although the incremental increase may not justify the additional cost to round surface 1207R. The embodiments are not limited in this context.

Numerous specific details have been set forth herein to provide a thorough understanding of the embodiments. It will be understood by those skilled in the art, however, that the embodiments may be practiced without these specific details.

In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. A security tag, comprising:

an attachment end having a first compartment to hold a tack retaining system, said tack retaining system to include a wedge and a rubber spring arranged to retain a tack assembly, and to release said tack assembly when said attachment end is exposed to a magnetic field; and a detection end having a second compartment to hold an electronic article surveillance sensor, wherein said wedge to have a first end and a second end and is positioned to pivot around said second end, and said spring is positioned to bias said first end against a wedge stop of said first compartment.

2. The security tag of claim 1, said first compartment to have a wall, and said rubber spring positioned to bias said second end against said wall.

3. The security tag of claim 1 wherein said wedge stop is part of a wall extending along a tack shank of said tack assembly.

4. The security tag of claim 1, said first end to have an inclined surface tapering to a tack retaining edge.

5. The security tag of claim 4, said tack assembly to have a tack shank, said tack shank having a groove to contact said tack retaining edge as said tack shank is inserted within said attachment end.

6. The security tag of claim 5, said tack retaining edge to form a concave semi-circular ledge around said groove of said tack shank.

7. The security tag of claim 5, said groove having a groove lip, said rubber spring to bias said tack retaining edge into said groove as said tack shank is inserted within said attachment end, said groove lip to contact said tack retaining edge and prevent said tack assembly from being withdrawn from said attachment end to form a locked condition.

8. The security tag of claim 5, said magnetic field to pull said first end away from said groove toward a magnetic surface to release said tack shank.

9. The security tag of claim 5, wherein said tack retaining system is arranged for reuse.

10. The security tag of claim 9, said wedge further comprising a first axel protrusion and a second axel protrusion, and said first compartment to have a first recess and a second recess to receive said first and second axel protrusions, respectively.

11. The security tag of claim 10, said first recess and second recess to hold said first and second axel protrusions to allow said wedge to pivot around said second end to retain said tack shank, and to allow said rubber spring to push said wedge to a rest condition once said tack shank has been removed from said attachment end.

12. The security tag of claim 5, wherein said tack retaining system is arranged for a single use.

13. The security tag of claim 12, said magnetic field to pull said second end away from said wall, and said rubber spring to push said second end towards said tack shank until said second end passes a ledge for said wall.

14. The security tag of claim 13, said magnetic field to pull said wedge to a position substantially perpendicular to a magnetic surface.

15. The security tag of claim 1, said first end to have a detacher interface for a magnetic detaching device.

16. The security tag of claim 15, said detacher interface to correspond to a tag interface for said magnetic detaching device.

17. The security tag of claim 1, said wedge to be disposed within said first compartment with sufficient clearance to pivot approximately about a pivot edge.

18. A tack retaining system, comprising a first compartment having disposed therein a wedge and a rubber spring, said rubber spring arranged to bias said wedge to retain a tack assembly, and to release said tack assembly when an attachment end is exposed to a magnetic field, wherein said wedge to have a first end and a second end and is positioned to pivot around said second end, and said spring is positioned to bias said first end against a wedge stop of said first compartment.

19. The tack retaining system of claim 18, said first compartment to have a wall and said rubber spring positioned to bias said second end against said wall.

20. The tack retaining system of claim 18 wherein said wedge stop is part of a wall extending along a tack shank of said tack assembly.

21. The tack retaining system of claim 18, said first end to have an inclined surface tapering to a tack retaining edge.

22. The tack retaining system of claim 20, said tack assembly to have a tack shank, said tack shank having a groove to contact said tack retaining edge as said tack shank is inserted within said attachment end.

23. The tack retaining system of claim 22, said groove having a groove lip, said rubber spring to bias said tack retaining edge into said groove, said groove lip to contact said tack retaining edge to form a locked condition.

24. The tack retaining system of claim 22, said magnetic field to pull said first end away from said groove toward a magnetic surface to release said tack shank.

25. The tack retaining system of claim 22, wherein said tack retaining system is arranged for reuse.

26. The tack retaining system of claim 25, said wedge further comprising a first axel protrusion and a second axel protrusion, and said first compartment to have a first recess and a second recess to receive said first and second axel protrusions, respectively.

27. The tack retaining system of claim 26, said first recess and second recess to hold said first and second axel protrusions to allow said wedge to pivot around said second end to retain said tack shank, and to allow said rubber spring to push said wedge to a rest condition once said tack shank has been removed.

28. The tack retaining system of claim 22, wherein said tack retaining system is arranged for a single use.

29. The tack retaining system of claim 28, said magnetic field to pull said second end away from said wall, and said rubber spring to push said second end towards said tack shank until said second end passes a ledge for said wall.

30. The tack retaining system of claim 29, said magnetic field to pull said wedge to a position substantially perpendicular to a magnetic surface.

31. A magnetic detaching device, comprising:

a magnet to generate a magnetic field; and a housing to house said magnet, said housing to include a detacher interface to correspond to a tag interface for a security tag having a tack retaining system, said tack retaining system to include a wedge and a rubber spring arranged to retain a tack assembly, and to release said tack assembly when an attachment end is exposed to said magnetic field, wherein said wedge to have a first end and a second end and is positioned to pivot around said second end, said spring is positioned to bias said first end against a wedge stop of a first compartment.

32. The detacher of claim 31, said tag interface to include a tag protrusion for said security tag.

33. The detacher of claim 32, said detacher interface arranged to receive said tag protrusion.

34. The detacher of claim 33, said tag interface and said detacher interface arranged to position said tack retaining system of said security tag within said magnetic field of said magnet.

* * * * *